US007722150B2

(12) United States Patent
Furukawa et al.

(10) Patent No.: US 7,722,150 B2
(45) Date of Patent: May 25, 2010

(54) IMAGE RECORDING APPARATUS AND IMAGE RECORDING METHOD

(75) Inventors: Gentaro Furukawa, Kanagawa-ken (JP); Toshiya Kojima, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 464 days.

(21) Appl. No.: 11/882,850

(22) Filed: Aug. 6, 2007

(65) Prior Publication Data

US 2008/0030536 A1 Feb. 7, 2008

(30) Foreign Application Priority Data

Aug. 7, 2006 (JP) ..... 2006-214449

(51) Int. Cl.
*B41J 29/393* (2006.01)

(52) U.S. Cl. ..... 347/19

(58) Field of Classification Search ..... 347/16, 347/19, 105; 358/504; 73/865.9
See application file for complete search history.

(56) References Cited

U.S. PATENT DOCUMENTS 6,955,412 B2 * 10/2005 Hin ..... 347/19
7,171,864 B2 * 2/2007 Schmitz et al. ..... 73/865.9

FOREIGN PATENT DOCUMENTS

JP 2003-211770 A 7/2003
JP 2004-17458 A 1/2004

* cited by examiner

*Primary Examiner*—Lamson D Nguyen
(74) *Attorney, Agent, or Firm*—Birch, Stewart, Kolasch & Birch, LLP

(57) ABSTRACT

The image recording apparatus includes: a recording device which deposits an image record substance on a recording medium; a recording medium conveyance device which includes a conveyance medium having a recording medium hold region and conveying the recording medium with respect to the recording device in a conveyance direction while holding the recording medium on the recording medium hold region, the recording medium conveyance device being provided with a determination pattern which is formed outside the recording medium hold region on the conveyance medium and follows the conveyance direction; a determination device which determines the determination pattern while the recording medium is held on the conveyance medium; a calculation device which acquires speed variation data of the conveyance medium in accordance with determination results of the determination device; a storage device which stores the speed variation data acquired by the calculation device; and a record timing correction device which corrects record timing of the recording device in accordance with the speed variation data of the conveyance medium stored in the storage device.

25 Claims, 25 Drawing Sheets

P<Xa

P<Xb

Q>W+Xa

R>W+Xb

IMAGE RECORDING APPARATUS AND IMAGE RECORDING METHOD

BACKGROUND OF THE INVENTION

1. Field of the Invention

The present invention relates to an image recording apparatus and an image recording method, and more particularly, to a configuration of an image recording apparatus, and image forming technology, for forming an image on a recording medium.

2. Description of the Related Art

An inkjet recording apparatus has been known which forms an image on a recording medium, or the like, by ejecting ink from a head while conveying a recording medium or an intermediate transfer body which is fixed to a conveyance mechanism, such as a conveyance belt. In this inkjet recording apparatus, image deterioration, such as non-uniformities and color deviation, is likely to occur in the image recorded on the recording medium, or the like, when variation occurs in the conveyance speed of the recording medium, or the like, due to vibrations, fluctuations in the conveyance load resistance, or the like. Various technologies have been proposed in order to prevent non-uniformities and color deviation caused by the conveyance of the recording medium, or the like.

In the invention described in Japanese Patent Application Publication No. 2004-17458, an encoder is provided which detects slits provided on the edge of a conveyor belt, and ejection from the print head is controlled in synchronism with the output pulse signal output from the encoder, in such a manner that colored inks are ejected in consideration of the actual conveyance speed, thereby preventing color deviation in the sub-scanning direction.

In the invention described in Japanese Patent Application Publication No. 2003-211770, the color sequence in a recording device is KCMY, resist marks are recorded onto the recording paper at uniform intervals at the time of printing of the color K (black), the deviation in the movement speed of the recording paper is calculated from information obtained by reading in the resist marks, and the print timing for the colors C, M and Y is controlled on the basis of the calculated deviation in the movement speed of the recording paper, thereby eliminating color deviation caused by eccentricity in the recording paper rollers, or color non-uniformities caused by the density variations in the dots.

However, in the invention described in Japanese Patent Application Publication No. 2004-17458, since ejection is controlled in synchronism with an output pulse from the encoder, then a uniform time delay occurs between the detection and ejection, and it is difficult to provide correction for speed variations in cases where the speed variations occur in a short period of time.

In the invention described in Japanese Patent Application Publication No. 2003-211770, the behavior of the recording paper during printing and recording of the color K (black) affects positions of the resist marks, and therefore, if a non-uniformity occurs in the color K, then this non-uniformity is also superimposed on the other colors, C, M and Y, and it becomes difficult to eliminate the non-uniformity. For example, non-uniformities arise in the recorded image, as a result of impacts which occur when the recording paper is pinched between the conveyance rollers or separates from the conveyance rollers.

SUMMARY OF THE INVENTION

The present invention has been contrived in view of these circumstances, an object thereof being to provide an image recording apparatus and an image recording method which do not produce image degradation as a result of non-uniformities or color deviation in the recorded image, even if there is variation in the conveyance speed of the recording medium.

In order to attain the aforementioned object, the present invention is directed to an image recording apparatus, comprising: a recording device which deposits an image record substance on a recording medium; a recording medium conveyance device which includes a conveyance medium having a recording medium hold region and conveying the recording medium with respect to the recording device in a conveyance direction while holding the recording medium on the recording medium hold region, the recording medium conveyance device being provided with a determination pattern which is formed outside the recording medium hold region on the conveyance medium and follows the conveyance direction; a determination device which determines the determination pattern while the recording medium is held on the conveyance medium; a calculation device which acquires speed variation data of the conveyance medium in accordance with determination results of the determination device; a storage device which stores the speed variation data acquired by the calculation device; and a record timing correction device which corrects record timing of the recording device in accordance with the speed variation data of the conveyance medium stored in the storage device.

In this aspect of the present invention, since sudden speed variation caused in the conveyance medium on which the recording medium is held is corrected on the basis of the speed variation data of the conveyance medium stored in the storage device, then the occurrence of non-uniformities in the recorded image as a result of the sudden speed variation of the conveyance medium is prevented. Furthermore, since the speed variation data stored previously in the storage device is used for correcting the speed variation of the conveyance medium, then no delay arises due to the determination time or the processing time, compared to a system where the speed variation of the conveyance medium is corrected while the behavior of the conveyance medium is determined.

Here, the image record substance may be colored ink for forming a color image, resist for forming a pattern shape, or the like.

Moreover, the "recording medium" is a medium which receives the image record substance deposited by a recording device, and the recording medium includes various types of media, irrespective of material and size, such as continuous paper, cut paper, sealed paper or other types of paper, or resin sheets, film, cloth, metal sheets, and other materials.

The conveyance medium includes, for example, an endless belt wound about a plurality of rollers, or a plate-shaped member which is movable in a prescribed direction by means of a conveyance mechanism. Resin material and metal material are suitably used for the conveyance medium.

It is sufficient to provide the determination pattern only at portions corresponding to the region where the recording medium is held on the conveyance medium, the determination pattern following the conveyance direction of the recording medium. Of course, the determination pattern may also be provided throughout the whole of the recording medium in the conveyance direction.

A mode is possible where the determination device includes: a determination unit which determines the determination pattern and outputs a determination signal; and a signal processing unit which carries out prescribed signal processing (noise reduction, amplification, and the like) on the determination signal.

The "image" referred in the present invention not only mean an image such as a photograph or a picture, but also includes a wiring pattern formed on a printed wiring board, or a mask pattern used to form a three-dimensional shape on a substrate, or the like.

Preferably, the above-described image recording apparatus further includes: a supply device which supplies the recording medium to the recording medium conveyance device; and an output device which outputs the recording medium from the recording medium conveyance device, wherein the determination device determines the determination pattern during a period including a time point when the recording medium comes out of contact with the supply device and a time point when the recording medium comes into contact with the output device.

In this aspect of the present invention, it is possible to prevent image degradation caused by the speed variation occurring in the conveyance medium when the recording medium separates from the supply device, or the speed variation occurring in the conveyance medium when the recording medium comes into contact with the output device.

Preferably, the record timing correction device corrects the record timing of the recording device so as to eliminate an error based on difference between an actual conveyance amount of the conveyance medium and a theoretical conveyance amount of the conveyance medium.

In other words, by correcting the cycle of the trigger signal which indicates the record timing, it is possible to make the conveyance amount of the conveyance medium between two record timings coincide with the theoretical conveyance amount. If the actual conveyance distance is greater than the theoretical conveyance distance, then the record timing is corrected in such a manner that the cycle of the trigger signal becomes shorter, and if the actual conveyance distance is shorter than the theoretical distance, then the record timing is corrected in such a manner that the cycle of the trigger signal becomes longer.

Preferably, the recording medium conveyed by the recording medium conveyance device when the determination pattern is determined by the determination device, has a type and a size identical to the recording medium used in actual image recording.

In this aspect of the present invention, by using the recording medium which is used in actual image recording, when reading in the determination pattern, it is possible to calculate and correct the speed variation of the conveyance medium which occurs during actual image formation, in an accurate fashion, and hence a desirable recording image can be obtained.

Here, there are various types of recording media with different materials, different thicknesses, and different shapes, and the like; and, in this aspect of the present invention, the recording medium conveyed in determining the determination pattern may have a type identical to the recording medium used in actual image recording, in respect of at least one of these parameters.

Preferably, the determination pattern is formed by a photographic method.

In this aspect of the present invention, it is possible to form the determination pattern, with good accuracy, and therefore improvement in the accuracy of determining speed variations are expected.

A photographic method is a method which forms a pattern of photosensitive material by exposing photosensitive material through a mask in which holes corresponding to a pattern are formed. One characteristic feature of a photographic method is that it allows the formation of highly fine patterns by changing the magnification optically in the exposure step. For the method of forming the test pattern 37 (determination pattern) used in the present invention, apart from a photographic method in which photosensitive material is exposed, it is also possible to form a pattern of a liquid containing photosensitive material, such as a liquid resin, by means of a mask formed with fine pattern, whereupon the liquid is cured by heating or cooling, or by means of a chemical method.

In order to attain the aforementioned object, the present invention is also directed to an image recording apparatus, comprising: a recording device which deposits an image record substance on a recording medium; a recording medium conveyance device which conveys the recording medium with respect to the recording device in a conveyance direction while holding the recording medium; a storage device which stores speed variation data of the recording medium acquired in accordance with determination results of a determination pattern composed of the image record substance deposited on the recording medium by the recording device; and a record timing correction device which corrects record timing of the recording device in accordance with the speed variation data of the recording medium stored in the storage device.

In this aspect of the present invention, sudden speed variation occurring in the recording medium, and the speed variation of the recording medium caused by sudden speed variation occurring in the conveyance medium due to stretching or defects in the conveyance medium, or slippage between the recording medium and the conveyance medium, are corrected on the basis of the speed variation data of the recording medium stored in the storage device. Therefore, the occurrence of non-uniformities in the recorded image due to sudden speed variations in the recording medium is prevented. Furthermore, since speed variation data stored previously in the storage device is used for correcting speed variation of the recording medium, then no delay arises due to the determination time or the processing time, compared to a system where speed variation of the recording medium is corrected while the behavior of the conveyance medium or recording medium is determined.

Preferably, the above-described image recording apparatus further includes a determination and calculation device which acquires the speed variation data of the recording medium to be stored in the storage device, the determination and calculation device including: a determination unit which determines the determination pattern on the recording medium; a movement unit which moves the recording medium on which the determination pattern is formed and the determination device relatively to each other; and a calculation unit which acquires the speed variation data of the recording medium in a state of being held on the recording medium conveyance device, in accordance with the determination results of the determination unit.

In this aspect of the present invention, since the determination pattern is determined at a position outside the conveyance system used for image recording (in other words, the determination pattern is determined in the determination and calculation device that is independent from the recording medium conveyance device), then the determination pattern is determined in a desirable fashion without being affected by vibrations, or the like, of the conveyance system being used for image recording while reading in the determination pattern.

The determination and calculation device may be provided inside the image recording apparatus or it may be provided externally to the image recording apparatus. In a mode where the determination and calculation device is provided inside the image recording apparatus, the determination and calculation device may be detachably installed to the image recording apparatus.

Preferably, the record timing correction device corrects the record timing of the recording device so as to eliminate an error based on difference between an actual conveyance amount of the recording medium and a theoretical conveyance amount of the recording medium.

In other words, by correcting the cycle of the trigger signal which indicates the record timing, it is possible to make the conveyance distance of the recording medium during two record timings coincide with the theoretical conveyance distance. If the actual conveyance distance is greater than the theoretical conveyance distance, then the record timing is corrected in such a manner that the cycle of the trigger signal becomes shorter, and if the actual conveyance distance is shorter than the theoretical distance, then the record timing is corrected in such a manner that the cycle of the trigger signal becomes longer.

Preferably, the recording medium on which the determination pattern is formed by the recording device, has a type and a size identical to the recording medium used in actual image recording.

In this aspect of the present invention, by using the recording medium which is used in actual image recording, when recording the determination pattern, it is possible to determine and correct the speed variation of the recording medium which occurs during actual image formation, in an accurate fashion, and hence a desirable recording image can be obtained.

Preferably, the above-described image recording apparatus further includes: a supply device which supplies the recording medium to the recording medium conveyance device; and an output device which outputs the recording medium from the recording medium conveyance device, wherein: a length P of the recording medium in the conveyance direction, a distance $X_a$ between the output device and an end of the recording device on a side of the output device, and a distance $X_b$ between the supply device and an end of the recording device on a side of the supply device, have at least one of relationships of $P \geqq X_a$ and $P \geqq X_b$; and the determination pattern is formed on the recording medium throughout the length P of the recording medium.

In this aspect of the present invention, even in the case of using a recording medium having a size such that the recording medium is being subjected to image recording at the time that the recording medium separates from the supply device or at the time that the recording medium comes into contact with the output device, it is still possible to correct the speed variation of the recording medium occurring in the recording medium when the recording medium separates from the supply device or when the recording medium comes into contact with the output device.

Preferably, the image recording apparatus further includes: a supply device which supplies the recording medium to the recording medium conveyance device; and an output device which outputs the recording medium from the recording medium conveyance device, wherein: at least one of following inequality expressions is satisfied:

$$Q<W+X_a, \text{ and}$$

$$Q<W+X_b,$$

where $X_a$ is a distance between the output device and an end of the recording device on a side of the output device, $X_b$ is a distance between the supply device and an end of the recording device on a side of the supply device, W is a length of the recording device in the conveyance direction, and Q is a distance between a leading end of a preceding recording medium and a leading end of a subsequent recording medium which is conveyed after the preceding recording medium when a plurality of recording media are conveyed consecutively; and the determination pattern is recorded on each of the plurality of recording media throughout the length of the recording media in the conveyance direction.

In this aspect of the present invention, in a mode where a plurality of recording media are conveyed consecutively and images are recorded thereon, it is possible to correct the speed variation occurring in a recording medium when another recording medium separates from the supply device or comes into contact with the output device.

Preferably, the image recording apparatus further includes: a supply device which supplies the recording medium to the recording medium conveyance device; and an output device which outputs the recording medium from the recording medium conveyance device, wherein: the determination pattern is formed on each of n pieces of recording medium throughout lengths of the n pieces of recording medium in the conveyance direction, in a case where the n pieces of recording medium are conveyed consecutively, n being a natural number not less than two; and at least one of following inequality expressions is satisfied:

$$R_n<W+X_a, \text{ and}$$

$$R_n<W+X_b,$$

where $X_a$ is a distance between the output device and an end of the recording device on a side of the output device, $X_b$ is a distance between the supply device and an end of the recording device on a side of the supply device, W is a length of the recording device in the conveyance direction, and $R_n$ is a distance between a leading end of a first recording medium to be conveyed first and a trailing end of a last recording medium to be conveyed last.

In this aspect of the present invention, in a mode where n pieces of recording media are conveyed consecutively and images are recorded thereon, it is possible to correct the speed variation occurring in a recording medium when another recording medium separates from the supply device or comes into contact with the output device.

Preferably, the image recording apparatus further comprises: a supply device which supplies the recording medium to the recording medium conveyance device; and an output device which outputs the recording medium from the recording medium conveyance device, wherein: the determination pattern is formed on each of a first recording medium and a second recording medium following the first recording medium, throughout lengths of the first recording medium and the second recording medium; and following inequality expressions are satisfied:

$$P_1 \geqq X_a,\ P_2 \geqq X_a,\ P_1 \geqq X_b,\ P_2 \geqq X_b, \text{ and } P_1+P_2+P_d<X_a+X_b+W,$$

where $P_1$ is a length of the first recording medium in the conveyance direction, $P_2$ is a length of the second recording medium in the conveyance direction, $P_d$ is a distance between an end of the first recording medium on a side of the second recording medium and an end of the second recording medium on a side of the first recording medium, $X_a$ is a distance between the output device and an end of the recording device on a side of the output device, $X_b$ is a distance between the supply device and an end of the recording device on a side of the supply device, and W is a length of the recording device in the conveyance direction.

In this aspect of the present invention, by using two pieces of recording media, it is possible to determine the speed variation data corresponding to all of the possible factors of the speed variation, in a mode where a plurality of recording media are conveyed consecutively and images are recorded thereon.

Preferably, the recording device includes a plurality of recording heads which deposit different types of image record substances on the recording medium; the recording medium is demarcated into a plurality of regions corresponding to the plurality of recording heads; and the determination patterns are respectively formed on the plurality of regions by the plurality of recording heads.

In this aspect of the present invention, since, in a mode where a plurality of recording heads are provided, the record positions of the recording heads at the same timing are mutually different, then by determining the speed variation data for each recording head, it is possible to achieve correction of the speed variation of the recording medium in consideration of the differences in the recording positions on the recording medium of the respective recording heads.

The different types of image record substances include inks of different colors. The plurality of recording heads corresponding to the different types of image record substances include recording heads for respective colors.

Preferably, the image recording apparatus further comprises: a speed variation position calculation device which calculates a position on the recording medium corresponding to a timing at which the speed variation occurs, in accordance with a position of the recording device in a conveyance path of the recording medium; and a determination control device which controls the determination and calculation device in such a manner that the determination unit selectively determines the determination pattern at the position on the recording medium corresponding to the timing at which the speed variation occurs, in accordance with calculation results of the speed variation position calculation device.

In this aspect of the present invention, it is possible to reduce the volume of determination data determined by the determination device, and this contributes to reducing the processing load of the calculation device which acquires the speed variation data, reducing the storage capacity of the storage device which stores the speed variation data, and thus helping to reduce the overall cost of the apparatus.

In order to attain the aforementioned object, the present invention is also directed to an image recording apparatus, comprising: a recording device which deposits an image record substance on an intermediate transfer body; a transfer device which transfers an image composed of the image record substance deposited on the intermediate transfer body to a recording medium by causing the intermediate transfer body and the recording medium to move relative to each other while causing the intermediate transfer body and the recording medium to be pressed against each other; a determination device which determines a determination pattern composed of the image record substance on the intermediate transfer body deposited by the recording device; a calculation device which acquires speed variation data of the intermediate transfer body in accordance with determination results acquired by the determination device; a storage device which stores the speed variation data of the intermediate transfer body acquired by the calculation device; and a record timing correction device which corrects record timing of the recording device in accordance with the speed variation data of the intermediate transfer body stored in the storage device.

In this aspect of the present invention, in an image recording apparatus which uses a so-called transfer method, in a mode where an image is formed on an intermediate transfer body while transferring an image from the intermediate transfer body to the recording medium, the speed variation occurring in the intermediate body due to the transfer operation is corrected and therefore it is possible to form a desirable image which is free of non-uniformities, on the intermediate transfer body.

In an image recording apparatus which uses the transfer method, the speed variation occurring in the recording medium when the recording medium is supplied or when the recording medium is output does not affect image recording onto the image transfer body.

Preferably, the recording device forms the determination pattern on the intermediate transfer body in a state where the intermediate transfer body and the recording medium are moved relatively to each other while being pressed against each other.

In this aspect of the present invention, since the determination pattern is recorded under the same conditions in the actual image formation on the image transfer body, then it is possible to determine the speed variation occurring in intermediate transfer body during actual image formation, accurately, and therefore the record timing can be corrected in a desirable fashion.

Preferably, the record timing correction device corrects the record timing so as to eliminate an error based on difference between an actual conveyance amount of the intermediate transfer body and a theoretical conveyance amount of the intermediate transfer body.

In other words, by correcting the cycle of the trigger signal which indicates the record timing, it is possible to make the conveyance distance of the intermediate transfer body during two record timings coincide with the theoretical conveyance distance. If the actual conveyance distance is greater than the theoretical conveyance distance, then the record timing is corrected in such a manner that the cycle of the trigger signal becomes shorter, and if the actual conveyance distance is shorter than the theoretical distance, then the record timing is corrected in such a manner that the cycle of the trigger signal becomes longer.

Preferably, the recording medium used when the determination pattern is recorded on the intermediate transfer body, has a type and a size identical to the recording medium used in actual image recording.

In this aspect of the present invention, by using the recording medium which is used in actual image recording, when forming the determination pattern, it is possible to determine and correct the speed variation of the intermediate transfer body which occurs during actual image formation, in an accurate fashion, and hence a desirable recording image can be obtained.

Preferably, the above-described image recording apparatuses further include an environment conditions measurement device which measures environment conditions including at least one of temperature and humidity in a conveyance path of the recording medium, wherein: the storage device stores the speed variation data in association with the environment conditions; the record timing correction device corrects the record timing of the recording device by reading out the speed variation data corresponding to the environment conditions measured by the environment conditions measurement device, from the storage device.

In this aspect of the present invention, even in cases where the thickness or the rigidity of the recording medium changes due to variation in the environmental conditions, such as the temperature and humidity, it is possible to correct the record timing in an appropriate manner.

In order to attain the aforementioned object, the present invention is also directed to an image recording method for an image recording apparatus which includes: a recording device which deposits an image record substance on a recording medium; and a recording medium conveyance device which includes a conveyance medium having a recording medium hold region and conveying the recording medium with respect to the recording device in a conveyance direction while holding the recording medium on the recording medium hold region, the image recording method comprising the steps of: determining a determination pattern which is formed outside the recording medium hold region on the conveyance medium and which follows the conveyance direction; calculating speed variation data of the conveyance medium in accordance with determination results of the determination pattern; storing the calculated speed variation data in a storage device; reading the stored speed variation data of the conveyance medium from the storage device; correcting record timing of the recording device in accordance with the read speed variation data; and recording an image on the recording medium with the recording device by depositing the image record substance on the recording medium according to the corrected record timing.

Moreover, in order to attain the aforementioned object, the present invention is also directed to an image recording method for an image recording apparatus which includes: a recording device which deposits an image record substance on a recording medium; and a recording medium conveyance device which conveys the recording medium with respect to the recording device in a conveyance direction while holding the recording medium, the image recording method comprising the steps of: determining a determination pattern composed of the image record substance which is deposited on the recording medium by the recording device; calculating speed variation data of the recording medium in accordance with determination results of the determination pattern; storing the calculated speed variation data in a storage device; reading the stored speed variation data of the recording medium from the storage device; correcting record timing of the recording device in accordance with the read speed variation data; and recording an image on the recording medium with the recording device by depositing the image record substance on the recording medium according to the corrected record timing.

Further, in order to attain the aforementioned object, the present invention is also directed to an image recording method for an image recording apparatus which includes: a recording device which deposits an image record substance on an intermediate transfer body; and a transfer device which transfers an image composed of the image record substance deposited on the intermediate transfer body to a recording medium by causing the intermediate transfer body and the recording medium to move relative to each other while causing the intermediate transfer body and the recording medium to be pressed against each other, the image recording method comprising the steps of: determining a determination pattern composed of the image record substance which is deposited on the intermediate transfer body by the recording device; calculating speed variation data of the intermediate transfer body in accordance with determination results of the determination pattern; storing the calculated speed variation data in a storage device; reading the stored speed variation data of the intermediate transfer body from the storage device; correcting record timing of the recording device in accordance with the read speed variation data; recording the image on the intermediate transfer body with the recording device by depositing the image record substance on the intermediate transfer body according to the corrected record timing; and transferring the recorded image on the intermediate transfer body to a recording medium with the transfer device.

According to the present invention, since sudden speed variation caused by the conveyance medium on which the recording medium is held is corrected on the basis of the speed variation data of the conveyance medium stored in the storage device, then the occurrence of non-uniformities in the recorded image as a result of the sudden speed variation of the conveyance medium is prevented. Furthermore, since the speed variation data stored previously in the storage device is used for correcting the speed variation of the conveyance medium, then no delay arises due to the determination time or the processing time, compared to a system where speed variation of the conveyance medium is corrected while the behavior of the conveyance medium is determined.

Moreover, sudden speed variation occurring in the recording medium, or speed variation of the recording medium caused by sudden speed variation occurring in the conveyance medium due to stretching or defects in the conveyance medium, or slippage between the recording medium and the conveyance medium, is corrected on the basis of the speed variation data for the recording medium stored in the storage device, and therefore the occurrence of non-uniformities in the recorded image due to sudden speed variations in the recording medium is prevented.

In an image recording apparatus which uses a so-called transfer method, in a mode where an image is formed on an intermediate transfer body while transferring an image from the intermediate transfer body to the recording medium, the speed variation occurring in the intermediate body due to the transfer operation is corrected and therefore it is possible to form a desirable image which is free of non-uniformities, on the intermediate transfer body.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

General Composition of Inkjet Recording Apparatus

Figure 1:
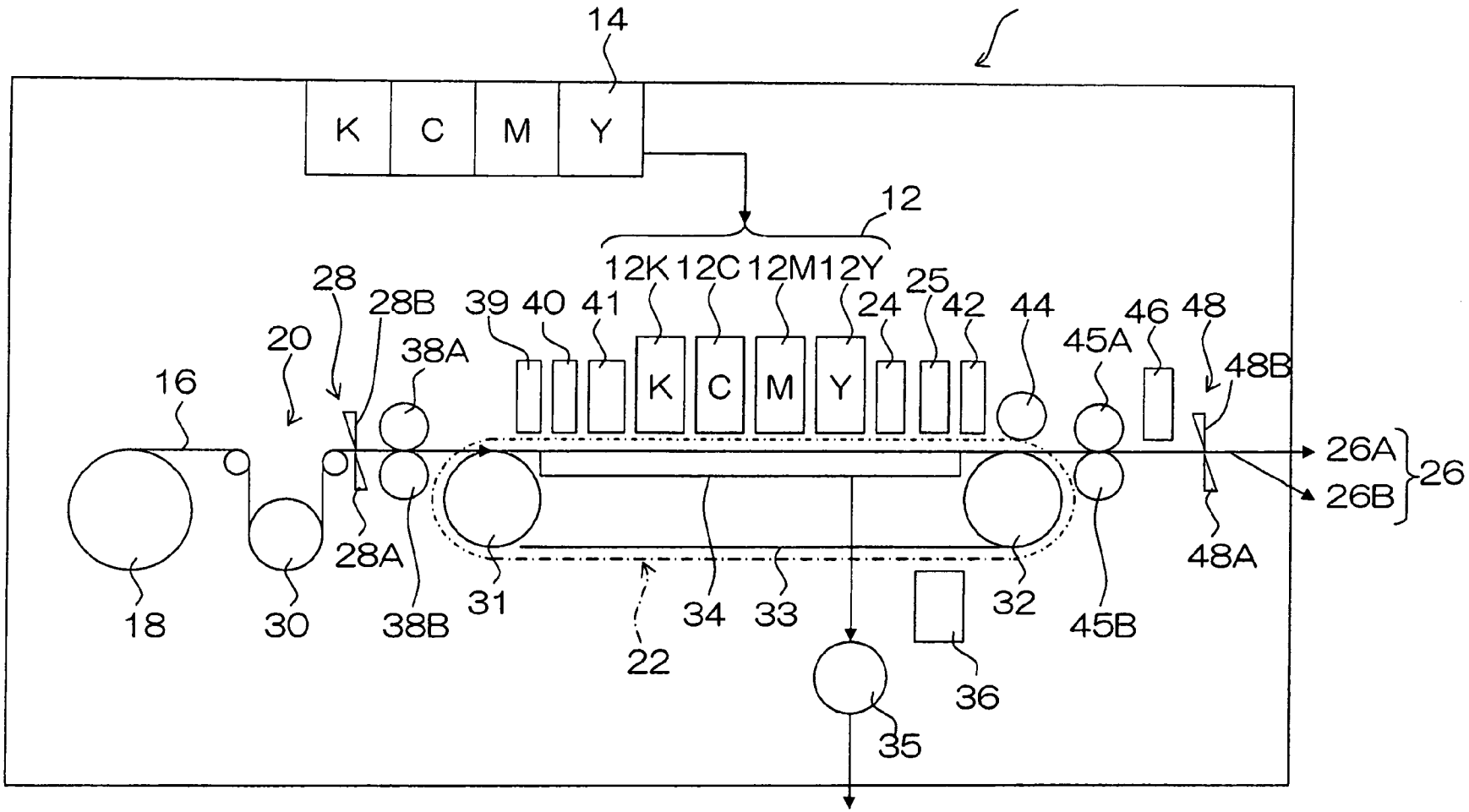
FIG. 1 is a basic schematic drawing of an inkjet recording apparatus according to a first embodiment of the present invention.

FIG. 1 is a diagram of the general composition of an inkjet recording apparatus (image recording apparatus) according to an embodiment of the present invention. As shown in FIG. 1, the inkjet recording apparatus 10 comprises: a recording unit 12 (recording device) having a plurality of recording heads 12K, 12C, 12M and 12Y for ink colors of black (K), cyan (C), magenta (M), and yellow (Y), respectively; an ink storing and loading unit 14 for storing inks of K, C, M and Y to be supplied to the respective recording heads 12K, 12C, 12M and 12Y; a paper supply unit 18 for supplying recording paper 16; a decurling unit 20 for removing curl in the recording paper 16 supplied from the paper supply unit 18; a suction belt conveyance unit 22 (conveyance device) disposed facing the nozzle face (ink ejection face) of the recording unit 12, for conveying the recording paper 16 while keeping the recording paper 16 flat; a print determination unit 24 for reading the printed result produced by the recording unit 12; a test pattern reading unit 25 (corresponding to a "determination device") which reads in a test pattern (corresponding to "determination pattern"; not shown in FIG. 1, but indicated by reference numeral 37 in FIG. 2) formed on the recording paper supporting surface of a conveyance belt 33 which supports and conveys the recording paper 16; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper. A composition may be adopted in which the recording paper information can be input by the user by means of a user interface.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 (conveyance medium) facing at least the nozzle face of the recording unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the recording unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction. In other words, the region of the belt 33 where the suction apertures are formed functions as a region (recording medium hold region) for holding the recording paper 16. The mode of holding the recording paper 16 on the belt 33 is not limited to a mode using air suction, and it is also possible to adopt other methods, as appropriate, such as electrostatic attraction in which static electricity is generated between the belt 33 and the recording paper 16, and the recording paper 16 is thereby attracted to the belt 33 by means of an electrostatic force.

The belt 33 is driven in the clockwise direction in FIG. 1 by the motive force of a motor 88 (not shown in FIG. 1, but shown in FIG. 6) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration of nipping with a brush roller, or a water absorbent roller or the like, an air blow configuration in which clean air is blown onto the belt, or a combination of these. In the case of the configuration of nipping with the cleaning rollers, it is preferable to make the line velocity of the cleaning rollers different than that of the belt 33 to improve the cleaning effect.

The inkjet recording apparatus 10 may include a roller nip conveyance mechanism, in place of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

Paper supply rollers 38A and 38B which guide recording paper 16 supplied from a paper supply unit 18, onto the belt 33, are provided on the upstream side (between the cutter 28 and the suction belt conveyance unit 22) of the suction belt conveyance unit 22 shown in FIG. 1, in terms of the conveyance direction of the recording paper 16 (hereinafter, called "paper conveyance direction"). When either the paper supply roller 38A, which presses against the recording surface (the upper side in FIG. 1) of the recording paper 16 on which the image is recorded, or the paper supply roller 38B, which presses against the holding surface (the lower side in FIG. 1) of the recording paper 16 which is held by the belt 33, is caused to rotate, then the recording paper 16 pinched between the paper supply rollers 38A and 38B is conveyed to the belt 33 in synchronism with the rotation of the paper supply rollers 38A and 38B, and the recording paper 16 is guided to the recording paper holding region on the belt 33.

A paper supply sensor 39 which detects the recording paper 16 (in other words, which judges whether or not the leading end of the recording paper 16 has arrived at the suction belt conveyance unit 22) is provided at the furthest upstream position on the paper conveyance path formed by the suction belt conveyance unit 22. The paper supply sensor 39 is composed of a light source (such as a LED) and a photoreceptor that is disposed across the recording paper 16 from the light source, and it outputs a determination signal which is directly proportional to the amount of light arriving at the photoreceptor. If recording paper 16 is present between the light source and the photoreceptor, then the amount of light incident on the photoreceptor is reduced in comparison with a case where the recording paper 16 is not present, and therefore the presence or absence of recording paper 16 is judged on the basis of the amount of light incident on the photoreceptor (in other words, the magnitude of the determination signal).

Furthermore, it is also possible to determine the length of the recording paper 16 in the direction of paper conveyance by storing (counting) the output signal of the paper supply sensor 39 continuously. In other words, the length of the recording paper 16 in the conveyance direction is found by multiplying the conveyance speed of the recording paper 16 by the time taken for the recording paper 16 to pass through the sensing region of the paper supply sensor 39.

It is also possible to dispose a light source and a photoreceptor on the same side of the recording paper 16 in such a manner that the photoreceptor receives the light emitted from the light source and reflected by the recording paper 16.

A temperature and humidity measurement unit 40 is provided at the next stage after the paper supply sensor 39 (on the downstream side in terms of the paper conveyance direction). The temperature and humidity measurement unit 40 is constituted by a temperature measurement section which measures the temperature, a humidity measurement section which measures the humidity, and a signal processing unit which carries out prescribed signal processing, such as noise reduction, amplification, and the like, on the temperature signal output from the temperature measurement section and the humidity signal output from the humidity measurement section.

A heating fan 41 is provided at the next stage after the temperature and humidity measurement unit (the downstream side in terms of the paper conveyance direction). This heating fan 41 blows heated air onto the recording paper 16 before printing, and thereby heats up the recording paper 16. Since the recording paper 16 is thus heated before printing, then the ink will dry more readily after depositing on the paper.

Figure 2:
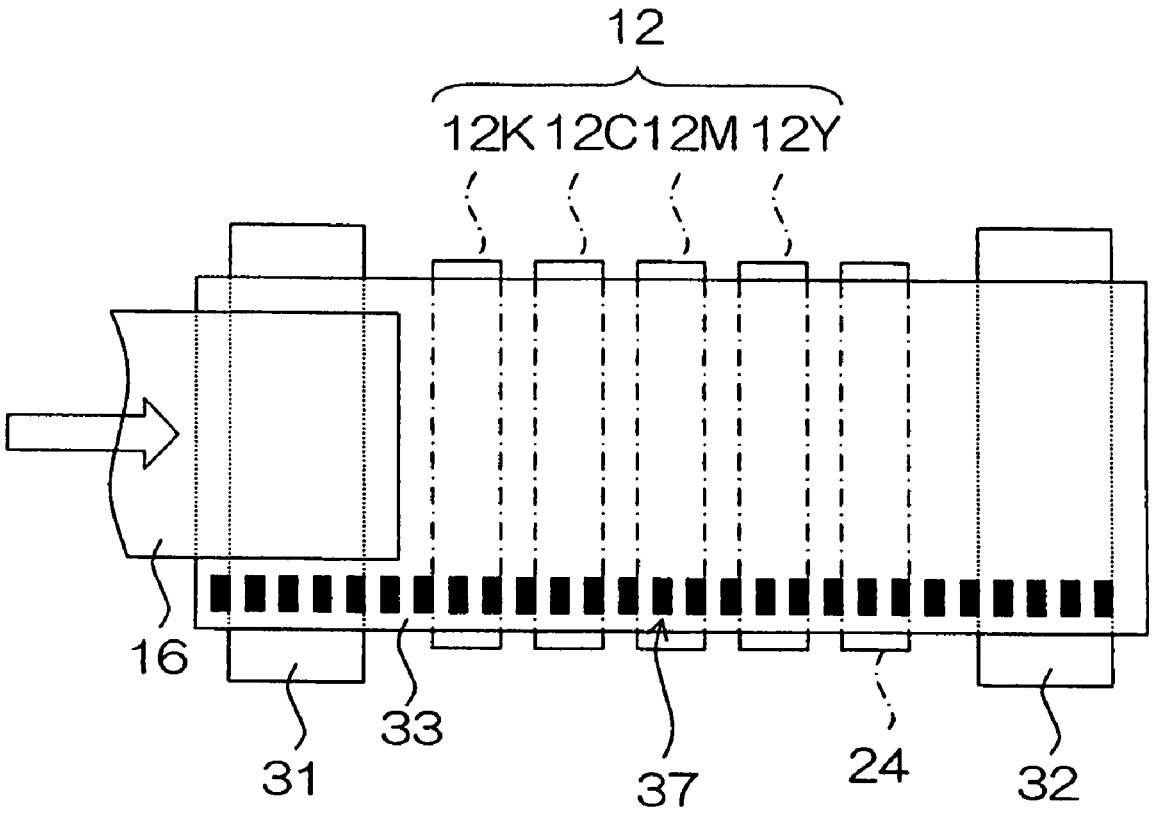
FIG. 2 is a plan view of the principal part of the peripheral printing region of the inkjet recording apparatus illustrated in FIG. 1.

The recording unit 12 provided at the next stage after the heating fan 41 (the downstream side in terms of the paper conveyance direction) includes a so-called "full line head" in which a line head having a length corresponding to the maximum paper width is arranged in a direction (main scanning direction) that is perpendicular to the paper feed direction (see FIG. 2).

Each of the recording heads 12K, 12C, 12M and 12Y is constituted by a line head, in which a plurality of ink ejection ports (nozzles) are arranged along a length that exceeds at least one side of the maximum-size recording paper 16 intended for use in the inkjet recording apparatus 10, as shown in FIG. 2. An example of the detailed structure of the recording head is described later.

The recording heads 12K, 12C, 12M and 12Y are arranged in the order of black (K), cyan (C), magenta (M) and yellow (Y) from the upstream side, along the feed direction of the recording paper 16. A color image can be formed on the recording paper 16 by ejecting the inks from the recording heads 12K, 12C, 12M and 12Y, respectively, onto the recording paper 16 while conveying the recording paper 16.

The recording unit 12, in which the full-line heads covering the entire width of the paper are thus provided for the respective ink colors, can record an image over the entire surface of the recording paper 16 by performing the action of moving the recording paper 16 and the recording unit 12 relative to each other in the sub-scanning direction just once (in other words, by means of a single sub-scan). Higher-speed printing is thereby made possible and productivity can be improved in comparison with a shuttle type head configuration in which a recording head moves reciprocally in the main scanning direction.

Although a configuration with four standard colors, K M C and Y, is described in the present embodiment, the combinations of the ink colors and the number of colors are not limited to these, and light and/or dark inks can be added as required. For example, a configuration is possible in which recording heads for ejecting light-colored inks such as light cyan and light magenta are added.

FIG. 2 is a plan diagram of the principal part of the recording unit 12 and the conveyance system of recording paper 16, as viewed from the side of the recording surface of the recording paper 16. As shown in FIG. 2, a test pattern 37 (determination pattern) composed of a plurality of rectangular patterns is formed by a photographic method on the belt 33, to the outside of the recording paper holding region.

The plurality of patterns constituting the test pattern 37 have the same shape and are aligned at uniform intervals, following the paper conveyance direction. The test pattern 37 is read in with the test pattern reading unit 25 shown in FIG. 1, while the recording paper 16, which is held on the belt 33, is conveyed at the same conveyance speed as in actual image recording, in other words, under the same conditions as the image recording conditions, and the speed of the belt 33 is measured from the reading results.

The photographic method described above is a method in which a liquid containing a photosensitive material, such as resist (light-sensitive film), is applied to a prescribed position on the belt 33, the resist is exposed by using a prescribed light source through a mask, and after this exposure process, the unwanted resist is removed, thereby forming a prescribed test pattern (determination pattern). If the photographic method is used, then it is possible to form a highly fine pattern with high precision, by using a mask which is larger than the actual test pattern and altering the magnification optically when carrying out exposure.

It is possible to form the test pattern 37 by applying a liquid, such as resin liquid, which does not contain photosensitive material, onto the belt 33 through a mask having the same pattern as the test pattern (by screen printing, for example), and then curing the liquid by means of a heating and cooling, or by means of a chemical method.

Although the details are described later, in the inkjet recording apparatus 10 shown in the present embodiment, the speed variation data for the belt 33 (recording paper 16) is previously obtained and stored, and ejection control is implemented in order to correct the ink ejection timings during image recording in accordance with this speed variation data. In the present embodiment, it is supposed that no slippage, or the like, occurs between the recording paper 16 and the belt 33, and the conveyance speed of the recording paper 16 is the same as the speed of the belt 33 in the recording region.

From the viewpoint of the visibility of the non-uniformities in the recorded image caused by the variation in the speed of the belt 33, it is desirable that the arrangement pitch of the test pattern 37 is 100 μm to 1 mm, and the width of each pattern is substantially ½ of the arrangement pitch of the test pattern.

FIG. 2 shows a mode where the test pattern 37 is provided in the vicinity of one end portion of the belt 33 in the breadthways direction thereof which is substantially perpendicular to the paper conveyance direction (the lower end portion in FIG. 2), but the test pattern 37 may also be provided on the other end portion of the belt 33 in the breadthways direction thereof (for example, the upper end portion in FIG. 2), or it may be provided on both end portions in the breadthways direction of the belt 33.

Although the present embodiment shows a mode in which the test pattern 37 is formed on the belt 33 by means of a photographic method, it is also possible to adopt a mode in which the test pattern is created by forming slits in the belt 33. In the mode where the slits are formed in the belt, it is difficult to process holes in order to form slits with high precision, and the deformation of the belt 33 due to the formation of the slits is also a concern. Therefore, a desirable mode is one in which the test pattern 37 is formed by the photographic method.

As shown in FIG. 1, the ink storing and loading unit 14 has ink tanks for storing the inks of the colors corresponding to the respective recording heads 12K, 12C, 12M and 12Y, and the respective tanks are connected to the recording heads 12K, 12C, 12M and 12Y by means of channels (not shown). The ink storing and loading unit 14 has a warning device (for example, a display device, an alarm sound generator, or the like) for warning when the remaining amount of any ink is low, and has a mechanism for preventing loading errors among the colors.

Furthermore, the paper supply unit 18 shown in FIG. 1 is able to ascertain the type of recording paper 16, and the like, by reading in an information storage body which stores recording paper information (recording medium information), such as the type of recording medium 16. For example, an IC tag which stores recording paper information, such as the type of recording paper, the quantity (length) of the paper, the date of manufacture, and the like, is attached to the central core portion of recording paper in a rolled form, the information on the IC tag is read out with a reading device installed in the paper supply unit 18, and the recording paper information thus read out is supplied to the control system (see FIG. 6).

Figure 6:
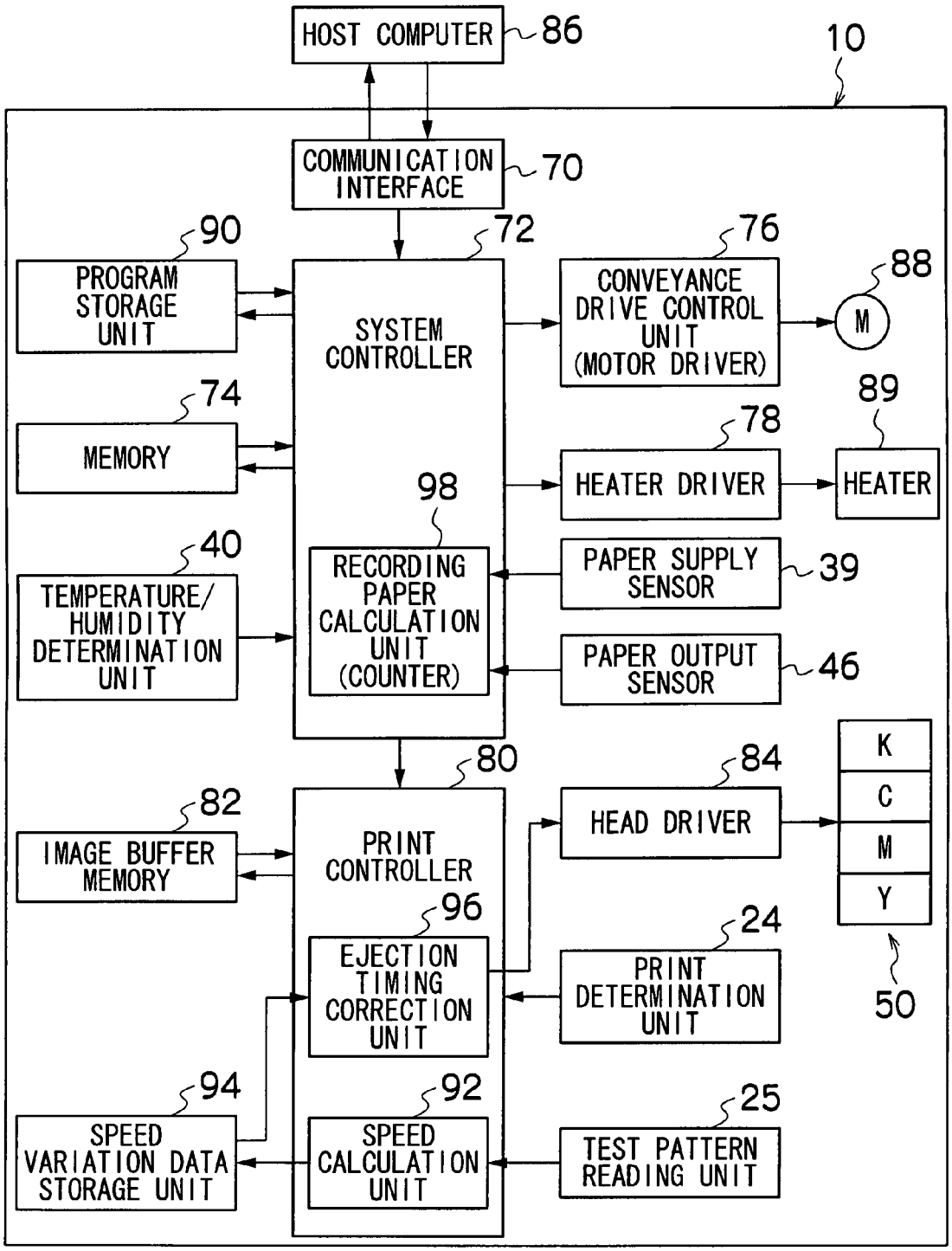
FIG. 6 is a principal block diagram showing the system configuration of the inkjet recording apparatus shown in FIG. 1.

The print determination unit 24 according to the present embodiment reads out the image printed on the recording paper 16, determines the print status (the presence/absence of ejection, variation in droplet ejection, and the like) by carrying out prescribed signal processing, or the like, and thereby functions as a print determination device for the control system (for example, the print controller 80 in FIG. 6). The print determination unit 24 according to the present embodiment is constituted by a line sensor having a row of photoreceptor elements of a greater width than the total width of the belt 33 (the length in the direction perpendicular to the paper conveyance direction). This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The test pattern reading unit 25 has a light source, such as an LED element, and a photoreceptor element, such as a photoelectric transducing element, provided on the side of the belt 33 where the test pattern is formed, and light is radiated onto the test pattern formed on the belt 33, by the light source, the light reflected is thereby received by the photoreceptor, and a determination signal which is directly proportional to the amount of incident light is output by the photoreceptor. It is also possible to adopt a composition in which the belt 33 is made of a transparent member (or semi-transparent member), and the photoreceptor element is disposed across the belt 33 from the light source, in such a manner that the light emitted from the light source and transmitted through the belt is received by the photoreceptor.

Furthermore, the test pattern reading unit 25 which is used in the present embodiment has a reading resolution which enables it to read each individual pattern of the test pattern 37. It is also possible to combine the test pattern reading unit 25 with the print determination unit 24.

A post-drying unit 42 is disposed following the test pattern reading unit 25. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming into contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller having a predetermined uneven surface shape while the image surface is heated, and the uneven shape is transferred to the image surface.

Paper output rollers 45A and 45B are provided at the stage after the heating and pressurizing unit 44 (in other words, on the downstream side of the suction belt conveyance unit 22 in terms of the paper conveyance direction). The paper output rollers 45A and 45B have the same structure as the paper supply rollers 38A and 38B described above, and when the recording paper 16 subjected to the complete image recording arrives between the paper output rollers 45A and 45B, then the recording paper 16 is output while being pressed between the paper output roller 45A and 45B.

A paper output sensor 46 which detects the recording paper 16 (namely, which judges whether or not the trailing end of the recording paper 16 has exited from the conveyance belt conveyance unit 22) is provided at the stage after the paper output rollers 45A and 45B. The paper output sensor 46 adopts the same composition as that of the paper supply sensor 39 described above.

The printed matter generated in this manner is outputted from the paper output unit 26. The target print (i.e., the result of printing the target image) and the determination print image (the image for determining the printing) are preferably outputted separately. In the inkjet recording apparatus 10, a sorting device (not shown) is provided for switching the outputting pathways in order to sort the printed matter with the target print and the printed matter with the determination print, and to send them to paper output units 26A and 26B, respectively. When the target print and the determination print are simultaneously formed in parallel on the same large sheet of paper, the determination print portion is cut and separated with a cutter (second cutter) 48. The cutter 48 is disposed directly in front of the paper output unit 26, and is used for cutting the determination print portion from the target print portion when the determination print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders. The reference numeral 26A is a main image output unit and the reference numeral 26B is a print determination image output unit.

Description of Structure of Recording Head

Next, the structure of the recording head is described below. The recording heads 12K, 12C, 12M and 12Y provided for the respective ink colors have the same structure, and a reference numeral 50 is hereinafter designated to any of the recording heads 12K, 12C, 12M and 12Y.

Figure 3A:
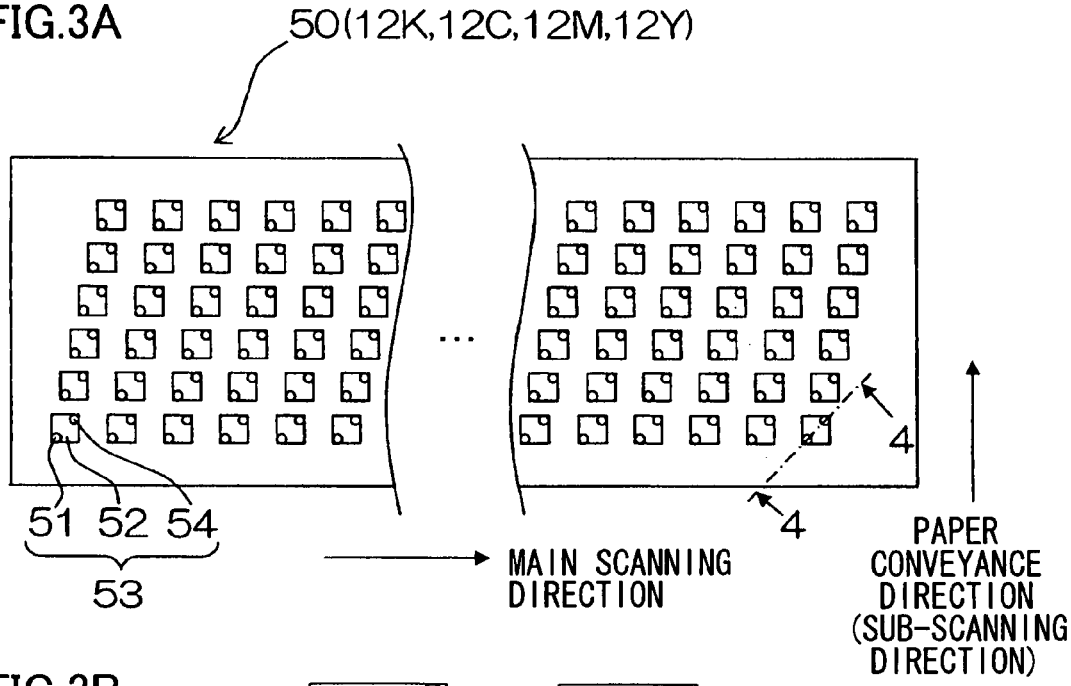
FIGS. 3A to 3C are plan view perspective diagrams showing examples of the composition of a print head.
Figure 3B:
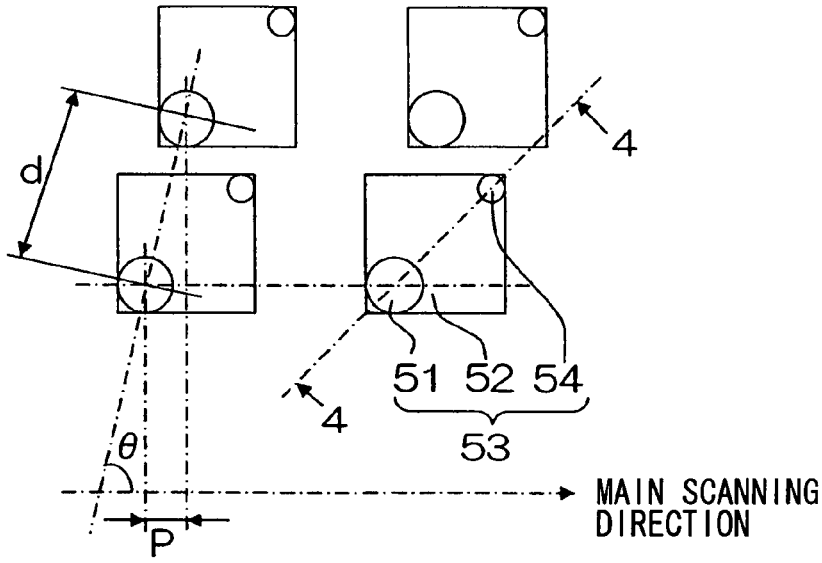
Figure 3C:
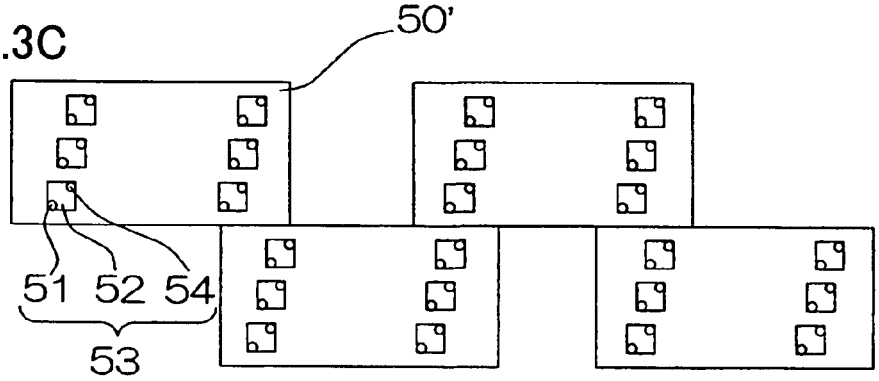

FIG. 3A is a plan view perspective diagram showing an example of the composition of a recording head 50, and FIG. 3B is an enlarged diagram of a portion of same. Furthermore, FIG. 3C is a plan view perspective diagram showing a further example of the structure of a recording head 50. In order to achieve a high density of the dot pitch printed onto the surface of the recording medium, it is necessary to achieve a high density of the nozzle pitch in the recording head 50. As shown in FIGS. 3A to 3C and 4, the recording head 50 in the present embodiment has a structure in which a plurality of ink chamber units 53, each including a nozzle 51 from which ink is output and a pressure chamber 52 connecting to the corresponding nozzle 51, are disposed in the form of a staggered matrix, and the effective nozzle pitch is thereby made small.

More specifically, as shown in FIGS. 3A and 3B, the recording head 50 according to the present embodiment is a full-line head having one or more nozzle rows in which a plurality of nozzles 51 for ejecting ink are arranged along a length corresponding to the entire width of the recording paper 16 in a direction substantially perpendicular to the paper conveyance direction.

Moreover, as shown in FIG. 3C, a full-line head can be composed of a plurality of short two-dimensionally arrayed head units 50' disposed in a staggered arrangement and combined so as to form nozzle rows having lengths that correspond to the entire width of the recording paper 16. Furthermore, although not shown in the drawings, it is also possible to connect short heads in a linear fashion.

As shown in FIGS. 3A to 3C, the pressure chamber 52 provided corresponding to each of the nozzles 51 is approximately square-shaped in plan view, and a nozzle 51 and a supply port 54 are provided respectively at either corner of a diagonal of the pressure chamber 52. Moreover, the respective pressure chambers 52 are each connected via a supply port 54 to the common liquid chamber (not shown in FIGS. 3A to 3C; and indicated by reference numeral 55 in FIG. 4).

As shown in FIG. 3B, the plurality of ink chamber units 53 having this structure are composed in a lattice arrangement, based on a fixed arrangement pattern having a row direction which coincides with the main scanning direction, and a column direction which, rather than being perpendicular to the main scanning direction, is inclined at a fixed angle of $\theta$ with respect to the main scanning direction. By adopting a structure in which a plurality of ink chamber units 53 are arranged at a uniform pitch d in a direction having an angle $\theta$ with respect to the main scanning direction, the pitch P of the nozzles projected so as to align in the main scanning direction is $d \times \cos\theta$.

More specifically, the arrangement can be treated equivalently to one in which the respective nozzles 51 are arranged in a linear fashion at uniform pitch P, in the main scanning direction. By means of this composition, it is possible to achieve a nozzle composition of high density, in which the nozzle columns projected to align in the main scanning direction reach a total of 2400 per inch (2400 nozzles per inch). Below, in order to facilitate the description, it is supposed that the nozzles 51 are arranged in a linear fashion at a uniform pitch (P), in the longitudinal direction of the head (main scanning direction).

In a full-line head comprising rows of nozzles corresponding to the entire width of the paper, the "main scanning" is defined as printing one line formed of a row of dots, or a line formed of a plurality of rows of dots in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIGS. 3A to 3C are driven, the main scanning according to the above-described (3) is preferred. On the other hand, "sub-scanning" is defined as to repeatedly perform printing of one line formed of a row of dots, or a line formed of a plurality of rows of dots formed by the main scanning, while moving the full-line head and the recording paper relatively to each other.

In other words, "main scanning" is the action of driving the nozzles so as to print a line constituted by one row of dots, or a plurality of rows of dots, in the breadthways direction of the paper, and "sub-scanning" is the action of repeating the printing of a line constituted by one row of dots or a plurality of rows of dots formed by main scanning. When implementing the present invention, the arrangement of the nozzles is not limited to that of the example illustrated.

Figure 4:
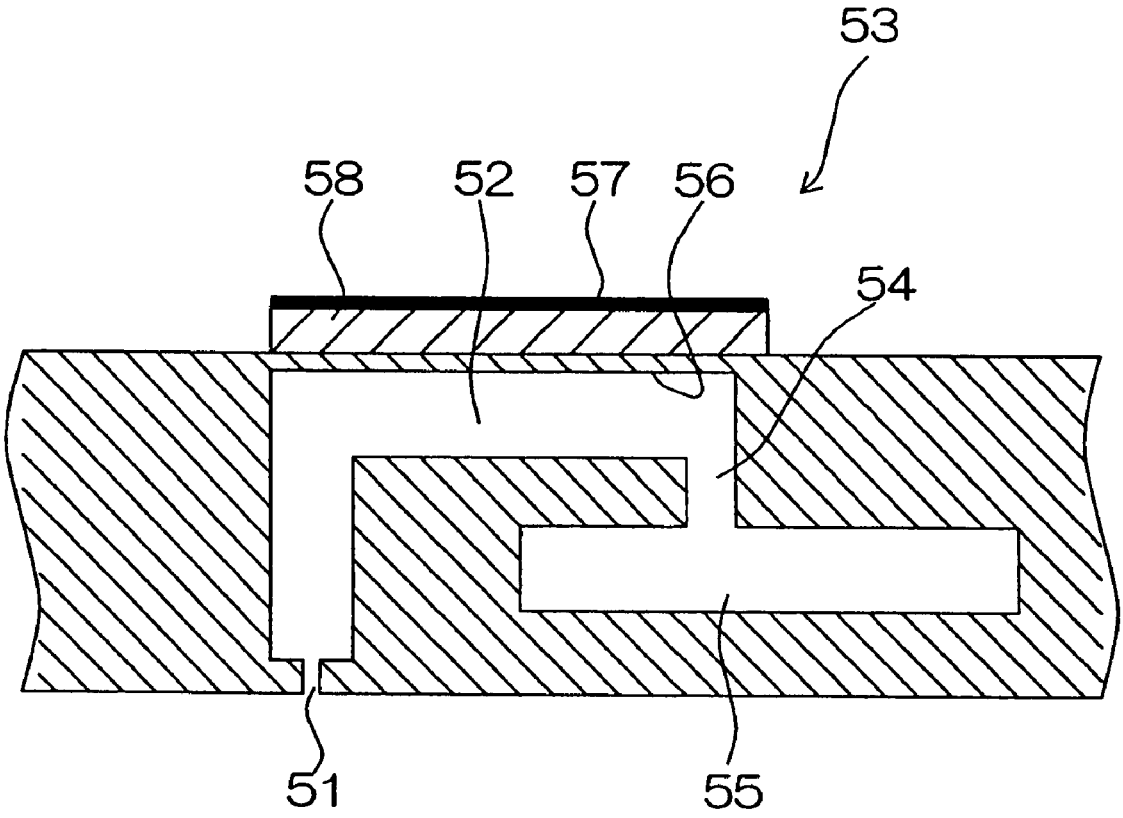
FIG. 4 is a cross-sectional diagram showing the three-dimensional structure of a print head.

FIG. 4 is a cross-sectional diagram showing the three-dimensional structure of the recording head 50 (the ink chamber unit 53 shown in FIGS. 3A to 3C) (namely, a cross-sectional diagram along line 4-4 in FIGS. 3A and 3B). A piezoelectric element 58 including an individual electrode 57 is bonded to the diaphragm 56 which constitutes the ceiling of the pressure chambers 52, and the diaphragm 56 also functions as a common electrode for the piezoelectric elements 58. By applying a drive voltage to the individual electrode 57, a bending deformation is applied to the piezoelectric element 58, the pressure chamber 52 is deformed, and ink is ejected from the nozzle 51. When ink is ejected from the nozzle, ink is supplied to the pressure chamber 52 from the common flow chamber 55, via the supply port 54.

In the present embodiment, a method is adopted in which ink is pressurized by the deformation of the piezoelectric element 58. In implementing the present invention, another actuator other than a piezoelectric element can also be used in place of the piezoelectric element 58.

Furthermore, in the present embodiment, a recording head is described in which nozzles are arranged in a matrix configuration, but the nozzle arrangement is not limited to a matrix configuration and it is also possible to use a mode where nozzles are arranged in one row following a direction which is perpendicular to the paper conveyance direction, and a mode where two nozzle rows are arranged in a staggered configuration.

The present embodiment describes, as an example, a full line recording head which has an ejection port row of a length corresponding to the breadthways direction of the recording paper 16, but the present invention may also be applied to a serial head which uses a method in which printing is carried out in the breadthways direction of the recording paper 16 while scanning the recording paper 16 with a short head having a length shorter than the breadthways length of the recording paper 16, in the breadthways direction of the recording paper 16, and the printing in the breadthways direction of the recording paper 16 is repeated while conveying the recording paper 16 in the paper conveyance direction.

Description of Ink Supply System

Figure 5:
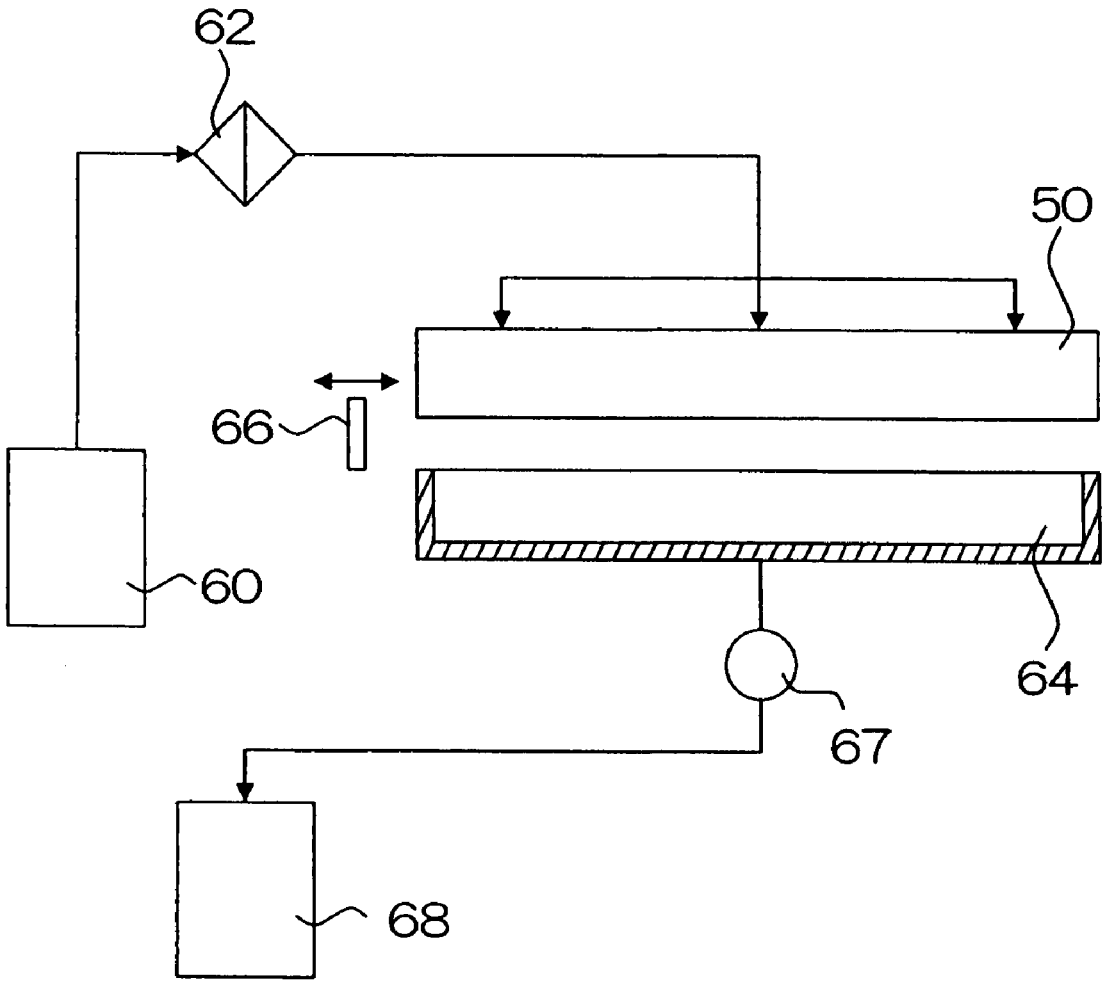
FIG. 5 is a cross-sectional diagram showing the composition of an ink supply system of the inkjet recording apparatus shown in FIG. 1.

Next, the general composition of the ink supply system of the inkjet recording apparatus 10 is described below. FIG. 5 is a conceptual diagram showing the composition of an ink supply system in the inkjet recording apparatus 10.

The ink supply tank 60 is a base tank that supplies ink and is set in the ink storing and loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

A filter 62 for removing foreign matters and bubbles is disposed between the ink supply tank 60 and the recording head 50 as shown in FIG. 5. The filter mesh size is preferably equivalent to or less than the diameter of the nozzle and commonly about 20 μm.

Desirably, a composition is adopted in which a sub tank (not illustrated) is provided in the vicinity of the recording head 50, or in an integrated fashion with the recording head 50. The sub tank has a damper function for preventing variation in the internal pressure of the pressure chamber 52 and the common flow channel 55 and a function for improving refilling characteristics.

Possible modes for controlling the internal pressure of the common flow channel 55 by means of the sub tank are: a mode where the internal pressure of the pressure chambers 52 is controlled by the differential in the ink level between a sub tank which is open to the external air and the pressure chambers 52 inside the recording head 50; and a mode where the internal pressure of the sub tank and the internal pressure of the pressure chambers 52 are controlled by a pump connected to a sealed sub tank; and the like. Either of these modes may be adopted.

Description of Maintenance of Head

As shown in FIG. 5, a cap 64 forming a device for preventing the drying of the nozzles 51 or increase in the viscosity of the ink in the vicinity of the nozzles 51 is provided in the inkjet recording apparatus 10, and a blade 66 is provided as a device for cleaning (wiping) the nozzle forming surface on which the nozzles 51 are formed.

A maintenance unit including the cap 64 and the blade 66 can be relatively moved with respect to the recording head 50 by a movement mechanism (not shown), and is moved from a predetermined holding position to a position below the recording head 50 as required.

The cap 64 shown in FIG. 5 has a size which enables it to cover the whole of the nozzle forming surface of the recording head 50. The cap 64 is displaced upwards and downwards in a relative fashion with respect to the recording head 50 by an elevator mechanism (not shown). When the power of the inkjet recording apparatus 10 is switched off or when in a print standby state, the cap 64 is raised to a predetermined raised position thereby placing same in close contact with the recording head 50 (the nozzle forming surface of the recording head 50), in such a manner that the nozzle forming surface is covered with the cap 64.

During printing or standby, if the use frequency of a particular nozzle 51 is low, and if a state of not ejecting ink continues for a prescribed time period or more, then the solvent of the ink in the vicinity of the nozzle evaporates and the viscosity of the ink increases. In a situation of this kind, it will become difficult to eject ink from the nozzle 51, even when the piezoelectric element 58 is operated.

Therefore, before a situation of this kind develops (namely, while the ink viscosity is within a range which allows the ink to be ejected by operation of the piezoelectric element 58), the piezoelectric element 58 is operated, and a preliminary ejection ("purge", "blank ejection", or "liquid ejection") is carried out toward the cap 64 (ink receptacle), in order to expel the degraded ink (namely, the ink in the vicinity of the nozzle which has increased viscosity).

This suction operation is also carried out when ink is loaded into the head for the first time, or in order to remove degraded ink which has increased in viscosity and solidified when the head starts to be used after having been out of use for a long period of time. Since the suction operation is carried out with respect to all of the ink inside the pressure chambers 52, the ink consumption is considerably large. Therefore, desirably, preliminary ejection is carried out while the increase in the viscosity of the ink is still minor. If an air bubble is present in a pressure chamber 52, then a pressure loss occurs when the piezoelectric element 58 is operated, and therefore, nozzle suctioning is carried out with the object of removing air bubbles inside the pressure chambers 52.

The blade 66 functions as a wiping device for removing dirt from the nozzle forming surface by moving while pressing against the nozzle forming surface, and a hard rubber material, or the like, is suitable for use in the blade 66. In other words, the blade 66 has a prescribed strength (rigidity) and a prescribed elasticity, and the surface thereof has prescribed hydrophobic properties such that the ink droplets are repelled from the surface thereof. The blade 66 is constituted of a member which is capable of wiping and removing ink (ink that has solidified on the nozzle forming surface), paper dust, and other foreign matter, which has adhered to the nozzle forming surface.

Furthermore, although not shown in FIG. 5, the head maintenance mechanism (head maintenance device) of the inkjet recording apparatus 10 includes a blade elevator mechanism (not shown), which moves the blade 66 in the upward and downward directions and thus switches the blade 66 between a state of contact and a state of non-contact with the nozzle forming surface, and a cleaning device which removes foreign matter adhering to the blade 66.

Description of Control System

Next, the control system of the inkjet recording apparatus 10 according to the present embodiment is described below. FIG. 6 is a principal block diagram showing the system composition of the inkjet recording apparatus 10. The inkjet recording apparatus 10 includes a communication interface 70, a system controller 72, a memory 74, a conveyance drive control unit (motor driver) 76, a heater driver 78, a print controller 80, an image buffer memory 82, a head driver 84, and the like.

The communication interface 70 is an interface unit for receiving image data sent from a host computer 86. A serial interface such as USB (Universal Serial Bus), IEEE1394, Ethernet®, wireless network, or a parallel interface such as a Centronics interface may be used as the communication interface 70. A buffer memory may be mounted in this portion in order to increase the communication speed. The image data sent from the host computer 86 is received by the inkjet recording apparatus 10 through the communication interface 70, and is temporarily stored in the memory 74. The memory 74 is a storage device for temporarily storing images inputted through the communication interface 70, and data is written and read to and from the memory 74 through the system controller 72. The memory 74 is not limited to a memory composed of semiconductor elements, and a hard disk drive or another magnetic medium may be used.

The system controller 72 is a control unit for controlling the various sections, such as the communication interface 70, the memory 74, the conveyance drive control unit 76, the heater driver 78, and the like. The system controller 72 is constituted by a central processing unit (CPU) and peripheral circuits thereof, and the like, and in addition to controlling communications with the host computer 86 and controlling reading and writing from and to the memory 74, or the like, it also generates a control signal for controlling the motor 88 of the conveyance system and the heater 89.

The conveyance drive control unit 76 is a driver (drive circuit) which drives the motor 88 of the conveyance drive system in accordance with instructions from the system controller 72. In addition to the motor 88, the conveyance drive control unit 76 also controls other motors relating to the conveyance system, such as the paper supply rollers 38A (38B) and the paper output rollers 45A (45B).

The heater driver 78 drives the heater 89 of the post-drying unit 42 or the like in accordance with commands from the system controller 72. The heater 89 shown in FIG. 6 includes heaters such as a heater used in a post-drying unit 42, as shown in FIG. 1, a temperature adjustment heater for each respective recording head 50, and the like.

The print controller 80 has a signal processing function for performing various tasks, compensations, and other types of processing for generating print control signals from the image data stored in the memory 74 in accordance with commands from the system controller 72 so as to supply the generated print control signal (print data) to the head driver 84. Prescribed signal processing is carried out in the print controller 80, and the ejection amount and the ejection timing of the ink droplets from the respective recording heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 6 is one in which the image buffer memory 82 accompanies the print controller 80; however, the memory 74 may also serve as the image buffer memory 82. Also possible is an aspect in which the print controller 80 and the system controller 72 are integrated to form a single processor.

The head driver 84 drives the piezoelectric element 58 (see FIG. 4) of the recording head 50 of the respective colors on the basis of print data supplied by the print controller 80. The head driver 84 can be provided with a feedback control system for maintaining constant drive conditions for the print heads.

The program storage unit 90 stores control programs for the inkjet recording apparatus 10, and the system controller 72 reads out the various control programs stored in the program storage unit 90, as and when appropriate, and executes the control programs.

The print determination unit 24 is a block that includes the line sensor as described above with reference to FIG. 1, reads the image printed on the recording paper 16, determines the print conditions (presence of the ejection and variation in the dot formation) by performing desired signal processing, or the like, and provides the determination results of the print conditions to the print controller 80. According to requirements, the print controller 80 makes various corrections with respect to the recording head 52 on the basis of information obtained from the print determination unit 24.

The test pattern reading unit 25 reads in the test pattern 37 (see FIG. 2) formed on the belt 33, by means of a sensor, and sends a corresponding read signal to the print controller 80. The test pattern reading unit 25 includes a reading control unit (reading control device) which controls the reading by the sensor on the basis of a control signal supplied by the print controller 80.

The speed calculation unit 92, which is one functional block of the print controller 80, calculates the speed variation data for the belt 33 on the basis of the read signal for the test pattern 37, and the speed variation data is stored in a speed variation data storage unit 94 attached to the print controller 80.

The speed variation data for the belt 33 stored in the speed variation data storage unit 94 is read out as and when appropriate by the ejection timing correction unit 96, which is one functional block of the print controller 80. The ejection timing correction unit 96 corrects the ink ejection timing on the basis of the speed variation data for the belt 33 (the ejection timing correction unit 96 sends a trigger signal indicating a corrected ejection timing to the head driver 84), and the ink is ejected at the corrected ejection timing.

The determination signals output from the paper supply sensor 39 and the paper output sensor 46 shown in FIG. 1 are supplied to the system controller 72, and it is judged whether or not the recording paper 16 is present in the recording paper conveyance path of the belt 33, in addition to which a recording paper calculation unit (counter) 98, which is one functional block of the system controller 72, calculates the length of the recording paper 16 on the conveyance path, and the interval between sheets of recording paper when a plurality of recording papers 16 are conveyed continuously (namely, the distance between the trailing end of a preceding recording paper and the leading end of a subsequent recording paper), on the basis of the determination signal from the paper supply sensor 39.

FIG. 6 shows the memories as separate memories according to the contents of the information stored therein, but these memories can be formed as shared memories or separate memories, accordingly. Moreover, the invention is not limited to a mode where the memories are attached to the system controller 72 and the print controller 80, and it is also possible to use the internal memory of the processors which constitute the system controller 72 and the print controller 80.

Description of Ejection Timing Correction

Next, the correction of ink ejection timing in the recording head 50 is described below. In the inkjet recording apparatus 10 according to the present embodiment, the test pattern 37 formed on the belt 33 is read in with the test pattern reading unit 25, the speed variation data for the belt 33 is calculated from the read result, this speed variation data is stored, and the ink ejection timing of the recording head 50 is corrected during image recording on the basis of the speed variation data for the belt 33.

The reading in of the test pattern 37 and the calculation of the speed variation data for the belt 33 needs to be carried out once only, when the apparatus is started up, for example. However, desirably, the test pattern 37 is read in and the speed variation data of the belt is calculated and stored, appropriately, when maintenance of the conveyance system, such as replacement of the belt 33, is carried out, or when recording paper 16 of a type for which speed variation data has not been stored is used, for instance. Moreover, the speed variation data corresponding to environmental conditions, such as the temperature and humidity, may be prepared in advance and the speed variation data to be used may be selected in accordance with the temperature and humidity. The mode of selecting the speed variation data in accordance with the temperature and humidity also includes a mode in which a temperature coefficient (a correction coefficient based on temperature) and a humidity coefficient (a correction coefficient based on humidity) are prepared in advance, and the speed variation data is corrected by multiplying the temperature coefficient and the humidity coefficient.

Figure 7A:
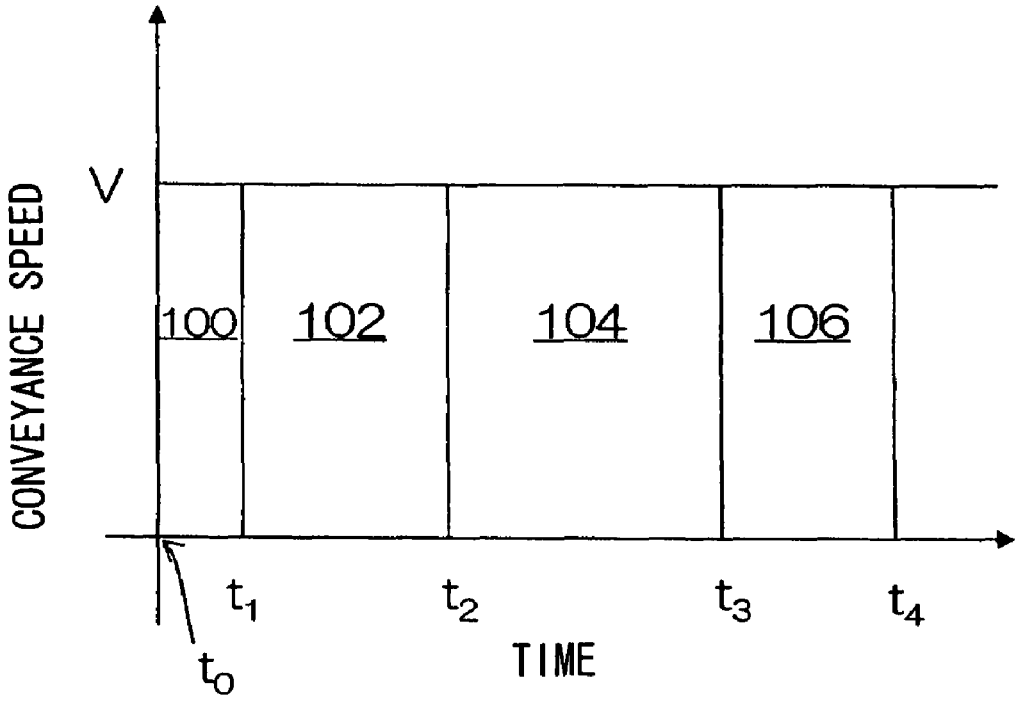
FIGS. 7A and 7B are diagrams showing the relationship between the conveyance speed of the belt and the ejection timing.
Figure 7B:
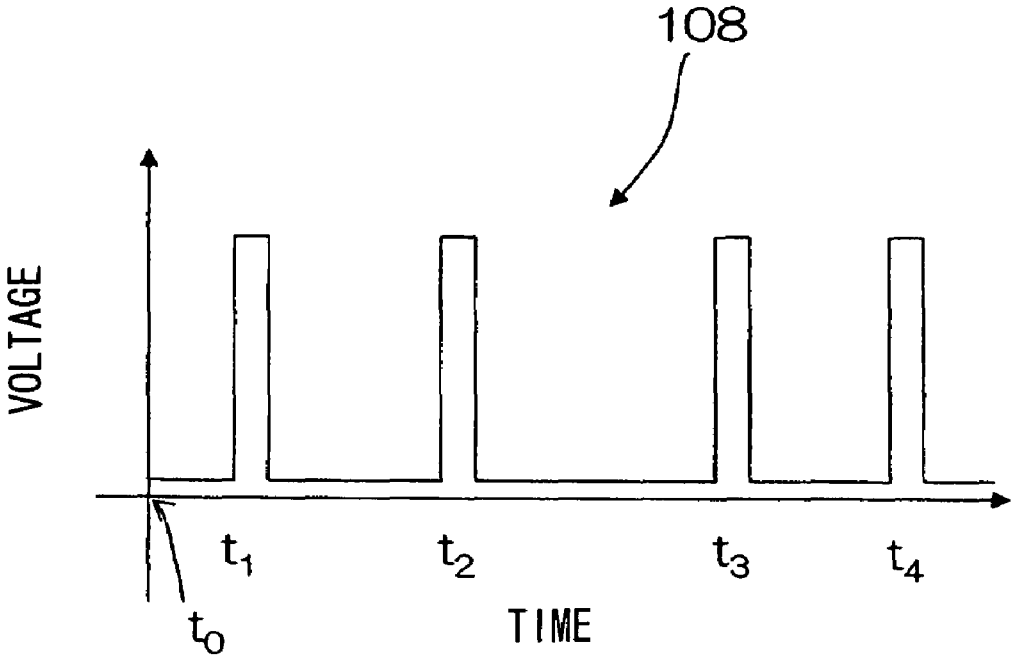

Next, the relationship between the conveyance speed of the belt 33 and the ejection timing is described below. FIG. 7A is a diagram showing the conveyance speed of the belt 33 in which there is no speed variation (in other words, the theoretical conveyance speed), and FIG. 7B is a diagram showing a trigger signal 108 which indicates the theoretical ejection timings (namely, the uncorrected ejection timings). The timings $t_1$ to $t_4$ shown in FIG. 7A indicate the ejection timings of the recording head 50. At the respective ejection timings shown in FIG. 7B, it is possible to carry out ink ejection simultaneously from a plurality of nozzles.

Furthermore, the values (namely, the areas of the rectangular shapes indicated by the reference numerals 100, 102, 104 and 106 in FIG. 7A) obtained by integrating the conveyance speed of the belt 33 with respect to the time interval between one ejection timing and the next ejection timing (for example, between $t_1$ and $t_2$), represent the distances (in other words, the conveyance amount of the recording paper 16) moved by the belt 33 between the respective ejection timings.

More specifically, the area of the region in FIG. 7A indicated by the reference numeral 100 represents the movement distance of the belt 33 from timing to timing $t_1$, and similarly, the areas of the regions indicated by the reference numerals 102, 104 and 106 respectively represent the movement distances of the belt 33 from $t_1$ to $t_2$, from $t_2$ to $t_3$, and from $t_3$ to $t_4$.

The trigger signal 108 shown in FIG. 7B is a positive logic pulse signal, and an ink ejection action is carried out at the timings $t_1$, $t_2$, $t_3$, and $t_4$ of the rising edges (leading edges) of the trigger signal 108. FIG. 7B shows a positive logic pulse signal where the leading edge is taken as the rising edge, but it is also possible to use a negative logic pulse signal where the leading edge is taken to be the falling edge.

Figure 8A:
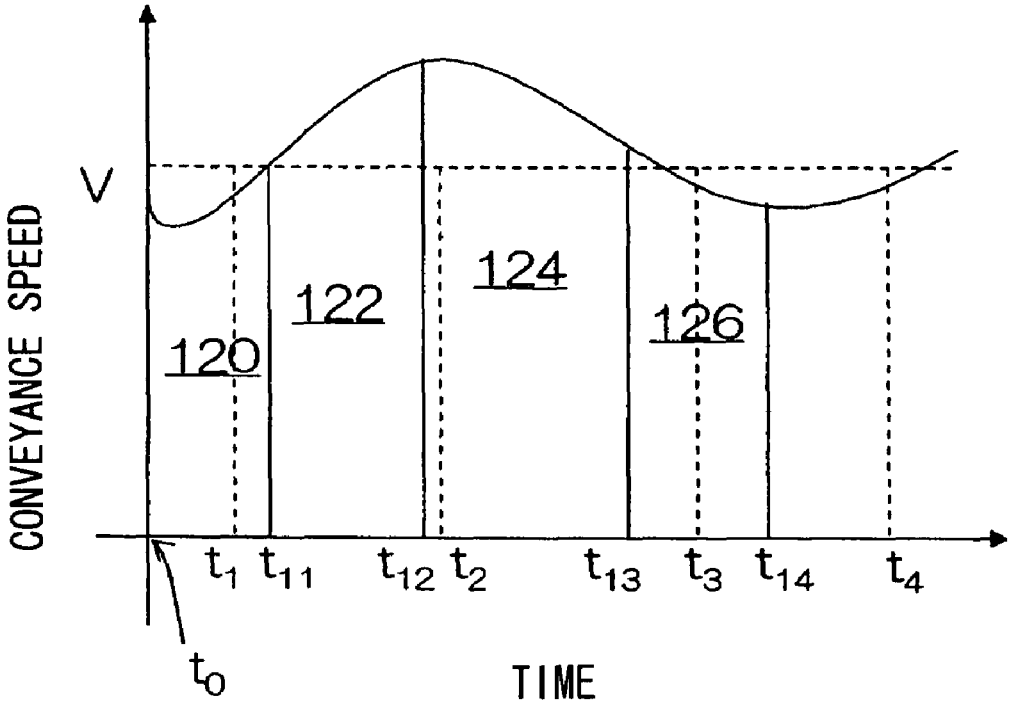
FIGS. 8A and 8B are diagrams for illustrating ejection timing correction according to an embodiment of the present invention.

FIG. 8A is a diagram showing the conveyance speed of the belt 33 in which there is variation in the speed of the belt 33. It is extremely rare for the belt 33 to be conveyed ideally (theoretically), as shown in FIG. 7A, and in actual practice, the speed variation occurs in the belt 33, for instance, when the recording paper 16 separates from the paper supply roller 38A (see FIG. 1), or when the leading end portion of the recording paper 16 impacts the paper output roller 45A (see FIG. 1), and as a result of the occurrence of the speed variation such as that shown in FIG. 8A, for example, positional displacement occurs in the recording paper 16.

In the inkjet recording apparatus 10 shown in the present embodiment, the effect of the positional displacement of the recording paper 16 with respect to the recording head 50 caused by the speed variation of the belt 33, can be eliminated by correcting the ejection timing so as to cancel the speed variation of the belt 33 such as that described above.

In other words, in the inkjet recording apparatus 10, the timings at which ink is ejected toward the recording paper 16 held on the belt 33, which produces the speed variation shown in FIG. 8A, are changed in such a manner that the movement distance of the belt 33 between the ejection timings coincides with the theoretical movement distance. More specifically, the ejection timing is changed from $t_1$ to $t_{11}$, in such a manner that the conveyance distance of the belt 33 indicated by the reference numeral 120 in FIG. 8A (the actual movement distance of the belt 33), becomes equal to the conveyance distance of the recording paper 16 indicated by the reference numeral 100 in FIG. 7A (the theoretical movement distance of the belt 33, indicated by the broken line in FIG. 8A). Similarly, the theoretical ejection timings $t_2$, $t_3$, and $t_4$ are respectively changed to ejection timings $t_{12}$, $t_{13}$, and $t_{14}$, in such a manner that the movement distances of the belt 33 indicated by the reference numerals 122, 124 and 126 in FIG. 8A, become equal to the movement distances of the belt 33 indicated by the reference numerals 104, 106 and 108 in FIG. 7A, respectively.

Figure 8B:
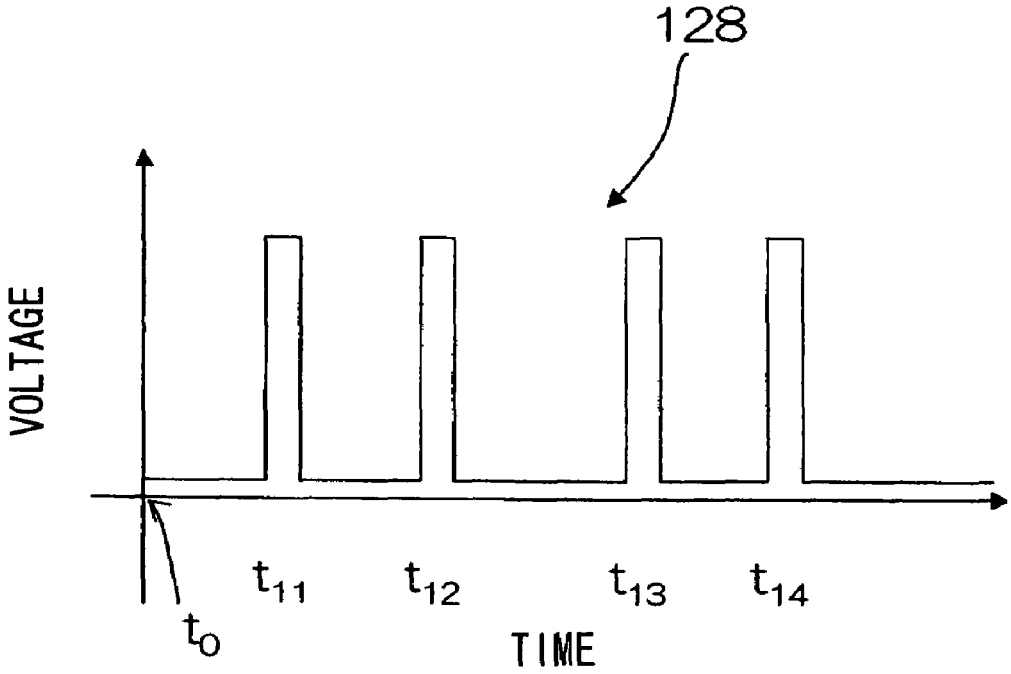

In other words, when the actual conveyance speed is slower than the theoretical conveyance speed, then the ejection timing is corrected in such a manner that the actual ejection timing is later than the theoretical ejection timing, and on the other hand, when the actual conveyance speed is faster than the theoretical conveyance speed, then the actual ejection timing is corrected in such a manner that the actual ejection timing is earlier than the theoretical ejection timing. FIG. 8B shows the trigger signal 128 in which the ejection timings described above have been corrected.

When the test pattern 37 is read in, a recording paper which is the same as the recording paper 16 to be used in actual image recording (the same type and the same size) is held on the belt 33, and the recording paper 16 is conveyed at the same conveyance speed as that used in image recording. In other words, by setting the conveyance of the belt 33 to the same conditions as the image recording conditions, then it is possible to determine accurately the variation in the conveyance speed of the belt 33 which may occur during image recording.

Furthermore, in a case where there are a plurality of recording papers 16 used in image recording, or in a case where a plurality of conveyance speeds can be set (for example, in the case of a composition which can be switched between high-speed printing for a low resolution mode and low-speed printing for a high resolution mode), a plurality of the speed variation data associated with the parameters such as the type and size of the recording paper, and the conveyance speed (image recording mode), or the like, are stored in the speed variation data storage unit 94 shown in FIG. 6. In the ejection timing correction process, the plurality of speed variation data are read out appropriately in accordance with the above-described parameters.

Here, the factors of variation in the speed of the belt 33 are described below. When the recording paper 16 makes contact with (abuts against) the paper output rollers 45A and 45B shown in FIG. 1, and the recording paper 16 is pinched between the paper output rollers 45A and 45B, then the speed variation occurs in the recording paper 16 and therefore the speed variation occurs in the belt 33, in synchronism with this speed variation of the recording paper 16.

Similarly, when the recording paper 16 separates from the paper supply rollers 38A and 38B, the speed variation occurs in the belt 33, in synchronism with the speed variation occurring in the recording paper 16. When a plurality of pieces of recording paper 16 are conveyed in a consecutive fashion, there may be cases where image recording onto a subsequent recording paper may be in progress at the timing that the preceding recording paper makes contact with the paper output rollers 45A and 45B, depending on the length of the recording paper 16 in the paper conveyance direction. In such cases, the speed variation of the belt 33 caused by the speed variation of the preceding recording paper produces the speed variation in the subsequent recording paper and thus has an effect on the image quality of the subsequent recording paper. Furthermore, if image recording onto the preceding recording paper is in progress at the timing that the subsequent recording paper separates from the paper supply rollers 38A and 38B, then the speed variation of the belt 33 caused by the speed variation of the subsequent recording paper 16 has an effect on the image quality of the preceding recording paper.

Consequently, in the case of continuous image recording onto a plurality of pieces of paper, it is necessary to determine the speed variation data of the belt 33 under the same conditions as the actual conveyance conditions, by conveying a plurality of pieces of recording paper of the same type and size as those used in actual image recording, and hence to determine the indirect speed variation arising as a result of speed variation of the belt 33 caused by speed variation of another recording paper. Moreover, in the case of continuous image recording onto a plurality of pieces of paper, if the same image is to be recorded using the same size of recording paper, then the speed variation occurring in the belt 33 can be considered to have periodicity (namely, a certain speed variation pattern is repeated), and therefore it is possible to determine a basic pattern of corrected ejection timings based on a basic speed variation pattern and to repeat the basic pattern, thereby canceling the overall speed variation pattern.

The inkjet recording apparatus 10 having the composition described above reads in the test pattern 37 provided on the belt 33, which holds and conveys the recording paper 16, by means of the test pattern reading unit 25. From these reading results, the inkjet recording apparatus 10 determines and stores the speed variation data for the belt 33, and during actual image recording, the ejection timings of the recording head 50 are corrected on the basis of this previously stored speed variation data. Consequently, even if a sudden speed variation occurs when the recording paper 16 separates from the paper supply rollers 38A and 38B or when the recording paper 16 receives pressurized contact from the paper output rollers 45A and 45B, the ejection timing is corrected accordingly and deviation does not occur in the image formation positions (dot formation positions) on the recording paper 16. Therefore, image degradation, such as non-uniformities and color deviations in the recorded image, are prevented.

Second Embodiment

Next, a second embodiment of the present invention is described below. In the second embodiment, a test pattern image (corresponding to a "determination pattern"; not shown in FIG. 9 and indicated by reference numeral 220 in FIGS. 11A and 11B) is formed on recording paper 16 while conveying the recording paper 16 under the same conveyance conditions as the conditions during actual image recording, the recording paper 16 formed with the test pattern image is moved to another conveyance system which is different to the conveyance system for image recording, and the test pattern image on the recording paper 16 is read in while conveying the recording paper 16 formed with the test pattern image by means of the other conveyance system. The speed variation data for the recording paper 16 is calculated from the reading results, and the speed variation data is stored in the prescribed storage unit. During image recording, the speed variation data of the recording paper 16 stored in the storage unit is read out and the ejection timing is corrected accordingly.

Figure 9:
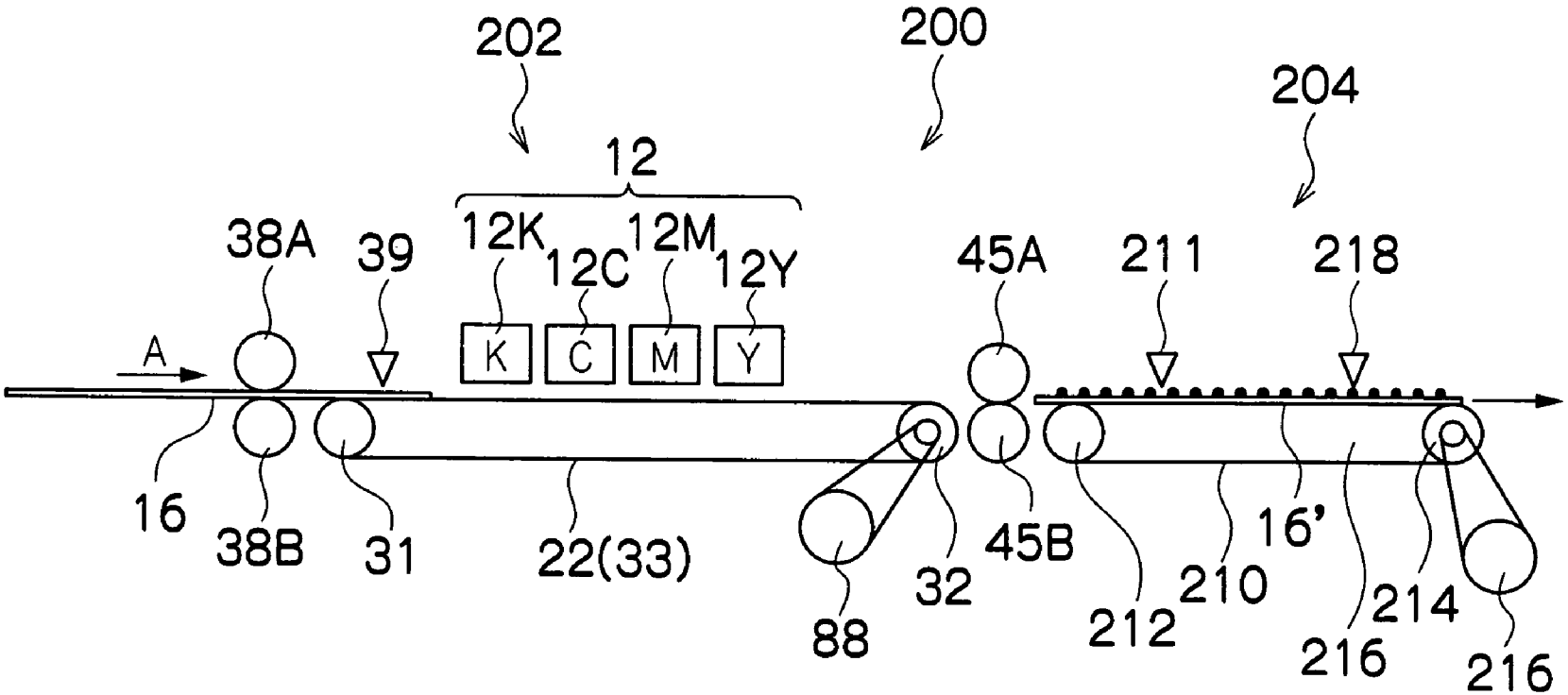
FIG. 9 is a basic schematic drawing of an inkjet recording apparatus according to a second embodiment of the present invention.

FIG. 9 is a general schematic drawing showing the general composition of an inkjet recording apparatus 200 according to the second embodiment of the present invention. In FIG. 9, items which are the same as or similar to those in FIG. 1 are labeled with the same reference numerals and description thereof is omitted here. Moreover, the composition apart from the main composition according to the present embodiment is not shown in FIG. 9.

The inkjet recording apparatus 200 shown in FIG. 9 has an image recording block 202 which records an image and a speed determination block 204 which determines variation in the conveyance speed of the recording paper 16. A test pattern image is formed on the recording paper 16 by the image recording block 202, and the speed determination block 204 then reads in the test pattern image on the recording paper 16, which is supplied from the image recording block. Moreover, the speed variation data of the recording paper 16 is calculated from the reading results, and the speed variation data is obtained for all the recording heads. The speed variation data of the recording paper 16 thus calculated is stored in a speed variation data storage unit of the image recording block 202, in association with the respective recording heads. The image recording block 202 subsequently corrects the ejection timings in image recording of the respective recording heads, on the basis of this speed variation data.

The image recording block 202 shown in FIG. 9 has a recording unit 12 including recording heads 12K, 12C, 12M and 12Y which correspond to respective ink colors of K, C, M and Y, a suction belt conveyance unit 22 which holds the recording paper 16 and conveys the recording paper 16 in the paper conveyance direction, paper supply rollers 38A and 38B which introduce the recording paper 16 onto the belt 33 of the suction belt conveyance unit 22, and paper output rollers 45A and 45B which output the recording paper 16 on which an image has been recorded.

The suction belt conveyance unit 22 shown in FIG. 9 has the same composition as the suction belt conveyance unit 22 in FIG. 1, namely, a structure in which an endless belt 33 is wound about rollers 31 and 32, and when the motor 88 is caused to rotate and the rollers 31 and 32 are caused to rotate in the counter-clockwise direction, then the belt 33 moves from left to right in FIG. 9 (indicated by arrow A in FIG. 9), and the recording paper 16 moves from left to right in FIG. 9.

Moreover, the speed determination block 204 shown in FIG. 9 includes: a conveyance system constituted by an endless belt 210 which holds the recording paper 16 on which the test pattern image (denoted with a reference numeral 220 in FIG. 11A) composed of colored patterns of K, C, M and Y, has been formed, and which conveys the recording paper 16 in a prescribed direction, rollers 212 and 214 about which the belt 210 is wound, and a motor 216 which drives the roller 214; a test pattern reading unit 218, which is provided so as to oppose the surface holding the recording paper 16 in the conveyance region of the conveyance system, and which reads in a dot pattern formed on the recording paper 16; and a recording paper detection sensor 211, which is provided on the upstream side of the conveyance system in terms of the paper conveyance direction, and which judges whether or not recording paper 16 is present on the belt 210.

The test pattern reading unit 218 shown in FIG. 9 is constituted by a line sensor having rows of photoreceptor elements having a larger width than the total width of the recording paper 16 (the length in a direction perpendicular to the paper conveyance direction), and the density of the test pattern image is read out with the test pattern reading unit 218.

The line sensor used in the test pattern reading unit 218 may be a color separation line CCD sensor including a red (R) sensor row composed of photoelectric transducing elements (pixels) arranged in a line provided with an R filter, a green (G) sensor row with a G filter, and a blue (B) sensor row with a B filter. If a color separation line CCD sensor is used for the test pattern reading unit 218, then it is possible to read in the test pattern images formed by the K, C, M and Y inks, for the colors, respectively. Instead of a line sensor, it is possible to use an area sensor composed of photoelectric transducing elements which are arranged two-dimensionally.

Moreover, although not shown in the drawings, the image recording block 202 includes a speed calculation unit (see FIG. 6) which determines the speed variation data of the recording paper 16 for each of the recording heads with different colored inks, on the basis of the determination signal obtained from the test pattern reading unit 218 of the speed determination block 204. A mode is also possible in which the speed calculation unit is provided in the speed determination block 204.

During the conveyance of the recording paper 16 in the speed determination block 204, it is desirable to ensure a state where there are no impacts caused by the pressurized contact of the rollers, separation from the rollers, or the like, and there is no variation in the speed during conveyance, caused by vibrations, or the like. When the test pattern image is read by the test pattern reading unit 218, errors will occur in the reading results if there is speed variation in the recording paper 16' on which the test pattern image is recorded, and these errors will affect the results of ejection timing correction. It is therefore preferable to prevent the speed variation of the recording paper and the conveyance system from occurring in the reading region of the test pattern reading unit 218.

To give one example of a mode for avoiding the causes of speed variation in the test pattern reading unit 218, there is a mode in which the recording paper 16' on which the test pattern image has been recorded is caused to contact the belt 210 tightly by applying an electrostatic force to the belt 210, and furthermore, the recording paper 16' is conveyed at a conveyance speed which minimizes the vibration during conveyance of the recording paper 16' on which the test pattern image has been recorded.

Moreover, it is also possible to compose the speed determination block 204 in such a manner that it is detachable from the inkjet recording apparatus 200. The speed determination block 204 shown in the present embodiment is used only when calculating the speed variation data for the recording paper 16, and therefore it may be detached from the inkjet recording apparatus 200 during image recording.

Figure 10:
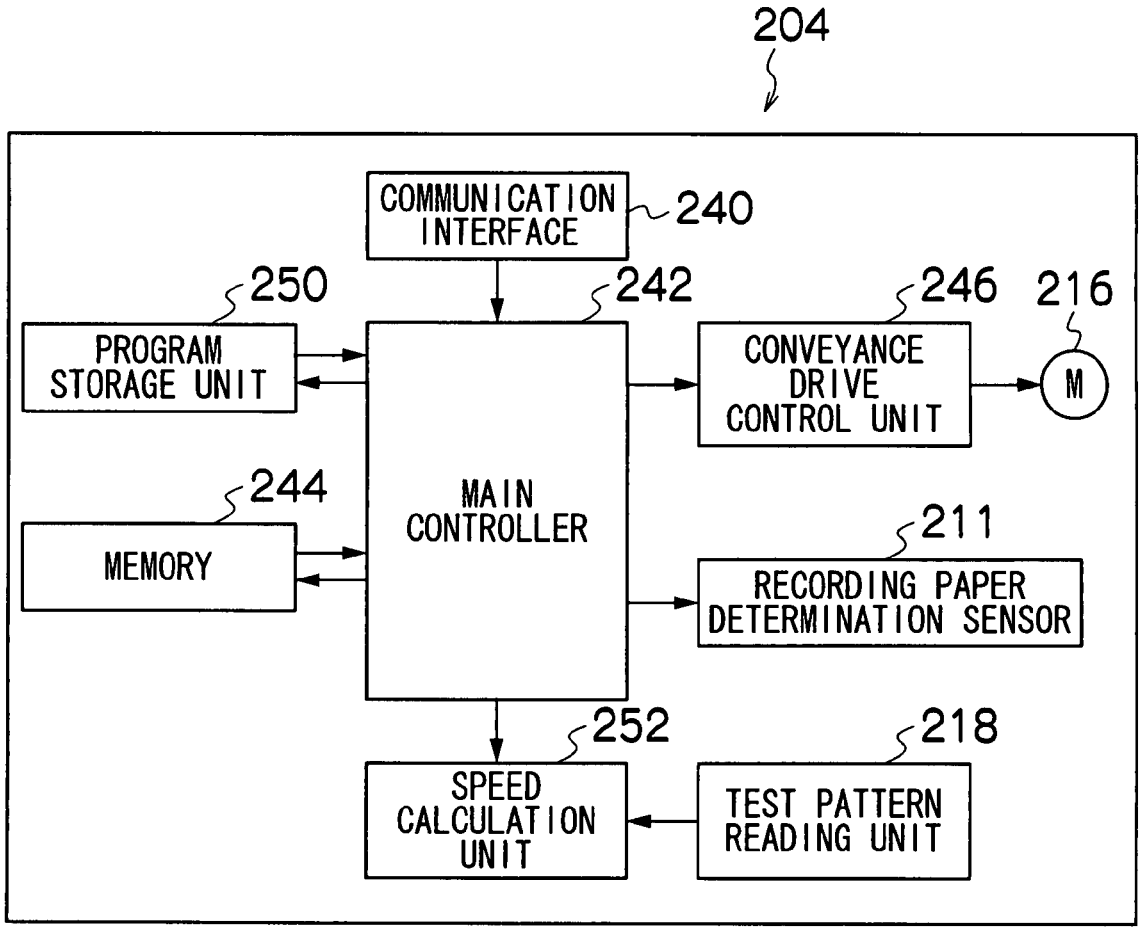
FIG. 10 is a block diagram showing the system composition of the speed determination block illustrated in FIG. 9.

FIG. 10 shows the composition of the conveyance system of the speed determination block 204. FIG. 10 is a principal block diagram showing the system composition of the speed determination block 204. It is possible to use the composition of the control system of the inkjet recording apparatus 10 according to the first embodiment of the present invention shown in FIG. 6, as the control system of the image recording block 202 in FIG. 9, and therefore further description thereof is omitted here. Moreover, the test pattern reading unit 25 and the speed calculation unit 92 shown in FIG. 6 can be omitted in the control system of the image recording block 202 as shown in FIG. 10, and therefore further description thereof is omitted here.

As shown in FIG. 10, the control system of the speed determination block 204 includes a communication interface 240, a controller 242, a memory 244, a conveyance drive control unit (motor driver) 246, and the like.

The communication interface 240 is an interface unit which receives image data transmitted from an external source. The communication interface 240 may adopt the same composition as the communication interface 70 shown in FIG. 6.

The memory 244 is a storage device which functions as a calculation region for the controller 242 and as a storage region for temporarily storing data, and data is read from and written to the memory 244 via the controller 242. The memory 244 is not limited to a memory composed of a semiconductor element, and a magnetic medium, such as a hard disk, or the like, may also be used.

The controller 242 is a control unit which governs the control system of the speed determination block 204, and it is constituted by a central processing unit (CPU) and peripheral circuits thereof, and the like, and in addition to controlling communications with external equipment and controlling reading and writing from and to the memory 244, or the like, it also generates a control signal for controlling the motor 216 of the conveyance system. The conveyance drive control unit 246 is a driver (drive circuit) which drives the motor 216 of the conveyance drive system in accordance with instructions from the controller 242.

The program storage unit 250 stores control programs for the speed determination block 204, and the controller 242 reads out the various control programs stored in the program storage unit 250, as and when appropriate, and executes the control programs.

As described above with reference to FIG. 9, the test pattern reading unit 218 is a block including a line sensor, and it reads in the test pattern image recorded on the recording paper 16 and supplies the read signal to the speed calculation unit 252. The test pattern reading unit 218 includes a reading control unit (reading control device) which controls the reading operation by the line sensor.

In the speed calculation unit 252, the speed variation data of the recording paper 16 is calculated on the basis of the read signal from the test pattern reading unit 218, and the speed variation data is stored temporarily in the memory 244. The speed variation data of the recording paper 16 temporarily stored in the memory 244 is stored in the speed variation data storage unit of the image recording block 202, via the controller 242. A mode is also possible in which the speed calculation unit 252 of the speed determination block 204 is provided in the control system of the image recording block 202. In this case, it is also possible to adopt a composition in which the read signal obtained from the test pattern reading unit 218 of the speed determination block 204 is supplied to the image recording block 202.

The detection signal output from the recording paper detection sensor 211 shown in FIG. 9 is supplied to the controller 242. The controller 242 judges whether or not the recording paper 16 is present on the recording paper conveyance path, as well as deciding the read start timing and the read end timing of the test pattern reading unit 218 on the basis of the determination signal from the recording paper detection sensor 211.

Figure 11A:
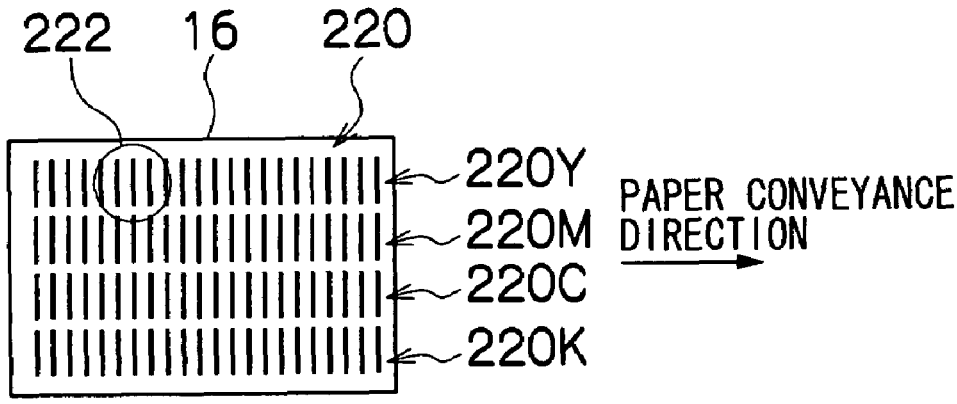
FIGS. 11A and 11B are diagrams for describing test pattern images recorded by the image recording block in FIG. 9.
Figure 11B:
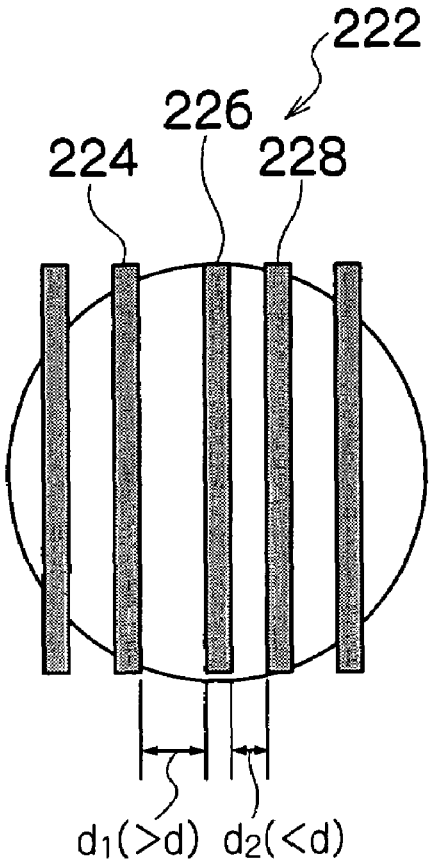

Next, the test pattern image is described specifically. FIG. 11A shows a test pattern image 220 formed on the recording paper 16, and FIG. 11B shows an enlarged view of the portion 222 of the test pattern image 220 surrounded by the circle in FIG. 11A.

As shown in FIG. 11A, the test pattern image 220 is formed over the whole surface of the recording paper 16 by ejecting inks at uniform time intervals, from specified nozzles of the recording heads 12K, 12C, 12M and 12Y of the respective colors in the recording unit 12.

More specifically, the test pattern image 220 is constituted of: a K ink pattern 220K which is formed by K ink; a C ink pattern 220C formed by C ink; an M ink pattern 220M formed by M ink; and a Y ink pattern 220Y formed by Y ink. As shown in FIG. 11A, patterns of the same color are formed following the paper conveyance direction and patterns of different colors are aligned following a direction substantially perpendicular to the paper conveyance direction.

As shown in FIG. 11A, the K ink pattern 220K, the C ink pattern 220C, the M ink pattern 220M and the Y ink pattern 220Y are formed respectively, following the paper conveyance direction, in separate regions which are divided in the direction substantially perpendicular to the conveyance direction of the recording paper 16.

It is desirable that the recording paper 16 is demarcated into separate regions and the test patterns are formed on the regions for the respective colors of the recording heads, as shown in FIG. 11A, since this makes it possible to determine speed variation data for the recording paper 16 for each of the recording heads.

Depending on the position of the recording head in the recording paper conveyance path, recording may not be affected even when the variation does occur in the speed of the recording paper 16. Therefore, by obtaining the speed variation data for each recording head, it is possible to avoid correction errors caused by the fact that the recording heads are disposed in different positions in the recording paper conveyance path.

FIG. 11B shows an enlarged view of the test pattern image 220 shown in FIG. 11A (the portion surrounded by the circle indicated by the reference numeral 222 in FIG. 11A). When the recording paper 16 separates from the paper supply rollers 38A and 38B, or when the recording paper 16 receives pressurized contact from the paper output rollers 45A and 45B, for instance, then the variation may occur in the conveyance speed of the recording paper 16, and in such a case, the interval between the patterns becomes non-constant and the test pattern image 220 is recorded at irregular intervals as shown in FIG. 11B.

If the conveyance speed of the recording paper 16 becomes slower than the theoretical conveyance speed, then the interval in the pattern becomes wider than the theoretical pattern interval d (not shown), as indicated by the interval $d_1$ between lines 224 and 226 (in other words, $d_1>d$), whereas if, on the other hand, the conveyance speed of the recording paper 16 becomes faster than the theoretical conveyance speed, then the pattern interval becomes narrower than the theoretical pattern interval, as indicated by the interval $d_2$ between lines 226 and 228 (in other words, $d_2<d$).

Figure 12:
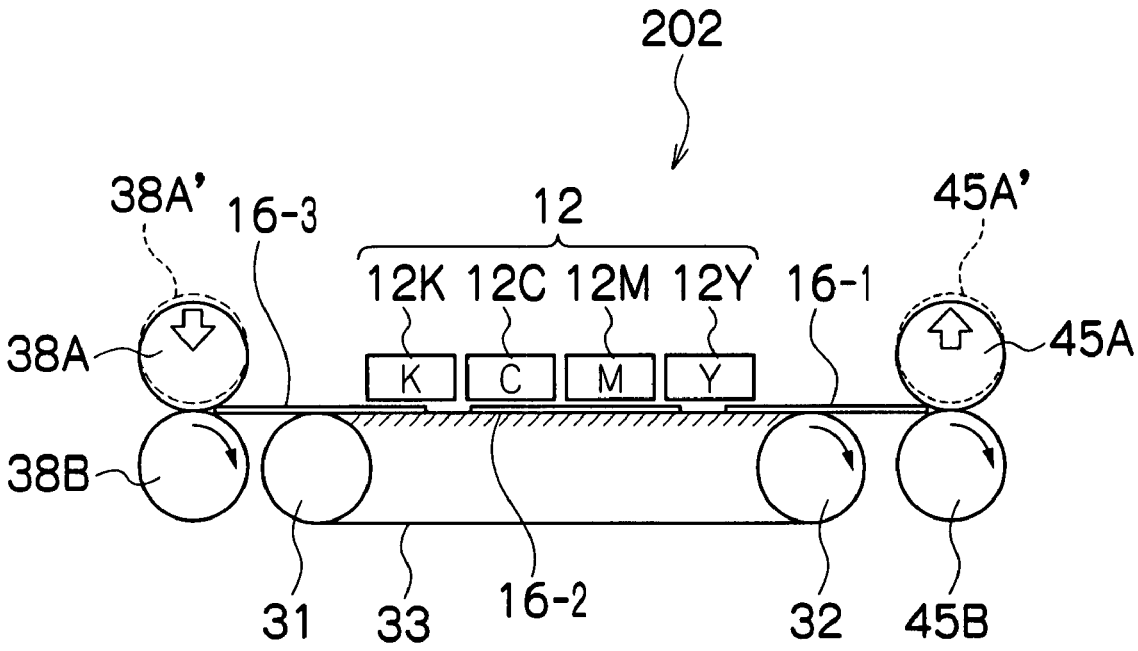
FIG. 12 is a diagram for describing the consecutive conveyance of a plurality of sheets, in the inkjet recording apparatus shown in FIG. 9.

Next, image recording onto a plurality of pieces of recording paper 16 which are conveyed consecutively is described below. FIG. 12 is a conceptual diagram showing a state where a plurality of pieces of recording paper 16 (16-1, 16-2, 16-3, . . . ) are conveyed consecutively and image recording is performed onto these pieces of recording paper. FIG. 12 shows three pieces of recording paper, but a mode is also possible in which image recording is carried out by conveying two pieces of recording paper, or four or more pieces of recording paper, consecutively.

Assuming that the recording paper 16 itself does not deform, the factors of the speed variation of the recording paper 16 are, for example: the acceleration of the recording paper (reference numeral 16-3 in FIG. 12) due to the force created by the descent of the paper supply roller 38A, when the recording paper 16 separates from a state where it is pinched between the paper supply rollers 38A and 38B, and the idle roller 38A descends from the state in 38A' indicated by the broken line in FIG. 12 (a state where it is pushed upwards by an amount corresponding to the thickness of the recording paper 16) to the state in 38A indicated by the solid line; and the speed differential between the belt 33 and the recording paper 16 caused by the load imparted to the recording paper 16 by the force required to push the paper output roller 45A upwards by an amount corresponding to the paper thickness, when the recording paper 16 (reference numeral 16-1 in FIG. 12) is pinched between the paper supply rollers 45A and 45B.

Furthermore, the speed variation of the recording paper 16 may be caused by the speed variation occurring in the recording paper 16 itself, or the speed variation of the recording paper 16 may be caused by the effects of the speed variation of the belt 33.

The speed variation occurring in the recording paper 16 itself may, for example, be caused by (1) slipping between the recording paper 16 and the belt 33. Furthermore, the occurrence of the speed variation in the recording paper 16 due to the effects of speed variation of the belt 33 may, for example, be caused by (2) slipping between the belt 33 and the drive roller 32 (drive shaft), or back-lash or slipping in the transmission mechanism (gears, belts, etc.) between the drive motor (reference numeral 88 in FIG. 9) and the drive roller 32.

If the holding force of the recording paper 16 (the adhesive force between the recording paper 16 and the belt 33) is weak, then only the speed variation of the recording paper 16 described in (1) above occurs, but if the recording paper 16 is held on the belt 33 by a normal holding force, then both (1) and (2) described above occur and therefore (1) and (2) described above should be taken into account.

Furthermore, in the cases where pieces of recording paper 16 are conveyed consecutively as shown in FIG. 12, if there is the speed variation of the belt 33, then the speed variation occurs in the plurality of recording papers 16 held on the belt 33. When the speed variation in a particular recording paper (for example, the recording paper 16-1 in FIG. 12) produces the speed variation in the belt 33, this speed variation of the belt 33 also produces the speed variation in the other pieces of recording paper (for example, the recording papers 16-2 and 16-3 in FIG. 12). Consequently, in order to determine the speed variation of the recording paper 16, it is necessary to determine both the speed variation of the recording paper 16 itself, and the speed variation of the recording paper 16 caused by the speed variation of the belt 33.

It is also possible to use an immobile body (such as a platen) as the conveyance medium for conveying the recording paper 16. In the case where an immobile body is used as the conveyance medium, since the length of the recording paper 16 is longer than the distance between the paper supply rollers 38A and 38B and the paper supply rollers 45A and 45B, then the speed variation does not occur in the conveyance body when the paper separates from the paper supply rollers 38A and 38B or when the paper is pinched between the paper output rollers 45A and 45B. However, wear due to the friction of the recording paper 16 does occur, and maintenance, such as replacement is necessary. Therefore, a desirable mode is one which uses a belt as the conveyance medium.

The factors of speed variation of the recording paper 16, in a case where pieces of recording paper 16 are conveyed consecutively, can be summarized as factors (A) to (D) below.

(A) The speed of the recording paper 16 is altered directly due to the recording paper 16 receiving the pressurized contact of (in other words, being pinched between) the paper output rollers 45A and 45B.

(B) The speed of the recording paper 16 is altered directly due to the recording paper 16 separating from the paper supply rollers 38A and 38B.

(C) The speed of the recording paper 16 is altered indirectly as a result of variation in the speed of the belt 33 due to another sheet of recording paper receiving the pressurized contact of the paper output rollers 45A and 45B.

(D) The speed of the recording paper 16 is altered indirectly as a result of variation in the speed of the belt 33 due to another sheet of recording paper separating from the paper supply rollers 38A and 38B.

In a system where other members which are the cause of load variation, such as other rollers, separating hooks, or the like, are present on the belt 33 (on the conveyance path of the recording paper 16), it is desirable that the speed variation of the recording paper 16 is determined by taking account of the load variations caused by these members which are causes of load variation.

Next, the factors of speed variation in recording paper 16 according to the length of the recording paper 16 is described below, with reference to FIGS. 13 to 18.

Figure 13:
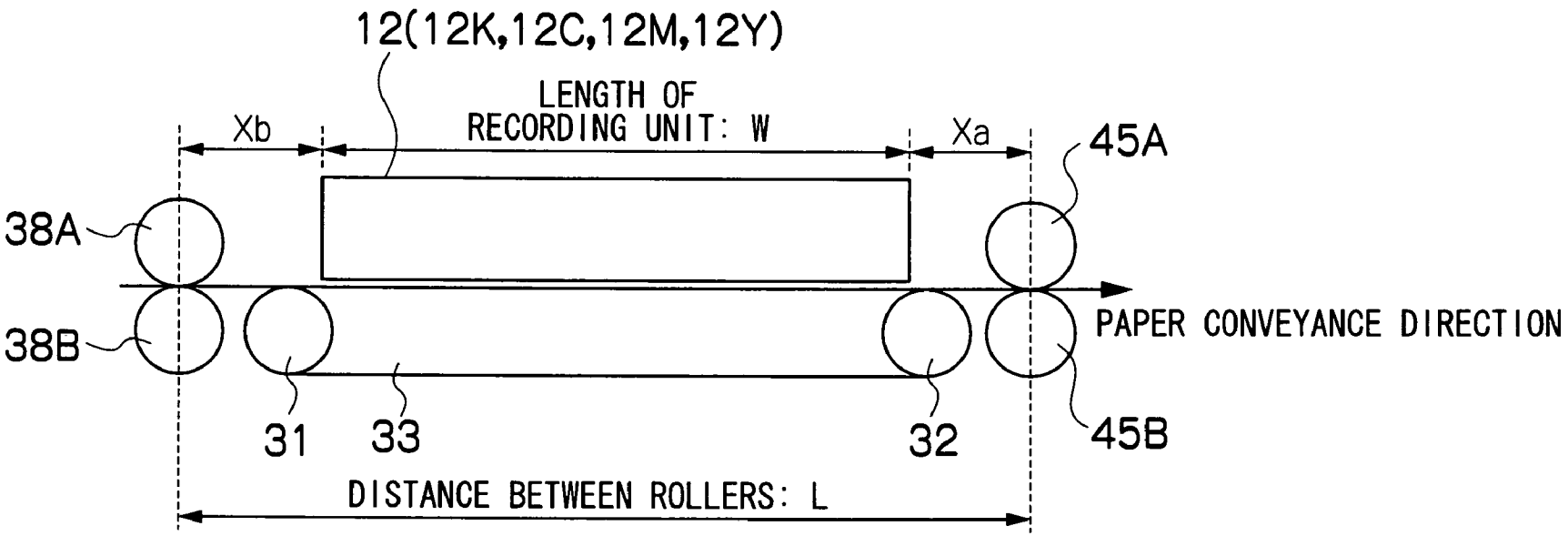
FIG. 13 is a diagram showing the detailed composition of an image recording block shown in FIG. 9.

As shown in FIG. 13, the length of the recording unit 12 (the total of the lengths of the recording heads 12K, 12C, 12M and 12Y in the paper conveyance direction plus the distances between the heads) is taken to be W, the distance between the furthest downstream portion of the recording unit 12 in terms of the paper conveyance direction (the front end portion of the recording unit) and the paper output rollers 45A and 45B (the position where the leading end portion of the recording paper 16 starts to receive pressurized contact by the paper output rollers 45A and 45B) is taken to be $X_a$, the distance between the furthest upstream portion of the recording unit 12 in terms of the paper conveyance direction (the rear end portion of the recording unit) and the paper supply rollers 38A and 38B (the position where the trailing end portion of the recording paper 16 separates from the paper supply rollers 38A and 38B) is taken to be $X_b$, and the length of the recording paper 16 in the paper conveyance direction is taken to be P.

Figure 14A:
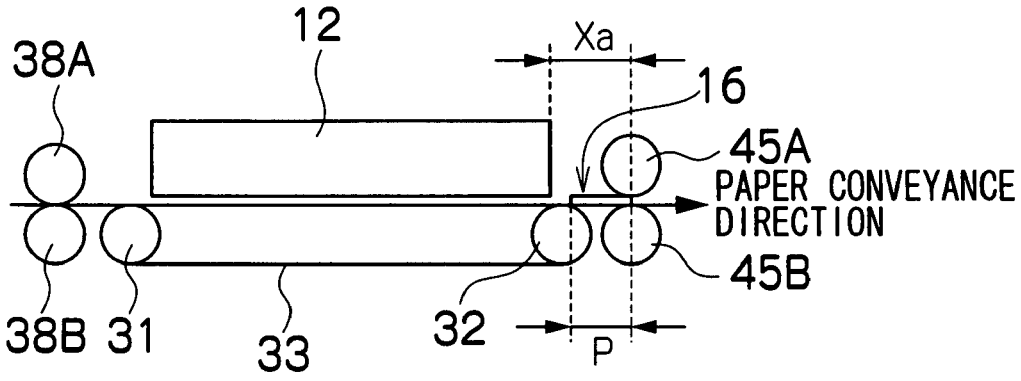
FIGS. 14A and 14B are diagrams for illustrating the factors of speed variation in a case where one sheet of recording paper is conveyed.

In a case where there is only one sheet of recording paper 16 on the belt 33 and the relationship of $P<X_a$ is satisfied as shown in FIG. 14A, then the whole of the recording paper 16 is situated outside the recording region (to the downstream side of the recording region in the paper conveyance direction) at the timing when the leading end portion of the recording paper 16 starts to receive the pressurized contact of the paper output rollers 45A and 45B, and therefore the speed variation in the recording paper 16 itself (the speed variation in the recording paper 16 due to the above-described factor (A)) does not affect recording quality. In other words, it is considered that the speed variation in the recording paper 16 itself does not occur during image recording onto the recording paper 16.

Figure 14B:
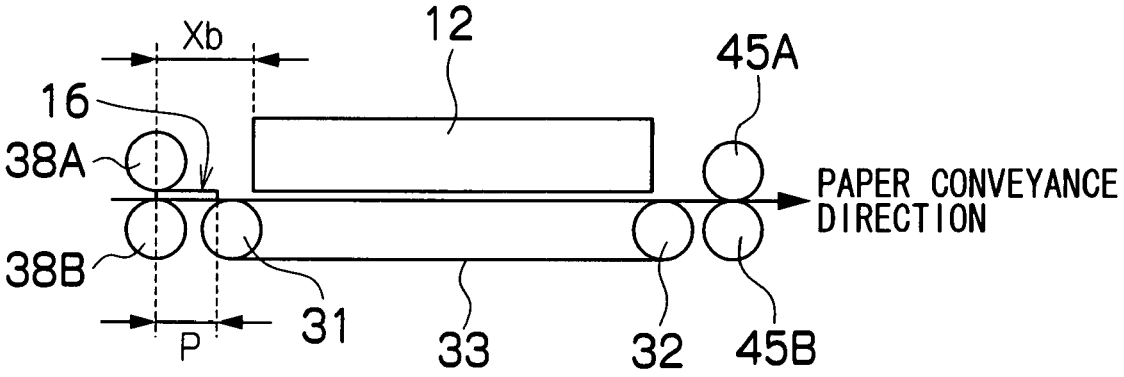

Moreover, in a case where there is only one sheet of recording paper 16 on the belt 33 and the relationship of $P<X_b$ is satisfied as shown in FIG. 14B, then the whole of the recording paper 16 is situated outside the recording region (to the upstream side of the recording region in the paper conveyance direction) at the timing when the trailing end portion of the recording paper 16 separates from the paper supply rollers 38A and 38B, and therefore the speed variation in the recording paper 16 itself (the speed variation in the recording paper 16 due to the above-described factor (B)) does not affect recording quality. In other words, it is considered that the speed variation in the recording paper 16 itself does not occur during image recording onto the recording paper 16.

Figure 15A:
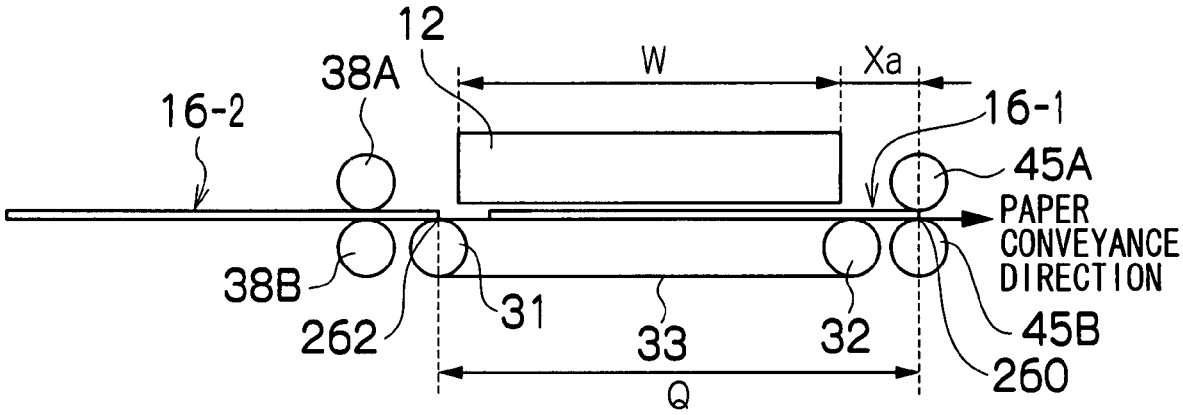
FIGS. 15A and 15B are diagrams for illustrating factors (A) and (B) of the speed variation.

Next, a mode where a plurality of pieces of recording paper 16 are conveyed consecutively is described below. As shown in FIG. 15A, taking the distance between the leading end portion 260 of a preceding recording paper 16-1 and the leading end portion 262 of the subsequent recording paper 16-2 to be Q, if the conditions of $Q>W+X_a$ are satisfied, the subsequent recording paper 16-2 is situated outside the recording region at the timing when the leading end portion 260 of the preceding recording paper 16-1 starts to receive the pressurized contact of the paper output rollers 45A and 45B, and therefore the speed variation of the preceding recording paper 16-1 does not affect the recording quality of the subsequent recording paper 16-2. In other words, it is considered that the speed variation does not occur in the recording paper (the recording paper 16-2 shown in FIG. 15A) due to the above-described factor (C).

Figure 15B:
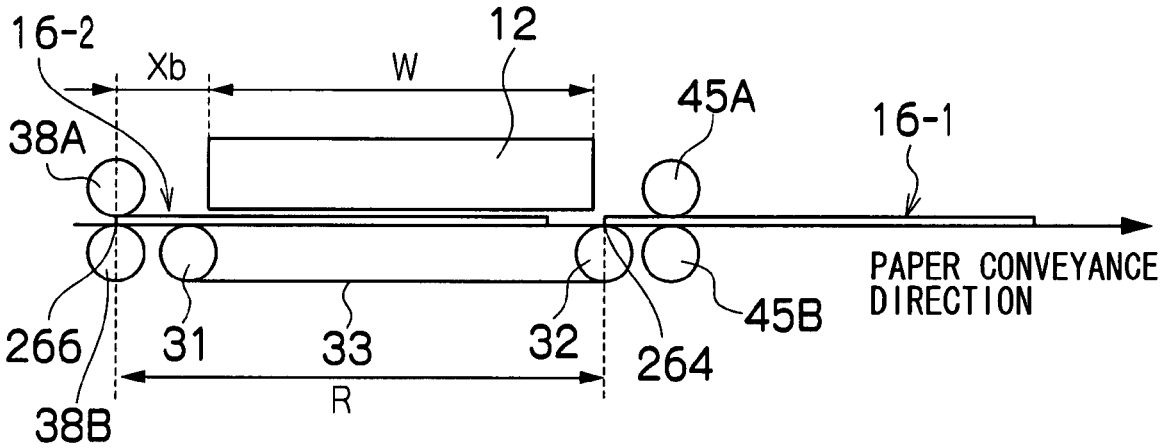

Moreover, as shown in FIG. 15B, taking the distance between the trailing end portion 264 of the preceding recording paper 16-1 and the trailing end portion 266 of the subsequent recording paper 16-2 to be R, then if the conditions of $R>W+X_b$ are satisfied, the trailing end portion 264 of the preceding recording paper 16-1 is situated outside the recording region (to the upstream side of the recording region in terms of the paper conveyance direction) at the timing when the subsequent recording paper 16-2 separates from the paper supply rollers 38A and 38B, and therefore the speed variation of the subsequent recording paper 16-2 does not affect the recording quality on the preceding recording paper 16-1. In other words, it is considered that the speed variation does not occur in the recording paper (the recording paper 16-1 in FIG. 15B) due to the above-described factor (D).

In the cases shown in FIGS. 15A and 15B, the speed variation in the recording paper itself does occur due to the above-described factors (A) and (B), for the recording paper that is situated in the recording region (the recording paper 16-1 in FIG. 15A and the recording paper 16-2 in FIG. 15B).

Figure 16A:
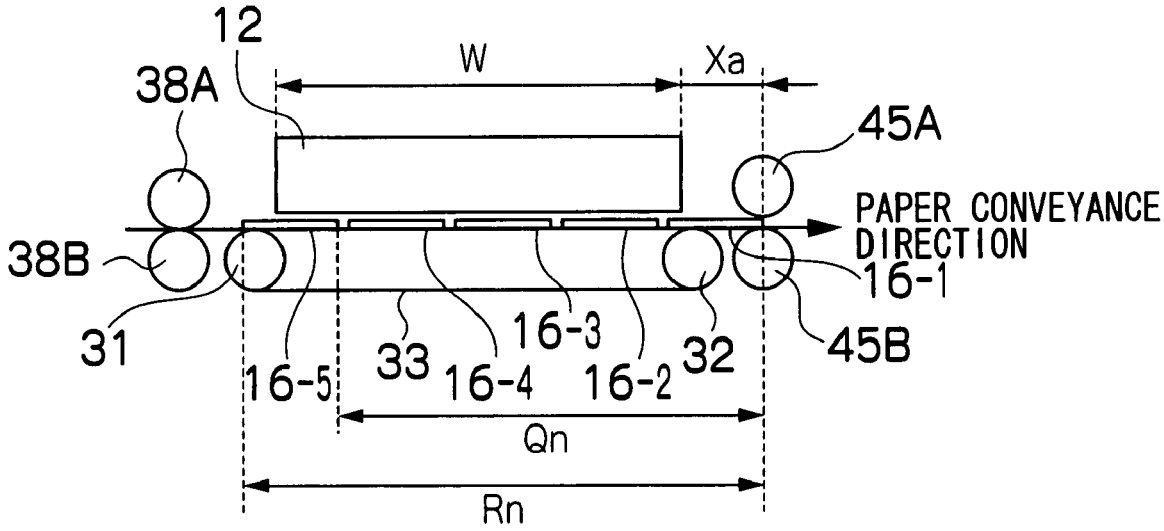
FIGS. 16A and 16B are diagrams for illustrating factors (C) and (D) of the speed variation.

FIG. 16A shows a case where there are a plurality of pieces of recording paper 16 (16-1, 16-2, 16-3, 16-4 and 16-5) in the recording region.

As shown in FIG. 16A, there are four pieces of recording paper 16-1, 16-2, 16-3 and 16-4 which precede the recording paper 16-5. If the distance $Q_n$ between the leading end portion of the leading recording paper 16-1 and the leading end portion of the rearmost recording paper 16-5 has the relationship of $Q_n<W+X_a$, then the recording quality on the four subsequent pieces of recording paper 16-2, 16-3, 16-4 and 16-5 is affected at the timing when the leading recording paper 16 starts to receive pressurized contact from the paper output rollers 45A and 45B. This means that in the case of the recording paper 16-5, the speed variation due to the speed variation (in other words, the speed variation due to the above-described factor (C)) of the other recording papers 16-1 to 16-4, occurs a plurality of times.

To state this situation in general terms, it is supposed that there are n pieces of recording paper on the belt 33, and the leading end portion of a specified recording paper $\mathbf{16}_{i-n}$ is in contact with the paper output rollers 45A and 45B. In this case, if the distance $Q_n$ between the leading end portion of the recording paper $\mathbf{16}_i$ and the leading end portion of the recording paper $\mathbf{16}_{i-n}$ which is n pieces ahead of the recording paper $\mathbf{16}_i$, has the relationship of $Q_n<W+X_a$, then the speed variation occurs in the recording paper $\mathbf{16}_i$ a number of times equal to the number of pieces of recording paper preceding the recording paper $\mathbf{16}_i$ (in the present example, n sheets). However, if the distance $R_n$ between the trailing end portion of the recording paper $\mathbf{16}_i$ and the leading end portion of the recording paper $\mathbf{16}_{i-n}$, which is n pieces ahead of the recording paper $\mathbf{16}_i$, has the relationship of $R_n<X_a$, then the speed variation in the recording papers $\mathbf{16}_{i-1}$, $\mathbf{16}_{i-2}$, . . . preceding the recording paper $\mathbf{16}_i$ does not affect the recording quality of the recording paper $\mathbf{16}_i$.

Figure 16B:
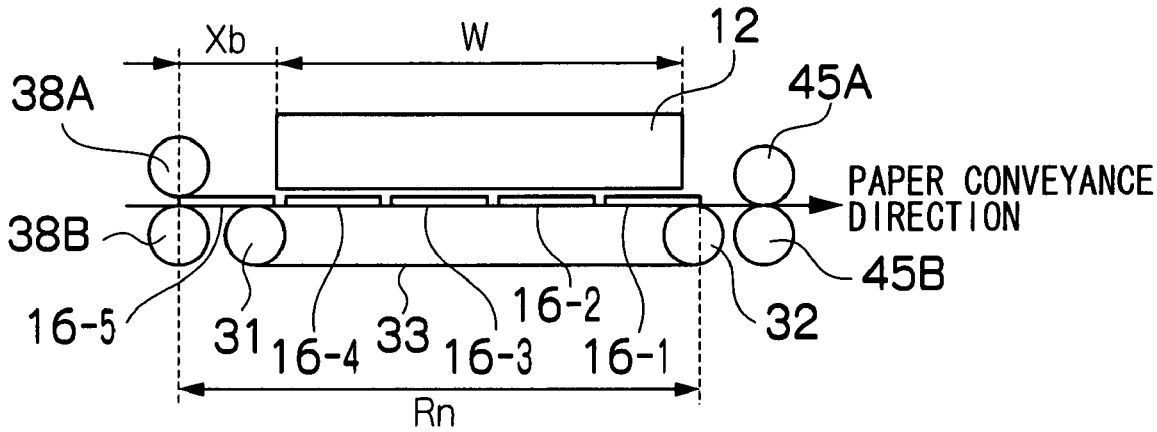

Furthermore, in FIG. 16B, similarly to FIG. 16A, there are four pieces of recording paper 16-2, 16-3, 16-4 and 16-5 following the recording paper 16-1. If the distance $R_n$ between the leading end portion of the leading recording paper 16-1 and the trailing end portion of the rearmost recording paper 16-5 has the relationship of $R_n<W+X_b$, then the speed variation will occur four times in the leading recording paper 16-1, at the timings when the following four recording papers 16-2 to 16-5 separate from the paper supply rollers 38A and 38B.

To state this situation in general terms, it is supposed that there are n pieces of recording paper on the belt 33, and the trailing end portion of a specified recording paper $\mathbf{16}_{i+n}$ is separating from the paper supply rollers 38A and 38B. In this case, if the distance $R_n$ between the leading end portion of the recording paper $\mathbf{16}_i$ and the trailing end portion of the recording paper $\mathbf{16}_{i+n}$, which is n pieces behind the recording paper $\mathbf{16}_i$, has the relationship of $R_n<W+X_b$, then the speed variation occurs in the recording paper $\mathbf{16}_i$ a number of times equal to the number of pieces of recording paper following the recording paper $\mathbf{16}_i$ (in the present example, n sheets). However, if the conditions of $R_n<X_b$ are satisfied, then the speed variations in the recording papers $\mathbf{16}_{i+1}$, $\mathbf{16}_{1+2}$, . . . , following the recording paper $\mathbf{16}_i$ do not affect the recording quality on the preceding recording paper $\mathbf{16}_i$.

Figure 17:
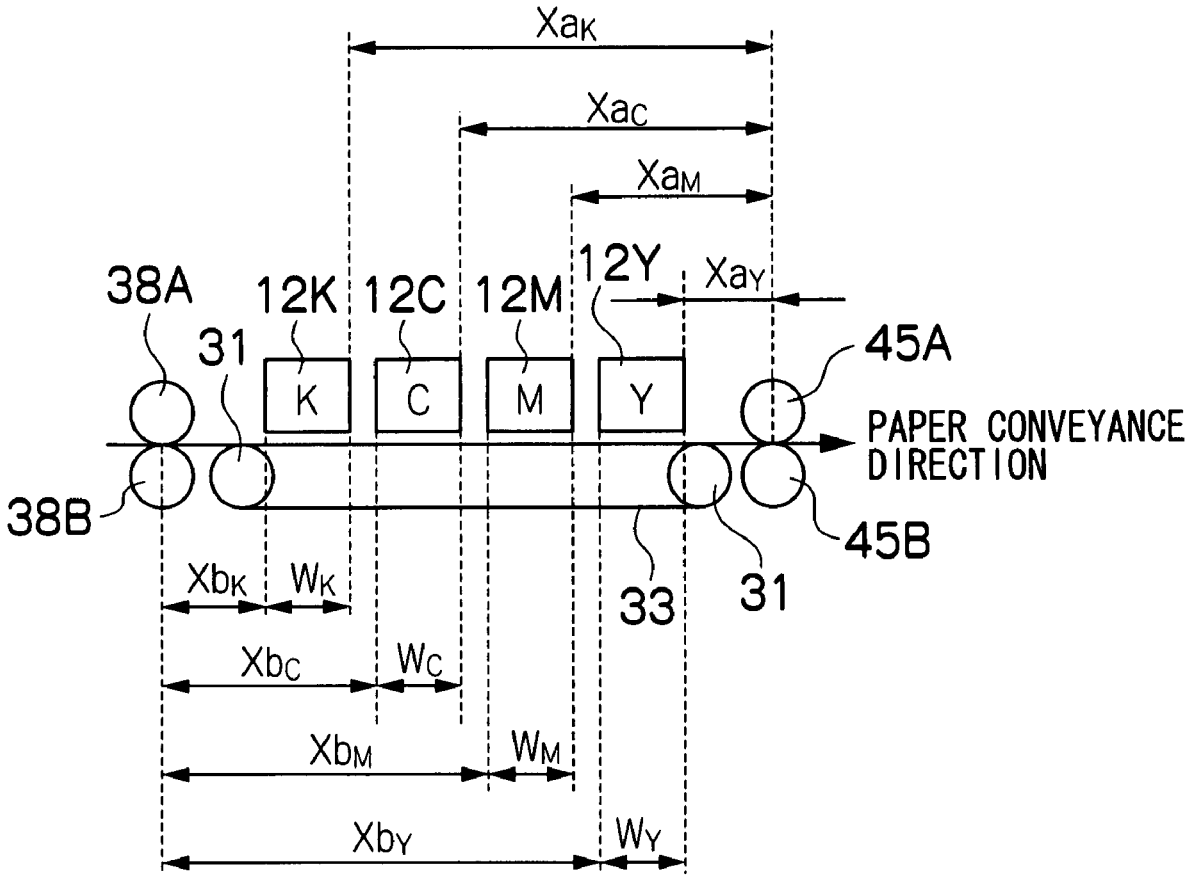
FIG. 17 is a diagram showing the detailed composition of another aspect of the image recording block shown in FIG. 9.

FIG. 17 shows a mode where the recording heads 12K, 12C, 12M and 12Y corresponding to the respective colors of K, C, M and Y are provided separately in the recording unit 12. In the recording unit 12 including line type heads, the recording heads of the respective colors are separated and are disposed at prescribed intervals. As shown in FIG. 17, in a mode where a plurality of independent recording heads are provided, the distance $X_a$ between the front end portion of the recording head and the paper output rollers 45A and 45B and the distance $X_b$ between the rear end portion of the recording head and the paper supply rollers 38A and 38B, are taken into consideration for each respective recording head.

It is possible to predict what kind of speed variations will occur when the following parameters are already know: the lengths $W_K$, $W_C$, $W_M$ and $W_Y$ of the respective recording heads 12K, 12C, 12M and 12Y of the colors K, C, M and Y in the paper conveyance direction; the distances $X_{aK}$, $X_{aC}$, $X_{aM}$ and $X_{aY}$ from the respective front ends of the recording heads 12K, 12C, 12M and 12Y (the ends on the upstream side in terms of the paper conveyance direction) to the paper supply rollers 45A and 45B; the distances $X_{bK}$, $X_{bC}$, $X_{bM}$ and $X_{bY}$ from the respective rear ends of the recording heads 12K, 12C, 12M and 12Y (the ends on the downstream side in terms of the paper conveyance direction) to the paper supply rollers 38A and 38B; and the length and number of pieces of the recording paper 16.

As described above, the speed variation data for the recording paper 16 is determined in accordance with the conditions relating to the composition of the recording unit 12, the size of the recording paper 16 and the number of pieces of recording paper 16, and the data thus determined is then stored in association with these respective conditions. It is thereby possible to provide desirable correction of the ejection timings in accordance with various recording conditions.

Next, the calculation of speed variation data when a plurality of pieces of recording paper 16 are conveyed consecutively, is described below in detail with reference to FIGS. 18 and 19.

Figure 18:
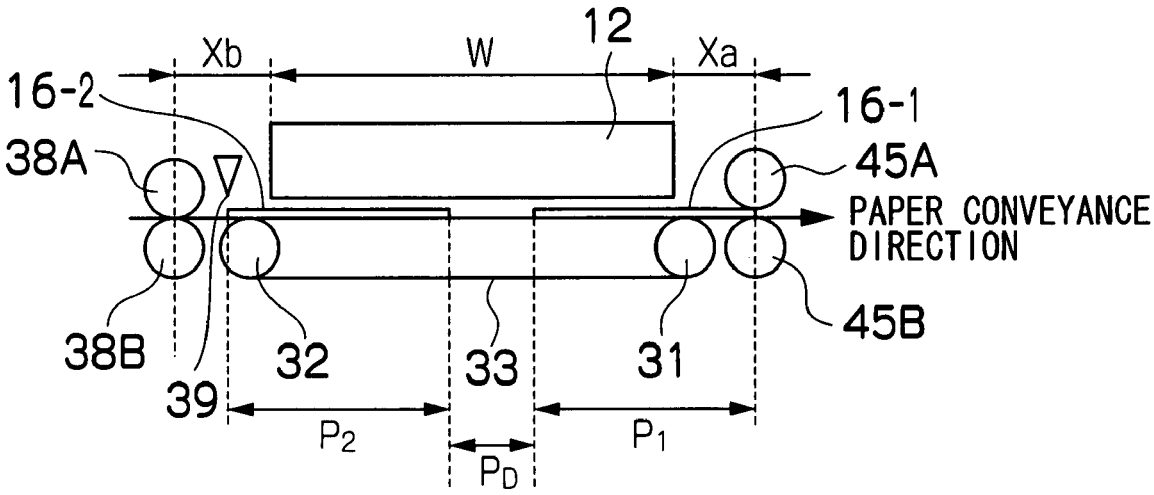
FIG. 18 is a diagram for describing test pattern determination relating to a second embodiment of the present invention.

FIG. 18 is a diagram for describing a method of determining the speed variation data for the recording paper 16 due to the aforementioned factors (A) to (D), using two pieces of recording paper 16-1 and 16-2.

The following parameters are already known: the length W of the recording unit 12 in the paper conveyance direction shown in FIG. 18; the distance $X_a$ between the front end portion of the recording unit 12 (the end on the downstream side in terms of the paper conveyance direction) and the paper output rollers 45A and 45B; and the distance $X_b$ between the rear end portion of the recording unit 12 (the end on the upstream side in terms of the paper conveyance direction) and the paper supply rollers 38A and 38B.

It is possible to determine the speed variation data for the recording paper 16 due to the factors (A) to (D), by determining the speed of two pieces of recording paper 16-1 and 16-2. In this case, the recording papers 16-1 and 16-2 have all of the following relationships:

$$P_1>X_a,\ P_1>X_b,\ P_2>X_a,\ P_2>X_b,\ \text{and}\ P_1+P_2+P_D<X_a+W+X_b,$$

where $P_1$ is the length of the preceding recording paper 16-1 in the paper conveyance direction, $P_2$ is the length of the subsequent recording paper 16-2 in the paper conveyance direction, and $P_D$ is the distance between the trailing end portion of the recording paper 16-1 and the leading end portion of the recording paper 16-2.

The length $P_1$ of the preceding recording paper 16-1 in the paper conveyance direction and the length $P_2$ of the subsequent recording paper 16-2 in the paper conveyance direction are known. It is possible to adopt a composition in which these values $P_1$ and $P_2$ are input via a user interface, such as a keyboard, or a composition in which these values $P_1$ and $P_2$ relating to the recording paper are read in automatically from an information record body in which the recording paper information is stored, when the paper is loaded in the paper supply unit 18 (see FIG. 1). Moreover, the distance $P_D$ between the trailing end portion of the recording paper 16-1 and the leading end portion of the recording paper 16-2 is measured by using the paper supply sensor 39 and a counter (not illustrated).

Figure 19:
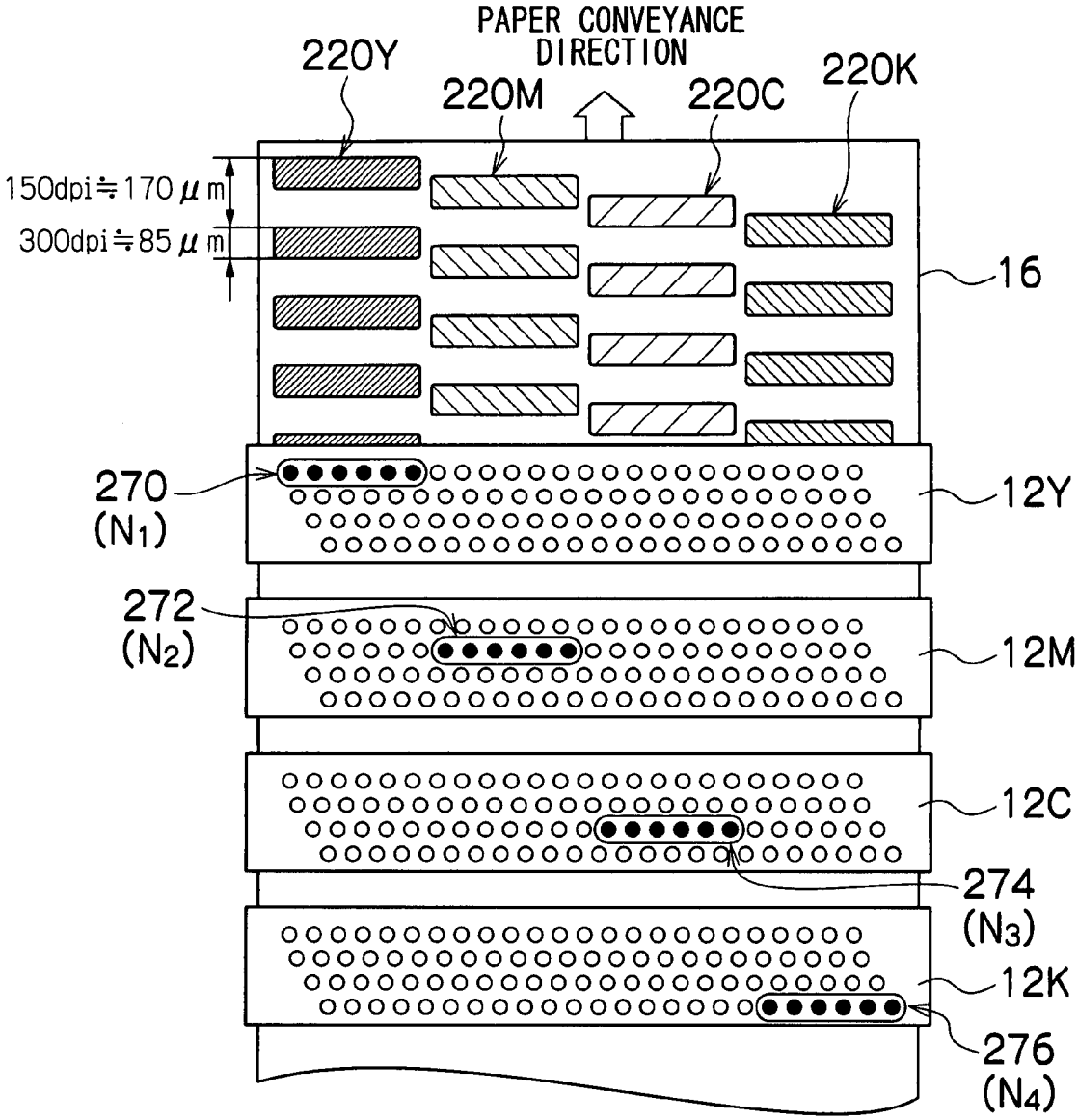
FIG. 19 is a diagram for describing test pattern recording relating to a second embodiment of the present invention.

FIG. 19 shows the details of the test pattern image 220 (test patterns 220K, 220C, 220M and 220Y) recorded on the recording paper 16, which is also shown in FIGS. 11A and 11B. FIG. 19 shows the nozzle arrangement of the recording heads 12K, 12C, 12M and 12Y of the respective colors in a simplified view, but in practice, the matrix configuration shown in FIG. 3A is adopted. Moreover, the recording of the test pattern image 220 is carried out by means of a single pass operation in which the recording papers 16-1 and 16-2 are moved (scanned) once only through the recording region of the recording unit 12.

The test pattern image 220 shown in FIG. 19 is constituted of a Y ink pattern 220Y, an M ink pattern 220M, a C ink pattern 220C and a K ink pattern 220K, and the patterns of the colors are recorded respectively onto separate regions of the recording paper 16 divided in the direction (the breadthways direction of the recording paper 16) perpendicular to the paper conveyance direction.

In other words, the test pattern image 220 is recorded onto the recording paper 16 in such a manner that the Y ink pattern 220Y, the M ink pattern 220M, the C ink pattern 220C and the K ink pattern 220K are aligned in this order in the breadthways direction of the recording paper 16, from the left-hand side in FIG. 19. FIG. 19 shows a mode where the test patterns for the colored inks are recorded respectively at positions which are staggered by a prescribed interval in the paper conveyance direction, but the present invention is not limited to this, and the test patterns of the colored inks may also be recorded onto the same position in terms of the paper conveyance direction.

When recording the test pattern image 220 shown in FIG. 19, the ink ejection from the recording heads 12K, 12C, 12M and 12Y of the respective colors is controlled in such a manner that the inks of respective colors are ejected from specified nozzles in the respective recording heads 12K, 12C, 12M and 12Y. In the Y head 12Y, a plurality of nozzles (nozzle group $N_1$) in the region indicated by the reference numeral 270 in FIG. 19 are used. The nozzle group $N_1$ includes nozzles which form dots at the same position in terms of the paper conveyance direction on the recording paper 16, when these nozzles eject ink at the same timing.

Similarly, in the M head 12M, a nozzle group $N_2$ in the region indicated by the reference numeral 272 is used, in the C head 12C, a nozzle group $N_3$ in the region indicated by the reference numeral 274 is used, and in the K head 12K, a nozzle group $N_4$ in the region indicated by the reference numeral 276 is used.

Since the recording regions of the recording heads 12K, 12C, 12M and 12Y (the recording region of the recording unit 12) have prescribed lengths in the paper conveyance direction, then the inks ejected from the respective recording heads 12K, 12C, 12M and 12Y at the same timing will be deposited onto the preceding recording paper 16-1 or onto the subsequent recording paper 16-2, when the preceding recording paper 16-1 and the subsequent recording paper 16-2 are present simultaneously on the recording region. In the respective recording heads 12K, 12C, 12M and 12Y, by simultaneously using the nozzle group $N_1$ at the front end in the paper conveyance direction and the nozzle group $N_4$ at the rear end in the paper conveyance direction, it is possible to record test patterns in the case of speed variations due to the above-described factors (A) to (D), onto the preceding recording paper 16-1 and the subsequent recording paper 16-2.

For example, when the speed variation occurs in the recording paper 16 due to the above-described factor (C), if ink is ejected from the nozzle group $N_1$ only that is situated at the front end of the recording region, then there may be a case where it is not possible to record the test pattern image that is subjected to the speed variation based on the factor (C), on the subsequent recording paper 16-2. More specifically, if the subsequent recording paper 16-2 is not present under the nozzle group $N_1$ when the preceding recording paper 16-1 receives pressurized contact with the paper output rollers 45A and 45B shown in FIG. 18, then it is not possible to record the test pattern image that is subjected to the speed variation based on the factor (C). Similarly, when the speed variation occurs in the recording paper 16 due to the above-described factor (D), if ink is ejected only from the nozzle group $N_4$ situated at the rear end of the recording region, then there may be a case where it is not possible to record the test pattern image that is subjected to the speed variation based on the factor (D), on the preceding recording paper 16-1. The recording of the test pattern image shown in the present embodiment is therefore desirable in that problems of this kind do not occur.

Moreover, the test pattern image 220 shown in FIG. 19 has a prescribed length in the paper conveyance direction and is recorded at a prescribed arrangement pitch in the paper conveyance direction. As shown in FIG. 19, a desirable mode is one where the width of each pattern (line) is 85 μm, and where the arrangement pitch of the patterns is approximately 170 μm.

Figure 20:
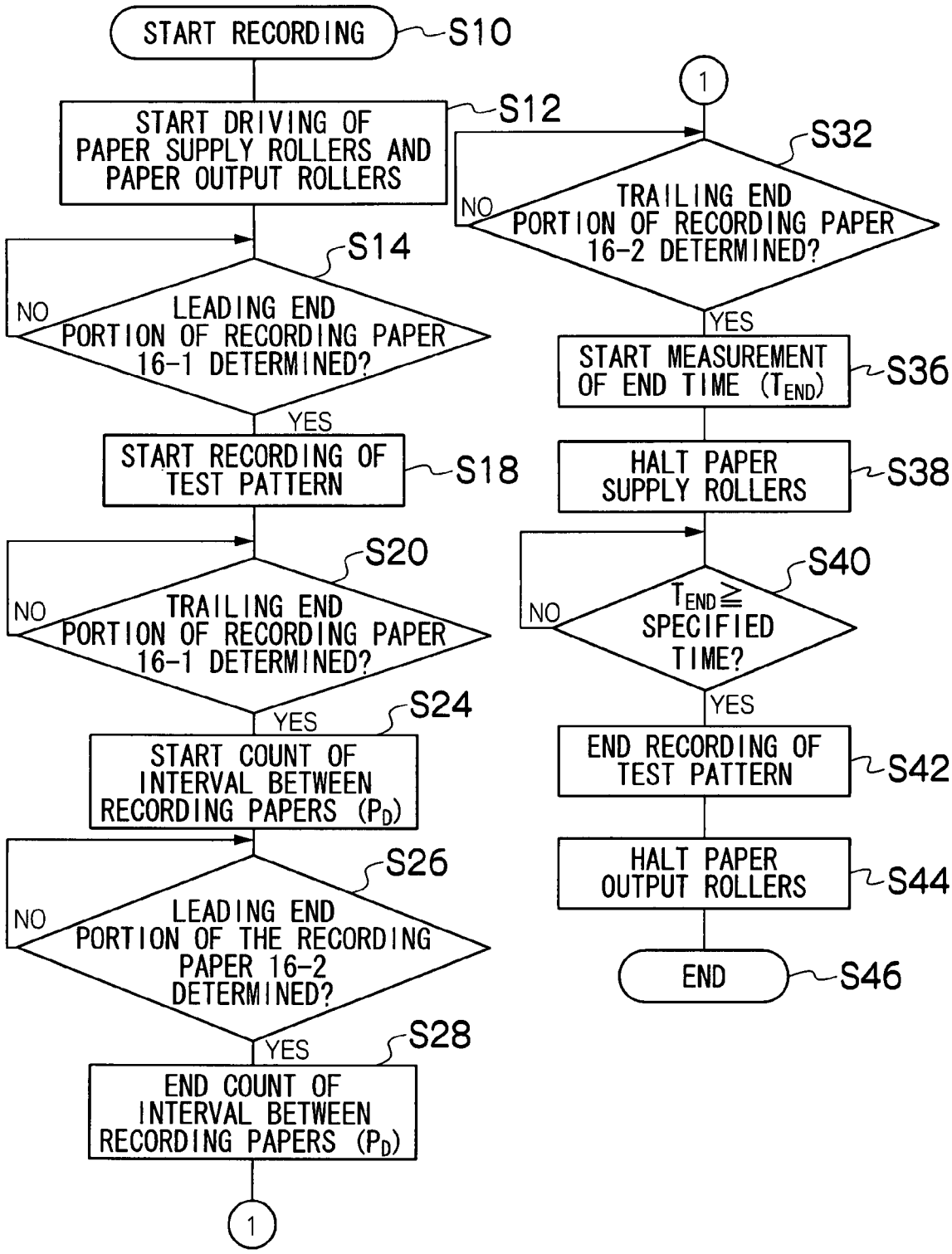
FIG. 20 is a flowchart of test pattern recording relating to a second embodiment of the present invention.

FIG. 20 is a flowchart showing the sequence of control for the recording of the above-described test pattern image, and FIGS. 21A to 21K are conceptual diagrams showing schematic views of respective states of test pattern image recording. Below the test pattern image recording procedure shown in FIG. 20 is described with reference to FIGS. 21A to 21K.

When test pattern recording starts (step S10), the paper supply rollers 38A and 38B and the paper output rollers 45A and 45B are started (step S12), and the procedure then advances to step S14.

Figure 21A:
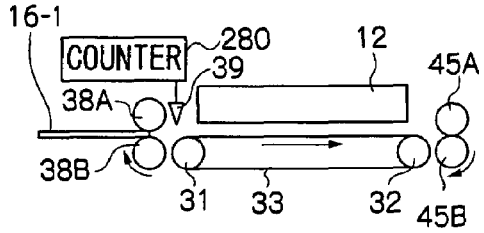
FIGS. 21A to 21K are diagrams for describing state transitions in test pattern recording relating to a second embodiment of the present invention.

FIG. 21A shows a state where the first sheet of recording paper 16 is supplied to a standby position and the paper supply rollers 38A and 38B and the paper output rollers 45A and 45B have started to be driven. The recording paper 16-1 situated in the standby position is pressed between the paper supply rollers 38A and 38B and due to the rotation of the paper supply rollers 38A and 38B, the recording paper 16-1 is moved in a prescribed conveyance direction.

Figure 21B:
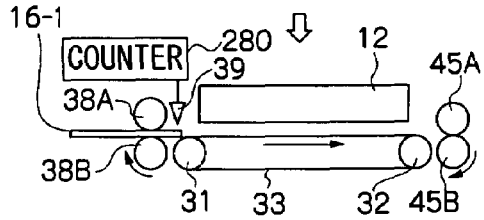

At step S14 in FIG. 20, determination of the leading end portion of the recording paper 16-1 is carried out by the paper supply sensor 39, and if the leading end portion of the recording paper 16-1 is not determined (NO verdict), then the determination of the leading end portion of the recording paper 16-1 is continued. If, on the other hand, the leading end portion of the recording paper 16-1 is determined (YES verdict), then the procedure advances to step S18. FIG. 21B shows a state where the leading end portion of the recording paper 16-1 has been determined by the paper supply sensor 39.

At step S18 in FIG. 20, when the recording paper 16-1 arrives at the recording region of the recording unit 12, then ink is ejected from the recording unit 12, and a prescribed test pattern image is recorded on the recording paper 16-1 (step S18). During recording of the test pattern image, determination of the trailing end portion of the recording paper 16-1 is carried out by the paper supply sensor 39 (step S20), and if the trailing end portion of the recording paper 16-1 is not determined (NO verdict), then the determination of the trailing end portion of the recording paper 16-1 is continued, and if the trailing end portion of the recording paper 16-1 is determined (YES verdict), then the procedure advances to step S24.

Figure 21C:
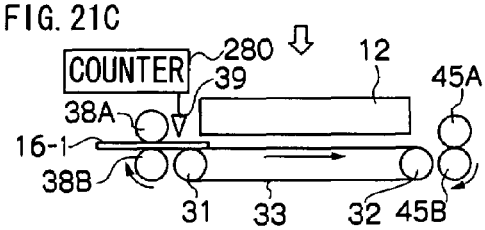
Figure 21D:
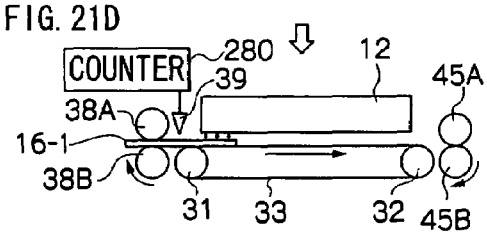

FIG. 21C shows a state at the start of test pattern image recording, and FIG. 21D shows a state where the recording paper 16-1 is separated from the paper supply rollers 38A and 38B during test pattern image recording, thereby producing the speed variation caused by the above-described factor (B).

At step S24 in FIG. 20, counting of the interval (distance) $P_D$ between the preceding recording paper 16-1 and the subsequent recording paper 16-2 (the distance between the trailing end portion of the preceding recording paper 16-1 and the leading end portion of the subsequent recording paper 16-2) is started (step S24).

Figure 21E:
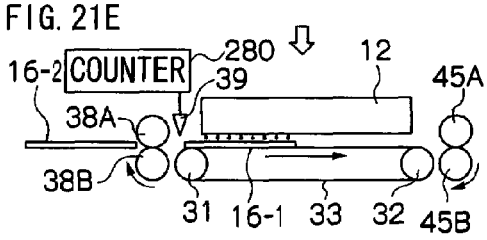

FIG. 21E shows a state where the trailing end portion of the recording paper 16-1 has been determined and the counting of the interval to the subsequent recording paper 16-2 has started. The interval between the preceding recording paper 16-1 and the subsequent recording paper 16-2 is counted by using a counter 280.

Figure 21F:
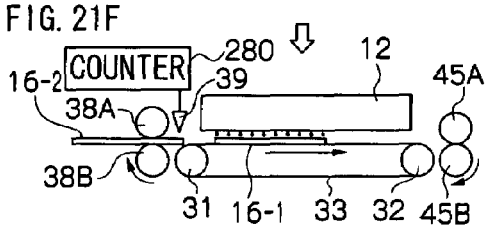

During the counting of the interval between the preceding recording paper 16-1 and the subsequent recording paper 16-2, determination of the leading end portion of the subsequent recording paper 16-2 is carried out (step S26 in FIG. 20). If, at step S26, the leading end portion of the recording paper 16-2 is not determined (NO verdict), then the determination of the leading end portion of the recording paper 16-2 is continued, and when the leading end portion of the recording paper 16-2 is determined (YES verdict), then the counting of the interval between the trailing end portion of the preceding recording paper 16-1 and the leading end portion of the subsequent recording paper 16-2 is terminated (step S28), and the procedure then advances to step S32. FIG. 21F shows a state where the leading end portion of the subsequent recording paper 16-2 has been determined.

At step S32 in FIG. 20, recording of a test pattern image onto the recording paper 16-2 is started at a prescribed timing. During the recording of the test pattern image onto the recording paper 16-2, determination of the trailing end portion of the recording paper 16-2 is carried out (step S32), and if the trailing end portion of the recording paper 16-2 is not determined (NO verdict), then the determination of the trailing end portion of the recording paper 16-2 is continued. On the other hand, if, at step S32, the trailing end portion of the recording paper 16-2 is determined (YES verdict), then the procedure advances to step S36.

Figure 21G:
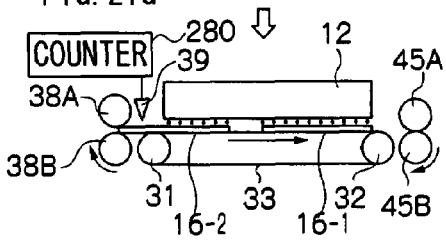
Figure 21H:
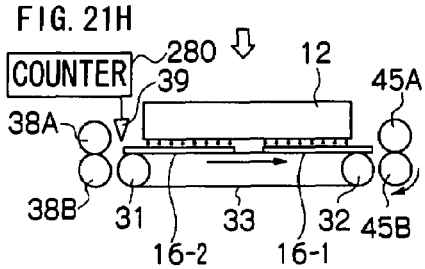

FIG. 21G shows a state where a test pattern image is being recorded onto the recording paper 16-1 and the recording paper 16-2, and FIG. 21H shows a state where the trailing end portion of the recording paper 16-2 is determined.

At step S36, measurement of the halt time $T_{END}$ is started (step S36), and if there is no subsequent recording paper following the recording paper 16-2, then the paper supply rollers 38A and 38B are halted (step S38) and the procedure then advances to step S40.

The halt time $T_{END}$ of which measurement is started in step S36 is the period of time from the time at which the trailing end portion of the recording paper 16-2 is determined until the trailing end portion of the recording paper 16-2 passes the print unit 12.

At step S40, it is judged whether or not the halt time $T_{END}$ has reached a specified time period (more specifically, a time value obtained by dividing the distance from the paper supply sensor 39 to the paper output rollers 45A and 45B, by the conveyance speed of the recording paper 16-2) determined on the basis of the length $P_2$ of the recording paper 16-2 in the paper conveyance direction, and the conveyance speed of the recording paper 16-2 (the conveyance speed of the belt 33), and if the halt time $T_{END}$ has not reached the specified time period (NO verdict), then the measurement of the halt time $T_{END}$ is continued. If, on the other hand, the halt time $T_{END}$ has reached the specified time period (YES verdict), then test pattern image recording is terminated (step S42), the driving of the paper output rollers 45A and 45B is halted (step S44), and test pattern recording ends (step S46).

Figure 21I:
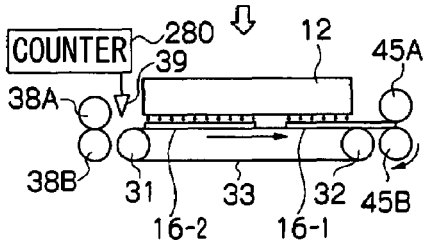
Figure 21J:
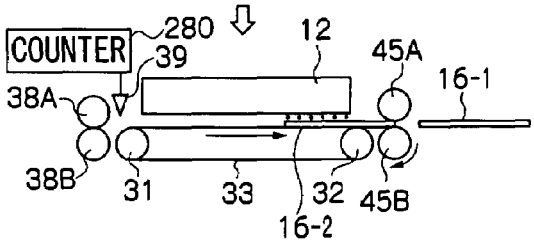
Figure 21K:
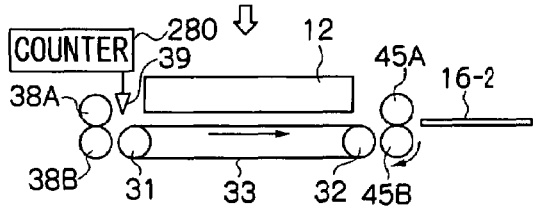

FIG. 21I shows a state at the time when the preceding recording paper 16-1 receives pressurized contact from the paper output rollers 45A and 45B. In the state shown in FIG. 21I, the speed variation occurs in the preceding recording paper 16-1 due to the above-described factor (A), and the speed variation occurs in the subsequent recording paper 16-2 due to the above-described factor (C). FIG. 21J shows a state where the speed variation occurs in the recording paper 16-2 due to the above-described factor (A), when the recording paper 16-2 receives pressurized contact from the paper output rollers 45A and 45B. Moreover, FIG. 21K shows a state where the recording paper 16-2 has been output.

The test patterns thus recorded on two pieces of recording paper 16-1 and 16-2 are then read in by the test pattern reading unit 218 of the speed determination block 204 shown in FIG. 9, and the speed variation data of the recording papers 16-1 and 16-2 in the image recording block 202 is calculated on the basis of these reading results. The method of calculating the speed variation data uses the same method as that of the first embodiment.

In other words, the test pattern image is recorded by means of a prescribed recording method onto a prescribed number of pieces of recording paper 16 having a prescribed size (test pattern recording step), in the image recording block 202 shown in FIG. 9, then in the speed determination block 204 shown in FIG. 9, the test pattern image is read in by means of the test pattern reading unit 218 (test pattern reading step), and the speed variation data is then calculated (speed variation data calculation step). The speed variation data thus calculated is stored in a prescribed storage unit (speed variation data storage step).

Figure 22A:
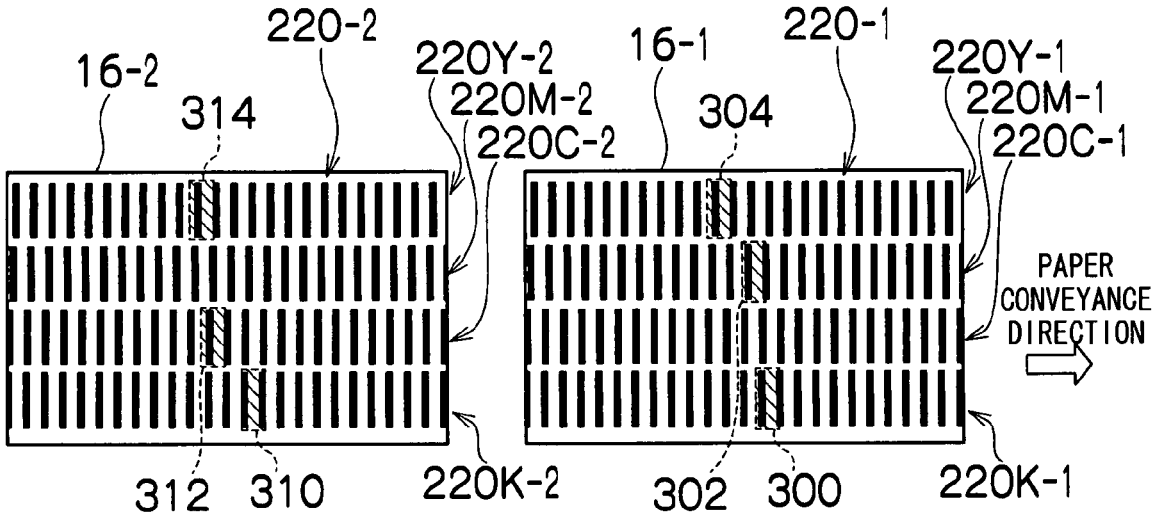
FIGS. 22A and 22B are diagrams for describing the relationship between the speed variation positions and the nozzles.
Figure 22B:
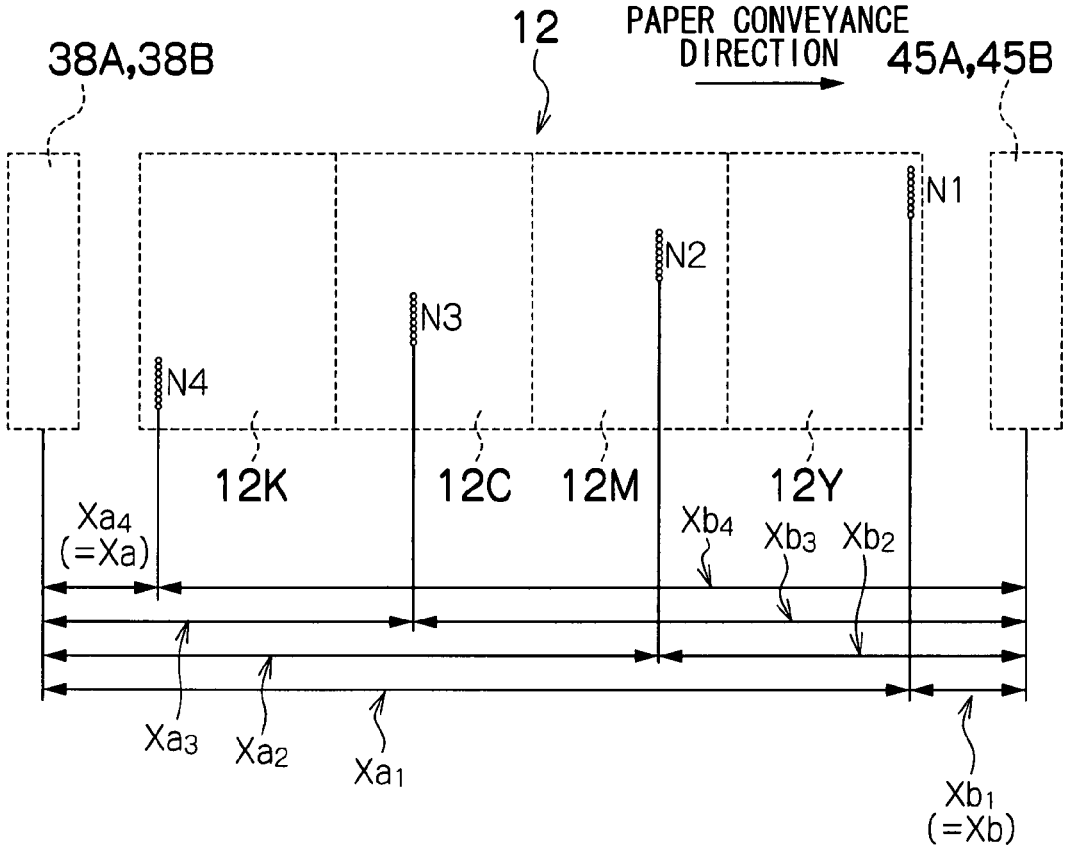

Next, the test pattern reading step is described with reference to FIGS. 22A and 22B. FIG. 22A shows test patterns 220-1 and 220-2 that have been recorded respectively on the recording paper 16-1 and the recording paper 16-2 in the test pattern recording step shown in FIGS. 20 and 21A to 21K. FIG. 22B is a conceptual diagram showing the positions of the nozzle groups recording the test pattern, in the conveyance path of the recording paper 16.

As shown in FIG. 22A, the test patterns 220-1 and 220-2 recorded include four regions divided in the direction perpendicular to the paper conveyance direction, and the four regions of the test patterns 220-1 and 220-2 are recorded by means of the corresponding colored inks ejected from the recording heads 12K, 12C, 12M and 12Y.

FIG. 22B shows the positions, on the conveyance path of the recording paper 16, of the nozzle groups $N_1$ to $N_4$ of the recording unit 12 (the recording heads 12K, 12C, 12M and 12Y) which record the test patterns. The nozzle groups $N_1$ to $N_4$ include a plurality of nozzles aligned in a direction perpendicular to the paper conveyance direction (see FIG. 19). The positions of the nozzle groups $N_1$ to $N_4$ in terms of the conveyance path of the recording paper 16 shown in FIG. 22B are previously stored as data in the memory 244 in FIG. 10.

The nozzle groups $N_1$ to $N_4$ in FIG. 22B correspond respectively to Y ink, M ink, C ink and K ink. The pattern groups 220Y-1 and 220Y-2 shown in FIG. 22A are recorded by means of Y ink, and the pattern groups 220M-1 and 220M-2 are recorded by means of M ink. Similarly, the pattern groups 220C-1 and 220C-2 are recorded by means of C ink and the pattern groups 220K-1 and 220K-2 are recorded by means of K ink.

In the test pattern reading process, each of the above-described factors (A) to (D) is independently analyzed on the basis of the test pattern image 220, the speed variation data is calculated for each of the factors (A) to (D), and this speed variation data is stored for each of the factors (A) to (D).

Since the positions in the conveyance path of the recording paper 16 at which the nozzle groups $N_1$ to $N_4$ recording the test patterns 220-1 and 220-2 are provided, are known in terms of the paper conveyance direction, then it is possible to predict (calculate) the positions on the recording paper 16 at which the speed variation of the recording paper 16 will occur.

The test pattern image 220-1 recorded on the recording paper 16-1 shown in FIG. 22A includes: a portion that is subjected to the speed variation caused by the above-described factor (B) at the position indicated by reference numeral 300 in the pattern group 220K-1; a portion that is subjected to the speed variation caused by the above-described factor (D) at the position indicated by the reference numeral 302 in the pattern group 220M-1; and a portion that is subjected to the speed variation caused by the above-described factor (A) in the portion indicated by reference numeral 304 in the pattern group 220K-1.

The test pattern image 220-2 recorded onto the recording paper 16-2 includes: a portion that is subjected to the speed variation caused by the above-described factor (B) in the portion indicated by reference numeral 310 in the pattern group 220K-2; a portion that is subjected to the speed variation caused by the factor (C) in the portion indicated by the reference numeral 312 in the pattern group 220C-2; and a portion that is subjected to the speed variation caused by the factor (A) in the portion indicated by reference numeral 314 in the pattern group 220Y-2.

As shown in FIG. 22B, symbols $X_{a1}$ to $X_{a4}$ indicate the distances between the paper supply rollers 38A and 38B and the nozzle groups $N_1$ to $N_4$, respectively; and symbols $X_{b1}$ to $X_{b4}$ indicate the distances between the paper output rollers 45A and 45B and the nozzle groups $N_1$ to $N_4$, respectively. The distance $X_{a4}$ from the paper supply rollers 38A and 38B to the nozzle group $N_4$ is equal to the distance $X_a$ from the paper supply rollers 38A and 38B to the rear end portion of the recording unit 12 ($X_{a4}=X_a$). Moreover, the distance $X_{b1}$ from the paper output rollers 45A and 45B to the nozzle group $N_1$ is equal to the distance $X_b$ from the paper output rollers 45A and 45B to the front end portion of the recording unit 12 ($X_{b1}=X_b$). These parameters are stored in the memory 244 in FIG. 10.

For example, assuming that the ink heads 12C and 12K are recording the test pattern image on the recording paper 16-1 when the recording paper 16-1 separates from the paper supply rollers 38A and 38B, it is possible to predict the positions (including the speed variation position 300 shown in FIG. 22) of the portions that are subjected to the speed variation caused by the factor (B) on the recording paper 16-1, as the positions at which the distances from the trailing end of the recording paper 16-1 are $X_{a3}$ and $X_{a4}$ (the distances in the paper conveyance direction from the paper supply rollers 38A and 38B to the nozzle groups $N_3$ and $N_4$), respectively.

Assuming that the ink heads 12Y and 12M are recording the test pattern image on the recording paper 16-1 when the recording paper 16-1 receives the pressurized contact of the paper output rollers 45A and 45B, it is possible to predict the positions (including the speed variation position 304) of the portions that are subjected to the speed variation caused by the factor (A) on the recording paper 16-1, as the positions at which the distances from the leading end of the recording paper 16-1 are $X_{b1}$ and $X_{b2}$ (the distances in the paper conveyance direction from the paper output rollers 45A and 45B to the nozzle groups $N_1$ and $N_2$), respectively. The speed variation position 314 at which the test pattern image is disturbed due to the factor (A) and the speed variation position 310 at which the test pattern image is disturbed due to speed variation cause (B), can also be predicted for the recording paper 16-2 by a similar method.

Moreover, assuming the ink heads 12Y and 12M are recording the test pattern image on the recording paper 16-1 when the recording paper 16-2 separates from the paper supply rollers 38A and 38B, it is possible to predict the positions (including the speed variation position 302) of the portions that are subjected to the speed variation caused by the factor (D) on the recording paper 16-1, as the positions at which the distances from the trailing end portion of the recording paper 16-1 are $(X_{a1}-(P_2+P_D))$ and $(X_{a2}-(P_2+P_D))$, respectively. In this case these values of $(X_{a1}-(P_2+P_D))$ and $(X_{a2}-(P_2+P_D))$ can be obtained respectively by subtracting the length $P_2$ of the recording paper 16-2 in the paper conveyance direction and the distance $P_D$ between the trailing end portion of the recording paper 16-1 and the leading end portion of the recording paper 16-1, from the distances $X_{a1}$ and $X_{a2}$ in the paper conveyance direction from the paper supply rollers 38A and 38B to the nozzle groups $N_1$ and $N_2$.

Assuming that the ink heads 12C and 12K are recording the test pattern image on the recording paper 16-2 when the recording paper 16-1 comes into pressurized contact from the paper output rollers 45A and 45B, it is possible to predict the positions (including the speed variation position 312) of the portions that are subjected to the speed variation caused by the factor (C) on the recording paper 16-2, as the positions at which the distances from the leading end portion of the recording paper 16-2 are $(X_{b3}-(P_1+P_D))$ and $(X_{b4}-(P_1+P_D))$, respectively. In this case, these values of $(X_{b3}-(P_1+P_D))$ and $(X_{b4}-(P_1+P_D))$ can be obtained respectively by subtracting the length $P_1$ in the paper conveyance direction of the recording paper 16-1 and the distance $P_D$ between the trailing end portion of the recording paper 16-1 and the leading end portion of the recording paper 16-1, from the distances $X_{b3}$ and $X_{b4}$ in the paper conveyance direction from the paper output rollers 45A and 45B to the nozzle groups $N_3$ and $N_4$.

In other words, the respective parameters described above are stored in advance in the memory 244 (see FIG. 10), and by acquiring data relating to the lengths $P_1$ and $P_2$ of the recording papers 16-1 and 16-2 in the paper conveyance direction, and the distance $P_D$ between the trailing end portion of the recording paper 16-1 and the leading end portion of the recording paper 16-2, the main controller 246 in FIG. 10 can predict (calculate) the positions on the recording papers 16-1 and 16-2 at which the test pattern image is disturbed due to the speed variation.

In the test pattern reading step according to the present embodiment, the speed variation positions (positions at which the speed variation is likely to occur) are predicted, and the test pattern image is read selectively at the speed variation positions.

In other words, the test pattern reading unit 218 executes reading control by referring to the data on the speed variation positions calculated (predicted) by the main controller 242 in FIG. 10. The speed variation of the recording paper 16 often affects on a certain range of the paper because of phenomena such as elastic deformation of the rollers 31 and 32 in the image recording block 202 shown in FIG. 9, slippage between the recording paper 16 and the belt 33, and vibration of the belt 33. Consequently, a desirable mode is one in which the periphery of the predicted speed variation position is also read in as a region in which the speed variation is likely to occur.

In other words, when reading in the test pattern image corresponding to the position at which the speed variation occurs, the test pattern image is read in over a prescribed range to the front and rear in the paper conveyance direction, centered on the position at which the speed variation occurs. The optimal value of this reading range is determined appropriately in accordance with the composition of the suction belt conveyance unit 22 of the image recording block 202.

The read data for the test pattern image is converted to binary data using a prescribed threshold value, and the speed variation data (see FIG. 8A) is then calculated on the basis of this binarized data. The test pattern image is read in selectively, and the calculated speed variation data forms partial data corresponding to the portions of the test pattern that have been read in.

Since the position at which the speed variation is to occur is already known (predicted in advance), as described above, then in an actual recording operation, it is possible to calculate the time period from the determination of the leading end position of the recording paper 16 until the occurrence of the speed variation, and the time period until the end of the speed variation. Therefore, it is possible to store the speed variation data in association with the time period from the determination of the leading end portion of the recording paper 16 until the start of correction of the speed variation (the time period from the determination of the leading end position of the recording paper 16 until the start of the speed variation), and the time period until the end of this correction (the time period until the end of the speed variation).

When the recording paper 16 for image recording is conveyed, the time period is counted from the determination of the leading end of the recording paper 16. At the time when the speed variation start time stored in association with the speed variation data has elapsed, then the ejection timing is corrected by correcting the trigger signal on the basis of the speed variation data. Moreover, at the time when the end time of the speed variation has elapsed, then the correction of the trigger signal on the basis of the speed variation data is terminated, and ejection is carried out on the basis of the original trigger signal. The correction data occurs two times to four times during the printing of one sheet, and the ejection timing is corrected accordingly on each occasion.

In this way, by adopting a mode in which the positions at which speed variation occurs in the test pattern image are identified, the test pattern image at the positions where the speed variation occurs is read in, and the ejection timing is corrected on the basis of the read results, it is possible to minimize the amount of read data and it is also possible to shorten the reading time and the processing time. Furthermore, it is possible to reduce the data volume of the stored speed variation data, and therefore it is possible to reduce the storage capacity of the speed variation data storage unit 94 shown in FIG. 6, and this helps to lower costs.

In the inkjet recording apparatus 200 having the composition described above, since the test pattern image 220 is recorded on the recording paper 16 by the image recording block 202, and the test pattern image 220 recorded on the recording paper 16 is read in by the test pattern reading unit 218 of the speed determination block 204, then it is possible to accurately determine the speed variation of the recording paper 16 even in a case where a speed differential arises between the recording paper 16 and the belt 33. Furthermore, since the test pattern recording block and the test pattern reading block are separate, then improved accuracy in reading the test pattern image can be expected.

Moreover, in a mode where image recording is carried out by conveying a plurality of pieces of recording paper 16 consecutively, then even if the speed variation occurs in a particular sheet of recording paper as a result of speed variation occurring in the belt 33 due to speed variation of another sheet of recording paper, it is still possible accurately to ascertain the speed variation of that sheet of recording paper.

In the case of image recording onto a plurality of consecutive pieces of recording paper, since the test pattern image is read in at the vicinities of the speed variation positions, in respect of each of the factors of speed variation in the recording paper 16, and speed variation data is calculated for each of the factors of speed variation in the recording paper 16, then it is possible to shorten the test pattern reading time, as well as contributing to reducing the storage volume required to store the speed variation data.

Application Embodiment

Figure 23:
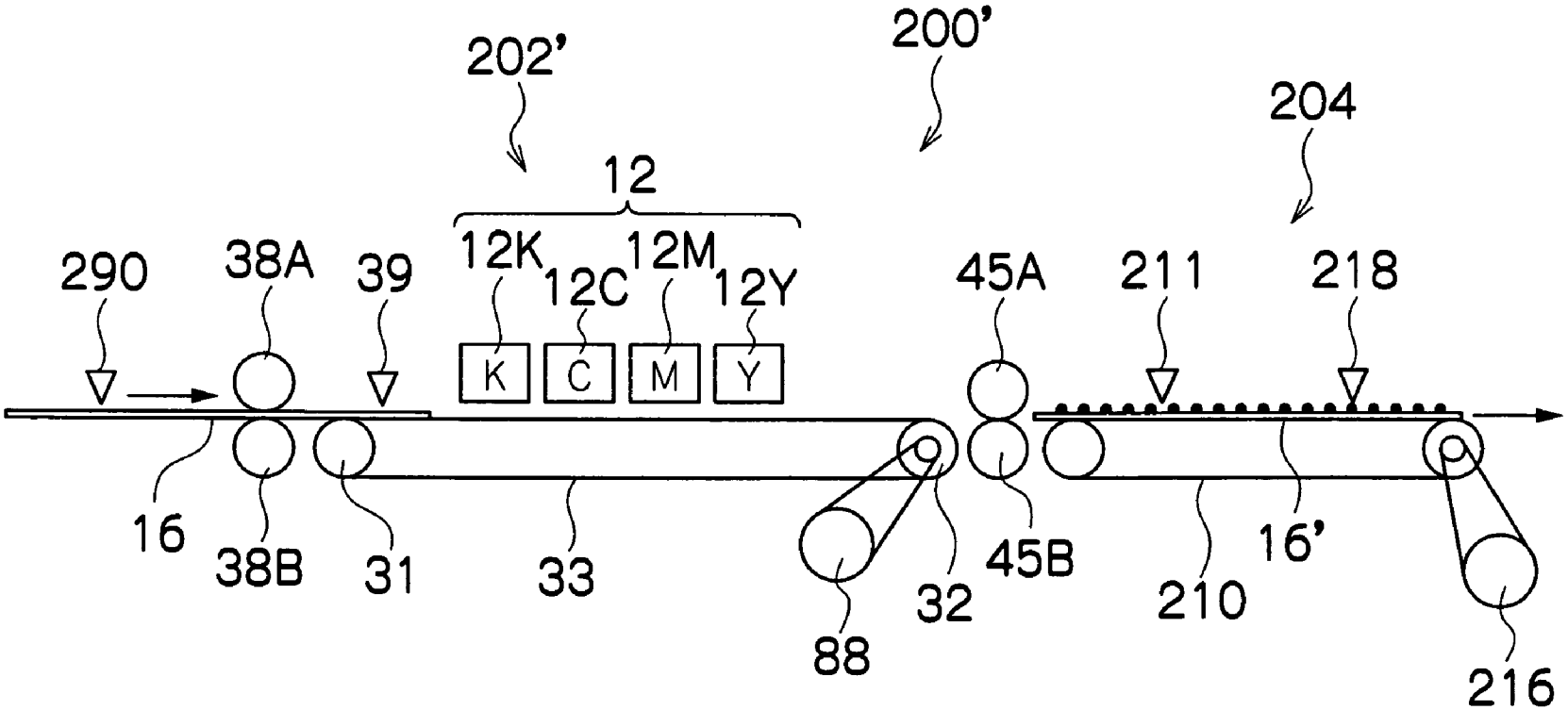
FIG. 23 is a basic schematic drawing of an inkjet recording apparatus according to an application example of the second embodiment of the present invention.

FIG. 23 shows an application of the second embodiment described above. In FIG. 23, items which are the same as or similar to those in FIG. 9 are labeled with the same reference numerals and description thereof is omitted here.

The inkjet recording apparatus 200' shown in FIG. 23 includes a recording paper identification unit 290 which identifies the type or size of the recording paper 16 in an image recording block 202'. At least one of the type and size of the recording paper 16 on which image recording is to be performed is identified by the recording paper identification unit 290, and it is determined whether or not there is a record of the use of this recording paper 16.

If a specified recording paper used has never been used, then a test pattern image is recorded on that recording paper 16, the test pattern image is read in by the speed determination block 204, the speed variation data is calculated from this read result, and the speed variation data is stored in a prescribed storage block.

If, on the other hand, there is a past record of use of a specified recording paper, then the corresponding speed variation data is read out from the speed variation data storage unit 94 shown in FIG. 6, and the ejection timing is corrected on the basis of the speed variation data thus read out.

The recording paper identification unit 290 may have a composition which captures an image of the surface of the recording paper by means of an image pickup element such as a CCD, and identifies the type of the recording paper (for example, the surface properties and color) on the basis of the image pickup results, or it may have a composition which identifies the type of recording paper by means of a sensor which determines the thickness or a sensor which determines the weight, or the like. The aforementioned compositions may also be combined suitably.

It is also possible to adopt a composition in which a user inputs recording paper information via a user interface, such as a keyboard, a mouse, a touch panel, or the like. Moreover, a mode may also be adopted, in which an information storage body (IC tag) which stores recording paper information (the type, color, thickness, weight, size, or the like) is provided on the recording paper stacker (in the case of cut paper) or the core of the roll (in the case of continuous paper), so that the recording paper information is read out automatically from the information storage body when the recording paper is installed in the apparatus.

According to the present application embodiment, even when there is change in the type and size of the recording paper, ejection timing correction which is suitable to that recording paper is carried out.

In the present application embodiment, a mode is adopted where the type of recording paper is identified, but it is also possible to adopt a mode in which speed variation data corresponding to environmental conditions, such as the temperature or humidity, is prepared in advance, and the speed variation data is switched appropriately in accordance with the environmental conditions. By adopting a mode where the speed variation data is switched in accordance with the environmental conditions, it is possible to reduce error in the correction of the ejection timing due to contraction of the recording paper 16 or contraction of the belt 33 based on the environmental conditions.

Third Embodiment

Figure 24:
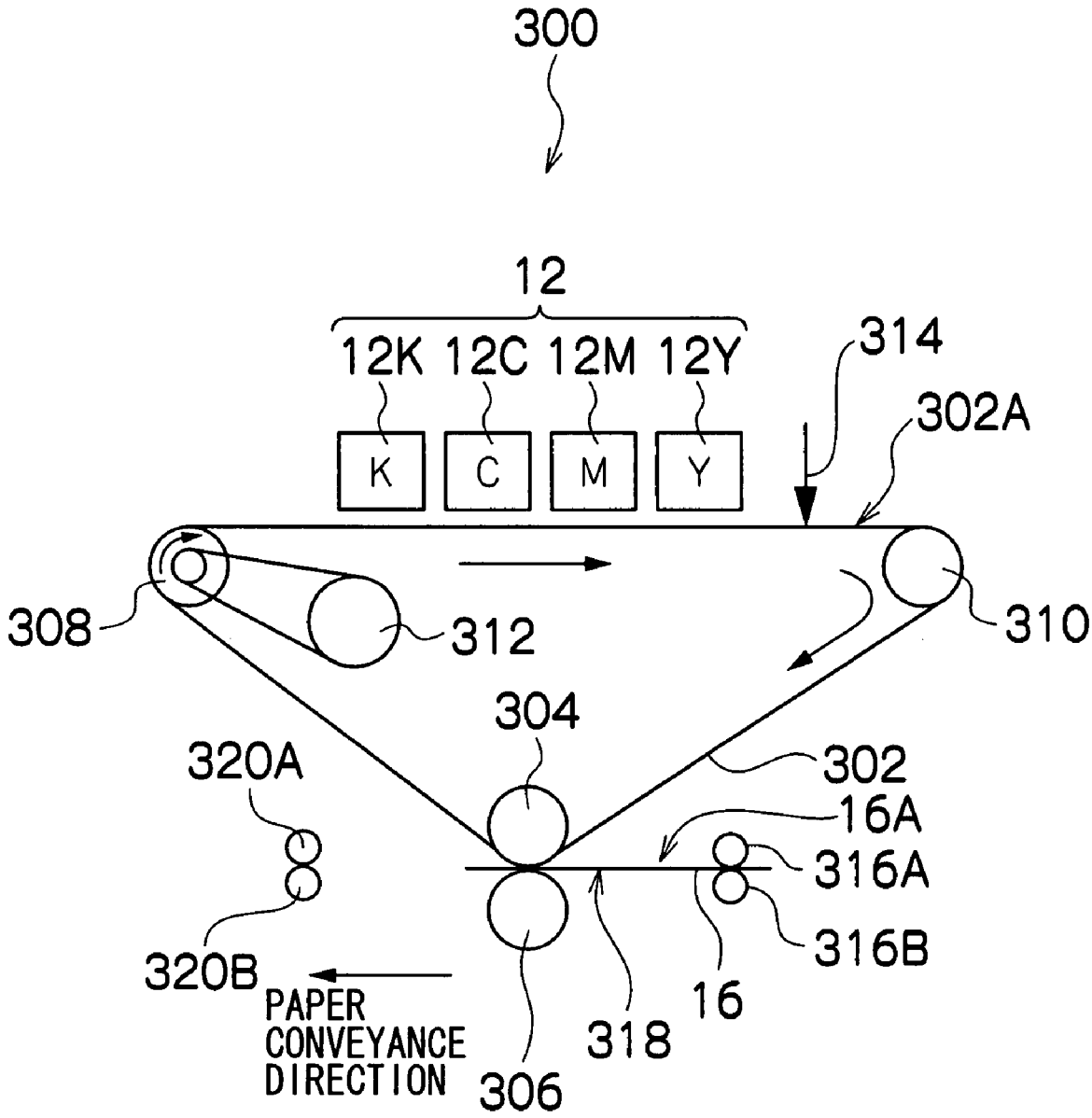
FIG. 24 is a basic schematic drawing of an inkjet recording apparatus according to a third embodiment of the present invention.
Figure 25:
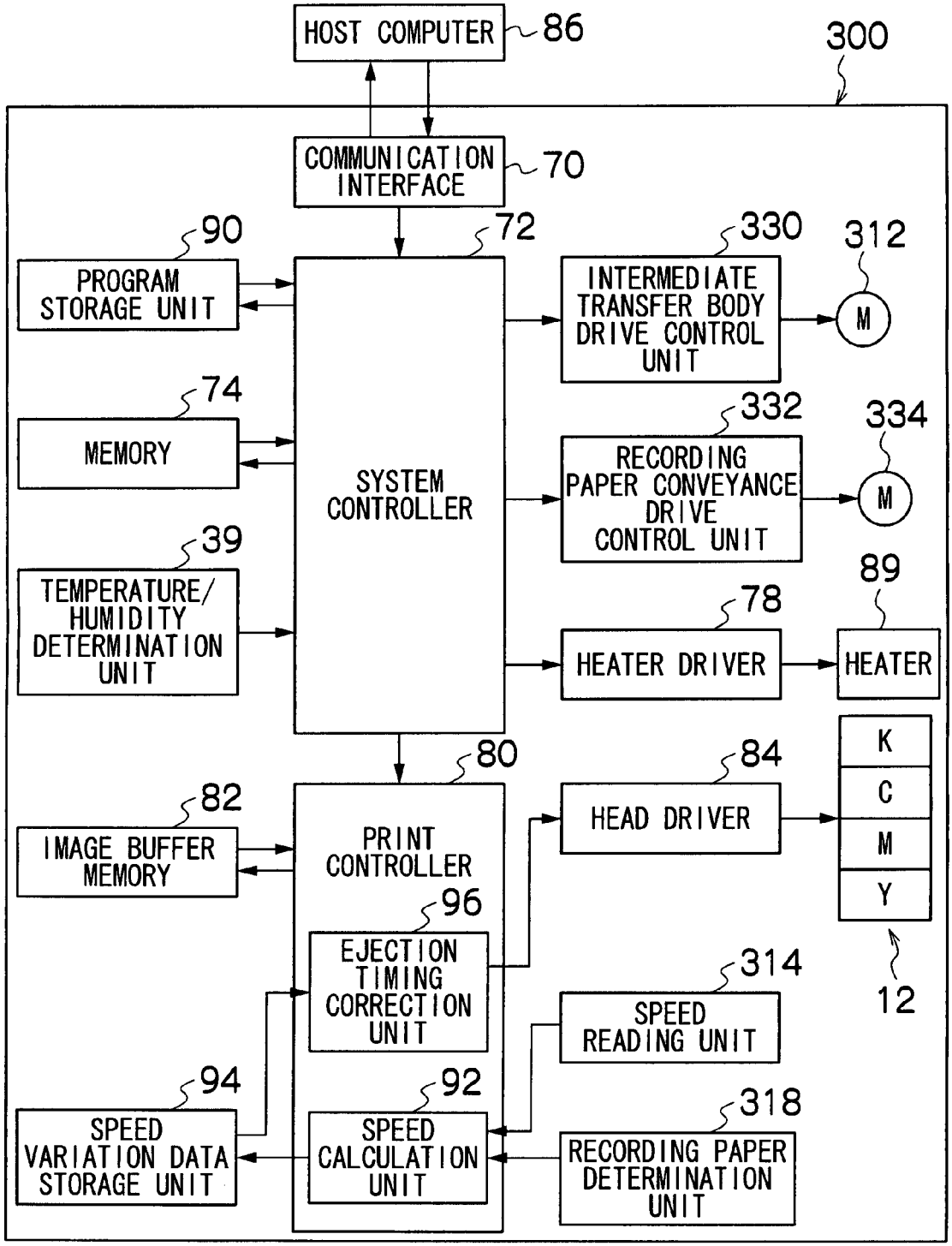
FIG. 25 is a block diagram showing the system configuration of the inkjet recording apparatus shown in FIG. 24.

Next, a third embodiment of the present invention is described below. FIG. 24 is a conceptual diagram showing the composition of the principal part of an inkjet recording apparatus 300 according to a third embodiment of the present invention, and FIG. 25 is a block diagram showing a general composition of a control system of the inkjet recording apparatus 300. Items of the present embodiment which are the same as or similar to those in the first and second embodiments described above are labeled with the same or similar reference numerals and description thereof is omitted here.

A so-called transfer method is used in the inkjet recording apparatus 300, as shown in FIG. 24. More specifically, an image is formed by ejecting ink onto an intermediate transfer body 302 from a recording unit 12, the image forming surface (image forming region) 302A of the intermediate transfer body 302 is placed in contact with the image recording surface 16A of the recording paper 16, and furthermore, the image formed on the intermediate transfer body 302 is transferred to a recording paper 16 by causing the intermediate transfer body 302 and the recording paper 16 to be pressed against each other by means of transfer rollers 304 and 306 while causing the recording paper 16 and the intermediate transfer body 302 to move in unison.

In the present embodiment, speed variation occurring in the intermediate transfer body 302 is determined while carrying out transfer to the recording paper 16 from the intermediate transfer body 302, and the ejection timing is corrected in accordance with the speed variation of the intermediate transfer body 302. In a mode where image recording onto the intermediate transfer body 302 is carried out, in order to improve productivity, while transferring an image from the intermediate transfer body 302 onto the recording paper 16, it is possible to prevent image degradation caused by speed variation of the intermediate transfer body occurring as a result of transfer, and therefore desirable image formation is achieved.

The intermediate transfer body 302 has a structure in which an endless belt is wound about rollers 308 and 310, and a transfer roller 304. When the drive roller 308 is caused to rotate in the clockwise direction by means of the motor 312, the intermediate transfer body 302 moves in the clockwise direction in synchronism with the rotation of the drive roller 308.

The recording unit 12 has a structure in which recording heads 12K, 12C, 12M and 12Y corresponding to inks of K, C, M and Y are aligned successively from the upstream side in terms of the direction of movement of the intermediate transfer body 302, and when the drive roller 308 is caused to rotate in the clockwise direction, the intermediate transfer body 302 moves from left to right in FIG. 24 through the recording region directly below the recording unit 12 (in the direction from the K ink recording head 12K to the Y ink recording head 12Y). A speed reading apparatus 314 which determines the movement speed of the intermediate transfer body 302 is provided on the downstream side of the recording unit 12 in terms of the direction of movement of the intermediate transfer body 302, and the speed information relating to the intermediate transfer body 302 obtained by the speed reading apparatus 314 is supplied to the control system (the print controller 80 in FIG. 25).

When an image is formed on the intermediate transfer body by means of ink ejected from the recording unit 12, the intermediate transfer body 302 is moved further and the image is moved into a transfer section which includes the transfer rollers 304 and 306. When the image arrives at the transfer section, the recording paper 16 is supplied to the transfer section by means of paper supply rollers 316A and 316B. A position determination sensor 318 which determines the position of the recording paper 16 is provided on the upstream side of the transfer unit in the paper conveyance direction, and the position determination sensor 318 determines whether or not there is a recording paper 16 present immediately before the transfer unit. When the image formed on the intermediate transfer body 302 has been transferred to the recording paper 16 by the transfer section, the recording paper 16 recorded with the image is then output by means of the paper output rollers 320A and 320B.

As shown in FIG. 25, the system controller 72 sends a control signal to the intermediate transfer body drive control unit 330 which controls the motor 312 forming the drive source of the intermediate transfer body 302. The intermediate transfer body drive control unit 330 controls the speed, and the like, of the intermediate transfer body 302 on the basis of the control signal sent by the system controller 72.

Similarly, the recording paper conveyance control unit 332 controls the drive motor 334 of the paper supply rollers 316A and 316B and the paper output rollers 320A and 320B, on the basis of the control signal sent by the system controller 72.

Furthermore, the output signal obtained from the speed reading apparatus 314 which determines the speed of the intermediate transfer body 302 is supplied to the speed calculation unit 92, which is a functional block of the print controller 80. Moreover, the output signal of the position determination sensor (recording medium determination unit) 318 which determines the position of the recording paper 16 is also supplied to the speed calculation unit 92.

In the speed calculation unit 92, the speed variation occurring in the intermediate transfer body 302 at the timing when the intermediate transfer body and the recording paper 16 receive the pressurized contact of the transfer rollers 304 and 306 is determined on the basis of the speed information relating to the intermediate transfer body 302 and the position information relating to the recording paper 16, and speed variation data is created accordingly. The speed variation data created by the speed calculation unit 92 is stored in the speed variation data storage unit 94, and the ejection timing correction unit 96 reads out this speed variation data, as and when necessary, and corrects the ejection timing accordingly.

Next, the correction of the ejection timing according to the third embodiment is described in detail below. Firstly, a test sheet of recording paper 16 is conveyed (recording paper conveyance step). The recording paper to be used for actual image recording (in other words, a recording paper with the same type and size) is used as the test recording paper 16.

The speed (speed variation) of the intermediate transfer body 302 when the test recording paper 16 and the intermediate transfer body 302 are pressed by the transfer rollers 308 and 310 is measured by the speed reading apparatus 314. The speed variation of the intermediate transfer body 302 is measured by determining a test pattern formed previously on the intermediate transfer body 302 (see FIG. 2), by means of a sensor (test pattern reading step), and then calculating speed variation data for the intermediate transfer body 302 on the basis of the determination result (speed variation data calculation step).

Furthermore, alternatively, a test pattern image may be formed on the intermediate transfer body by means of the recording unit 12 (see FIGS. 11A and 19), an imaging apparatus, such as a CCD sensor, is used as the speed reading apparatus 314, and an image of the test pattern image on the intermediate transfer body 302 is captured by the CCD sensor (test pattern reading step), speed variation data for the intermediate transfer body 302 being calculated on the basis of this imaging result (speed variation data calculation step).

In a mode where a test pattern image is formed by ejecting ink from the recording unit 12, a step for removing the test pattern becomes necessary, and therefore a desirable mode is one in which a test pattern is formed previously at a prescribed position on the intermediate transfer body 302.

In a so-called transfer method, as described in the present embodiment, since a conveyance belt for conveying the recording paper 16 is not necessary (the conveyance system for the recording paper 16 adopts a simplified composition shown in FIG. 24, including only paper supply rollers 316A and 316B, and paper output rollers 320A and 320B), then the speed variation occurring in the recording paper 16 when the recording paper 16 separates from the paper supply rollers 316A and 316B or when the recording paper 16 comes under pressurized contact from the paper output rollers 320A and 320B, is absorbed by deformation of the recording paper 16, and therefore it does not affect the speed variation of intermediate transfer body 302. Consequently, it is sufficient to consider only the speed variation occurring in the intermediate transfer body 302 when the recording paper 16 receives the pressurized contact of the transfer rollers 304 and 306, and when the recording paper 16 separates from the transfer rollers 304 and 306.

Since the conveyance distance from the transfer rollers 304 and 306 to the recording unit 12 is already known, then it is possible to predict the timing at which speed variation will occur in the intermediate transfer body 302, on the basis of the timing at which the recording paper 16 receives the pressurized contact of the transfer rollers 304 and 306, and the length of the recording paper 16.

The embodiments of the present invention described above related to an inkjet recording apparatus 10 which forms color images on a recording paper 16 by ejecting liquid ink droplets onto the recording paper 16, but the scope of application of the present invention is not limited to an inkjet recording apparatus, and it may also be applied to a liquid ejection apparatus which ejects other types of liquid, such as water, liquid chemicals, treatment liquid, and the like, from ejection holes (nozzles) provided in a head. Furthermore, it may also be applied to an image recording apparatus which forms a prescribed pattern by using a recording body such as resist, on a substrate.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image recording apparatus, comprising:

a recording device which deposits an image record substance on a recording medium;

a recording medium conveyance device which includes a conveyance medium having a recording medium hold region and conveying the recording medium with respect to the recording device in a conveyance direction while holding the recording medium on the recording medium hold region, the recording medium conveyance device being provided with a determination pattern which is formed outside the recording medium hold region on the conveyance medium and follows the conveyance direction;

a determination device which determines the determination pattern while the recording medium is held on the conveyance medium;

a calculation device which acquires speed variation data of the conveyance medium in accordance with determination results of the determination device;

a storage device which stores the speed variation data acquired by the calculation device; and a record timing correction device which corrects record timing of the recording device in accordance with the speed variation data of the conveyance medium stored in the storage device.

2. The image recording apparatus as defined in claim 1, further comprising:

a supply device which supplies the recording medium to the recording medium conveyance device; and an output device which outputs the recording medium from the recording medium conveyance device, wherein the determination device determines the determination pattern during a period including a time point when the recording medium comes out of contact with the supply device and a time point when the recording medium comes into contact with the output device.

3. The image recording apparatus as defined in claim 1, wherein the record timing correction device corrects the record timing of the recording device so as to eliminate an error based on difference between an actual conveyance amount of the conveyance medium and a theoretical conveyance amount of the conveyance medium.

4. The image recording apparatus as defined in claim 1, wherein the recording medium conveyed by the recording medium conveyance device when the determination pattern is determined by the determination device, has a type and a size identical to the recording medium used in actual image recording.

5. The image recording apparatus as defined in claim 1, wherein the determination pattern is formed by a photographic method.

6. The image recording apparatus as defined in claim 1, further comprising an environment conditions measurement device which measures environment conditions including at least one of temperature and humidity in a conveyance path of the recording medium, wherein:

the storage device stores the speed variation data in association with the environment conditions; and the record timing correction device corrects the record timing of the recording device by reading out the speed variation data corresponding to the environment conditions measured by the environment conditions measurement device, from the storage device.

7. An image recording apparatus, comprising:

a recording device which deposits an image record substance on a recording medium;

a recording medium conveyance device which conveys the recording medium with respect to the recording device in a conveyance direction while holding the recording medium;

a storage device which stores speed variation data of the recording medium acquired in accordance with determination results of a determination pattern composed of the image record substance deposited on the recording medium by the recording device; and a record timing correction device which corrects record timing of the recording device in accordance with the speed variation data of the recording medium stored in the storage device.

8. The image recording apparatus as defined in claim 7, further comprising a determination and calculation device which acquires the speed variation data of the recording medium to be stored in the storage device, the determination and calculation device including:

a determination unit which determines the determination pattern on the recording medium;

a movement unit which moves the recording medium on which the determination pattern is formed and the determination device relatively to each other; and a calculation unit which acquires the speed variation data of the recording medium in a state of being held on the recording medium conveyance device, in accordance with the determination results of the determination unit.

9. The image recording apparatus as defined in claim 8, further comprising:

a speed variation position calculation device which calculates a position on the recording medium corresponding to a timing at which the speed variation occurs, in accordance with a position of the recording device in a conveyance path of the recording medium; and a determination control device which controls the determination and calculation device in such a manner that the determination unit selectively determines the determination pattern at the position on the recording medium corresponding to the timing at which the speed variation occurs, in accordance with calculation results of the speed variation position calculation device.

10. The image recording apparatus as defined in claim 7, wherein the record timing correction device corrects the record timing of the recording device so as to eliminate an error based on difference between an actual conveyance amount of the recording medium and a theoretical conveyance amount of the recording medium.

11. The image recording apparatus as defined in claim 7, wherein the recording medium on which the determination pattern is formed by the recording device, has a type and a size identical to the recording medium used in actual image recording.

12. The image recording apparatus as defined in claim 7, further comprising:

a supply device which supplies the recording medium to the recording medium conveyance device; and an output device which outputs the recording medium from the recording medium conveyance device, wherein:

a length P of the recording medium in the conveyance direction, a distance $X_a$ between the output device and an end of the recording device on a side of the output device, and a distance $X_b$ between the supply device and an end of the recording device on a side of the supply device, have at least one of relationships of $P \geqq X_a$ and $P \geqq X_b$; and the determination pattern is formed on the recording medium throughout the length P of the recording medium.

13. The image recording apparatus as defined in claim 7, further comprising:

a supply device which supplies the recording medium to the recording medium conveyance device; and an output device which outputs the recording medium from the recording medium conveyance device, wherein:

at least one of following inequality expressions is satisfied:

$$Q<W+X_a, \text{ and}$$

$$Q<W+X_b,$$

where $X_a$ is a distance between the output device and an end of the recording device on a side of the output device, $X_b$ is a distance between the supply device and an end of the recording device on a side of the supply device, W is a length of the recording device in the conveyance direction, and Q is a distance between a leading end of a preceding recording medium and a leading end of a subsequent recording medium which is conveyed after the preceding recording medium when a plurality of recording media are conveyed consecutively; and the determination pattern is recorded on each of the plurality of recording media throughout the length of the recording media in the conveyance direction.

14. The image recording apparatus as defined in claim 7, further comprising:

a supply device which supplies the recording medium to the recording medium conveyance device; and an output device which outputs the recording medium from the recording medium conveyance device, wherein:

the determination pattern is formed on each of n pieces of recording medium throughout lengths of the n pieces of recording medium in the conveyance direction, in a case where the n pieces of recording medium are conveyed consecutively, n being a natural number not less than two; and at least one of following inequality expressions is satisfied:

$$R_n<W+X_a, \text{ and}$$

$$R_n<W+X_b,$$

where $X_a$ is a distance between the output device and an end of the recording device on a side of the output device, $X_b$ is a distance between the supply device and an end of the recording device on a side of the supply device, W is a length of the recording device in the conveyance direction, and $R_n$ is a distance between a leading end of a first recording medium to be conveyed first and a trailing end of a last recording medium to be conveyed last.

15. The image recording apparatus as defined in claim 7, further comprising:

a supply device which supplies the recording medium to the recording medium conveyance device; and an output device which outputs the recording medium from the recording medium conveyance device, wherein:

the determination pattern is formed on each of a first recording medium and a second recording medium following the first recording medium, throughout lengths of the first recording medium and the second recording medium; and following inequality expressions are satisfied:

$$P_1 \geqq X_a,\ P_2 \geqq X_a,\ P_1 \geqq X_b,\ P_2 \geqq X_b, \text{ and } P_1+P_2+P_d<X_a+X_b+W,$$

where $P_1$ is a length of the first recording medium in the conveyance direction, $P_2$ is a length of the second recording medium in the conveyance direction, $P_d$ is a distance between an end of the first recording medium on a side of the second recording medium and an end of the second recording medium on a side of the first recording medium, $X_a$ is a distance between the output device and an end of the recording device on a side of the output device, $X_b$ is a distance between the supply device and an end of the recording device on a side of the supply device, and W is a length of the recording device in the conveyance direction.

16. The image recording apparatus as defined in claim 7, wherein:

the recording device includes a plurality of recording heads which deposit different types of image record substances on the recording medium;

the recording medium is demarcated into a plurality of regions corresponding to the plurality of recording heads; and the determination patterns are respectively formed on the plurality of regions by the plurality of recording heads.

17. The image recording apparatus as defined in claim 7, further comprising an environment conditions measurement device which measures environment conditions including at least one of temperature and humidity in a conveyance path of the recording medium, wherein:

the storage device stores the speed variation data in association with the environment conditions; and the record timing correction device corrects the record timing of the recording device by reading out the speed variation data corresponding to the environment conditions measured by the environment conditions measurement device, from the storage device.

18. An image recording method for an image recording apparatus which includes: a recording device which deposits an image record substance on a recording medium; and a recording medium conveyance device which includes a conveyance medium having a recording medium hold region and conveying the recording medium with respect to the recording device in a conveyance direction while holding the recording medium on the recording medium hold region, the image recording method comprising the steps of:

determining a determination pattern which is formed outside the recording medium hold region on the conveyance medium and which follows the conveyance direction;

calculating speed variation data of the conveyance medium in accordance with determination results of the determination pattern;

storing the calculated speed variation data in a storage device;

reading the stored speed variation data of the conveyance medium from the storage device;

correcting record timing of the recording device in accordance with the read speed variation data; and recording an image on the recording medium with the recording device by depositing the image record substance on the recording medium according to the corrected record timing.

19. An image recording apparatus, comprising:

a recording device which deposits an image record substance on an intermediate transfer body;

a transfer device which transfers an image composed of the image record substance deposited on the intermediate transfer body to a recording medium by causing the intermediate transfer body and the recording medium to move relative to each other while causing the intermediate transfer body and the recording medium to be pressed against each other;

a determination device which determines a determination pattern composed of the image record substance on the intermediate transfer body deposited by the recording device;

a calculation device which acquires speed variation data of the intermediate transfer body in accordance with determination results acquired by the determination device;

a storage device which stores the speed variation data of the intermediate transfer body acquired by the calculation device; and a record timing correction device which corrects record timing of the recording device in accordance with the speed variation data of the intermediate transfer body stored in the storage device.

20. The image recording apparatus as defined in claim 19, wherein the recording device forms the determination pattern on the intermediate transfer body in a state where the intermediate transfer body and the recording medium are moved relatively to each other while being pressed against each other.

21. The image recording apparatus as defined in claim 19, wherein the record timing correction device corrects the record timing so as to eliminate an error based on difference between an actual conveyance amount of the intermediate transfer body and a theoretical conveyance amount of the intermediate transfer body.

22. The image recording apparatus as defined in claim 19, wherein the recording medium used when the determination pattern is recorded on the intermediate transfer body, has a type and a size identical to the recording medium used in actual image recording.

23. The image recording apparatus as defined in claim 19, further comprising an environment conditions measurement device which measures environment conditions including at least one of temperature and humidity in a conveyance path of the recording medium, wherein:

the storage device stores the speed variation data in association with the environment conditions; and the record timing correction device corrects the record timing of the recording device by reading out the speed variation data corresponding to the environment conditions measured by the environment conditions measurement device, from the storage device.

24. An image recording method for an image recording apparatus which includes: a recording device which deposits an image record substance on a recording medium; and a recording medium conveyance device which conveys the recording medium with respect to the recording device in a conveyance direction while holding the recording medium, the image recording method comprising the steps of:

determining a determination pattern composed of the image record substance which is deposited on the recording medium by the recording device;

calculating speed variation data of the recording medium in accordance with determination results of the determination pattern;

storing the calculated speed variation data in a storage device;

reading the stored speed variation data of the recording medium from the storage device;

correcting record timing of the recording device in accordance with the read speed variation data; and recording an image on the recording medium with the recording device by depositing the image record substance on the recording medium according to the corrected record timing.

25. An image recording method for an image recording apparatus which includes: a recording device which deposits an image record substance on an intermediate transfer body; and a transfer device which transfers an image composed of the image record substance deposited on the intermediate transfer body to a recording medium by causing the intermediate transfer body and the recording medium to move relative to each other while causing the intermediate transfer body and the recording medium to be pressed against each other, the image recording method comprising the steps of:

determining a determination pattern composed of the image record substance which is deposited on the intermediate transfer body by the recording device;

calculating speed variation data of the intermediate transfer body in accordance with determination results of the determination pattern;

storing the calculated speed variation data in a storage device;

reading the stored speed variation data of the intermediate transfer body from the storage device;

correcting record timing of the recording device in accordance with the read speed variation data;

recording the image on the intermediate transfer body with the recording device by depositing the image record substance on the intermediate transfer body according to the corrected record timing; and transferring the recorded image on the intermediate transfer body to a recording medium with the transfer device.

* * * * *